US005797074A

United States Patent [19]

Kasahara et al.

[11] Patent Number: 5,797,074

[45] Date of Patent: Aug. 18, 1998

[54] IMAGE FORMING SYSTEM

[75] Inventors: Nobuo Kasahara, Yokohama; Satoshi Muramatsu; Hiroyuki Shibaki, both of Kawasaki, all of Japan

[73] Assignee: Ricoh Company, Ltd., Tokyo, Japan

[21] Appl. No.: 632,119

[22] Filed: Apr. 15, 1996

[30] Foreign Application Priority Data

| | | | |
|---|---|---|---|
| Apr. 14, 1995 | [JP] | Japan | 7-089697 |
| Apr. 26, 1995 | [JP] | Japan | 7-101807 |
| Aug. 7, 1995 | [JP] | Japan | 7-201022 |
| Nov. 15, 1995 | [JP] | Japan | 7-296777 |
| Mar. 26, 1996 | [JP] | Japan | 8-069909 |

[51] Int. Cl.[6] ..... G03G 15/08

[52] U.S. Cl. ..... 399/262; 399/27; 399/119; 399/258; 399/260

[58] Field of Search ..... 399/119, 120, 399/258, 260, 264, 257, 27, 30, 58, 262, 8; 347/43, 86; 222/DIG. 1

[56] References Cited

U.S. PATENT DOCUMENTS

| | | | |
|---|---|---|---|
| 3,244,325 | 4/1966 | Lindquist | 222/DIG. 1 |
| 3,973,699 | 8/1976 | Cook | 222/DIG. 1 |
| 4,358,196 | 11/1982 | Mugrauer | 399/258 X |
| 4,432,005 | 2/1984 | Duffield et al. | 347/86 |
| 4,640,605 | 2/1987 | Ariyama et al. | 399/257 X |
| 5,283,617 | 2/1994 | Benedict et al. | 399/264 |
| 5,311,260 | 5/1994 | Nakakuma et al. | 399/258 X |
| 5,329,340 | 7/1994 | Fukuchi et al. | 399/260 X |
| 5,363,178 | 11/1994 | Matsumoto | 399/299 |
| 5,379,094 | 1/1995 | Wing et al. | 399/264 |
| 5,537,197 | 7/1996 | Fujishiro et al. | 399/262 X |
| 5,561,506 | 10/1996 | Kasahara | 222/DIG. 1 |
| 5,587,730 | 12/1996 | Karz | 347/43 |

FOREIGN PATENT DOCUMENTS

| | | |
|---|---|---|
| 63-137256 | 6/1988 | Japan . |
| 2-293769 | 12/1990 | Japan . |
| 3-501296 | 3/1991 | Japan . |
| 3-62062 | 3/1991 | Japan . |
| 4-9082 | 1/1992 | Japan . |
| 6-222669 | 8/1994 | Japan . |
| 7-10101 | 1/1995 | Japan . |
| 7-219329 | 8/1995 | Japan . |
| 7-225515 | 8/1995 | Japan . |

*Primary Examiner*—Matthew S. Smith

*Attorney, Agent, or Firm*—Oblon, Spivak, McClelland, Maier & Neustadt, P.C.

[57] ABSTRACT

An image forming system including a plurality of image forming apparatuses is disclosed. The image forming apparatuses is of the type electrostatically forming a latent image representative of a document on an image carrier, developing it with a developing device, and transferring the resulting image to a recording medium. A single developer source is included in the system and delivers a developer to all the image forming apparatuses. The shared developer source reduces the space to be occupied by the individual image forming apparatus and insures high operation efficiency and maintenance efficiency.

32 Claims, 35 Drawing Sheets

IMAGE FORMING SYSTEM

BACKGROUND OF THE INVENTION

1. Field of the Invention

The present invention relates to an image forming system and, more particularly, to a mechanism for replenishing and collecting a developer for image formation.

2. Discussion of the Background

An electrophotographic copying system belongs to a family of image forming systems and is generally implemented as a copier, printer, facsimile apparatus or similar image forming apparatus. The copying system uniformly charges a photoconductive drum or similar image carrier, electrostatically forms a latent image on the charged drum by exposure or optical writing, develops the latent image with a developer, and then transfers the developed image to a recording medium. The developer is either a two-ingredient type developer or toner and carrier mixture or a single-ingredient type developer or toner. As the image formation is repeated, the developer is sequentially consumed and has its toner concentration reduced. Specifically, as for the two-ingredient type developer, the amount of toner or toner concentration decreases and prevents a desired image density from being attained. It is a common practice to replenish fresh toner when the toner concentration of the developer decreases, thereby maintaining the toner concentration constant.

A toner replenishing section is included in a developing device and stores a preselected amount of fresh toner. The fresh toner is replenished into the developer in accordance with the varying toner concentration of the developer. The problem with the state-of-the-art developing device is that the replenishing section is limited in size in order to miniaturize the developing device. For example, when the replenishing section runs out of the fresh toner, the replenishing section is bodily removed from the developing unit and replaced.

In the event of replacement of the replenishing section, the operation of the image forming apparatus must be interrupted and then resumed, wasting much time. To reduce the duration of interruption, a toner storing section having a relatively great capacity may be connected to a developing unit, as taught in Japanese Patent Laid-Open Publication No. 61-188564 by way of example. The toner storing section supplies toner to a replenishing section on the basis of the toner remaining in the replenishing section. In this configuration, the replenishing section and a developing section are communicated to each other by a pipe. A coil screw is disposed in the pipe so as to convey the toner toward the developing section. The coil screw may be replaced with an arrangement for causing the toner to drop into the developing section due to gravity or with compressed air, as disclosed in, e.g., Japanese Patent Application No. 7-165442. Further, the toner storing section may be constructed independently of the developing device and located outside of the image forming apparatus, as proposed in Japanese Patent Laid-Open Publication No. 198966 by way of example. In this case, the toner storing section is connected to the developing device by a pipe or similar connecting member accommodating a screw therein.

The image forming apparatus further includes a cleaning device for removing the toner left on the image carrier after image transfer. The cleaning device has a cleaning blade contacting the surface of the image carrier so as to scrape off the remaining toner.

To promote the effective use of limited resources, there is an increasing demand for an implementation for recycling the toner, i.e., a mechanism for returning the toner collected in the cleaning device to the toner replenishing section. In a specific mechanism, the cleaning device is formed with an outlet for delivering the collected toner and connected to the toner storing section or the developing device by a pipe accommodating a screw. In another specific mechanism, a collected toner storing section is located in the vicinity of the toner outlet of the cleaning device and receives the collected toner dropping due mainly to gravity.

However, the above conventional mechanisms are directly added to the developing device. As a result, the space to be occupied by the developing section in the apparatus increases to, in turn, increase the overall size of the apparatus while complicating the construction. The bulky and complicated apparatus brings about a problem as to the space for installation, maintenance including the replacement of the toner storing section, and duration of interruption of operation ascribable to maintenance. This is particularly true when a plurality of image forming apparatuses are taken into account. Specifically, the duration of interruption of operation is proportional to the period of time necessary for maintenance. Therefore, if the toner storing section to be maintained is of a large size, then it increases time and labor accordingly and thereby lowers the operation ratio for image formation.

Assume that the toner present in the toner storing section is subjected to an excessive driving force in the event of replenishment. Then, the toner is apt to generate heat due to a heavy mechanical stress. Particularly, when the force compressing the particles of the toner is intense, it causes the particles to cohere due to compression heat. This phenomenon, generally referred to as toner blocking, deteriorates the conveyance of the toner. In addition, it is likely that the toner has its particles crushed and its charge reduced. As a result, the toner fails to have a characteristic adequate for the developing device.

In the arrangement wherein the toner is supplied or collected by the pipe and screw accommodated therein, it is necessary that the distance over which the screw conveys the toner be as short as possible. Should the distance be great, the screw would require a heavy torque and would thereby increase the size of the device including a drive section. Another prerequisite is that the toner transport path be as straight as possible or be provided with a radius of curvature close to a straight line so as to insure the transport. This limits the location of the transport path and the conditions for installation. Moreover, when the toner is collected from the cleaning device, it is necessary that the position for storing the collected toner be lower in level than the toner outlet of the cleaning device; if the toner is easier to drop, it will be collected more smoothly. As a result, even the configuration of the toner storing section is limited, obstructing the effective use of the space available in the apparatus.

With the toner collection schemes, it is preferable that the toner be collected in a great amount and returned to the developing unit a minimum number of times, thereby reducing time and labor for maintenance. This, however, cannot be done unless the toner storing section has a great capacity directly translating into a bulky image forming apparatus. Moreover, when the toner storing section and image forming apparatus are each situated at a different location, they, including the transport path extending therebetween, must be maintained independently of each other. Consequently, the operation for supplying and collecting toner is not efficient.

A member for storing the collected toner is, in many cases, disposable and simply functions to supply the collected toner to the replenishing section. This increases the costs for production and storage and requires a new storing member to be prepared at each time of maintenance. The result is the need for stock management and additional production for stock. The above member is therefore not efficient in the cost and operation aspect.

Technologies relating to the present invention are taught in, e.g., Japanese Patent Laid-Open Publication Nos. 63-137256, 2-293769, 3-62062, 4-9082, 7-10101, 7-219329, 7-225515 and 6-222669 as well as in Japanese Patent Publication (Kohyo) No. 3-501296.

SUMMARY OF THE INVENTION

It is therefore an object of the present invention to provide an image forming system capable of preventing the space to be occupied by an image forming apparatus from increasing, and preventing the operation ratio and maintenance efficiency from falling.

It is another object of the present invention to provide an image forming system capable of preventing the operation ratio from falling when a plurality of image forming apparatuses are used.

It is another object of the present invention to provide an image forming system capable of collecting an unused developer after development without increasing the space to be occupied by an image forming apparatus.

In accordance with the present invention, an image forming system has a plurality of image forming apparatuses each for electrostatically forming a latent image representative of a document image on an image carrier, developing the latent image with a developer stored in a developing device, and transferring the resulting developed image to a recording medium. A single developer source supplies the developer to the developing devices of all of the plurality of image forming apparatuses.

Also, in accodance with the present invention, an image forming system has a plurality of image forming apparatuses each for developing a latent image electrostatically formed on an image carrier with a developer, transferring the resulting developed image to a recording medium and fixing the developed image on the recording medium. A single developer storage and circulation device supplies and collects the developer from the plurality of image forming apparatuses for thereby circulating the developer.

Further, in accordance with the present invention, an image forming system has an image forming apparatus for developing a latent image electrostatically formed on an image carrier with a developer stored in a developing device, and transferring the resulting developed image to a recording medium. A developer supply device is constructed independently of the image forming apparatus and supplies the developer to the developing device. A developer collecting device collects a residual developer removed from the image carrier after image transfer.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
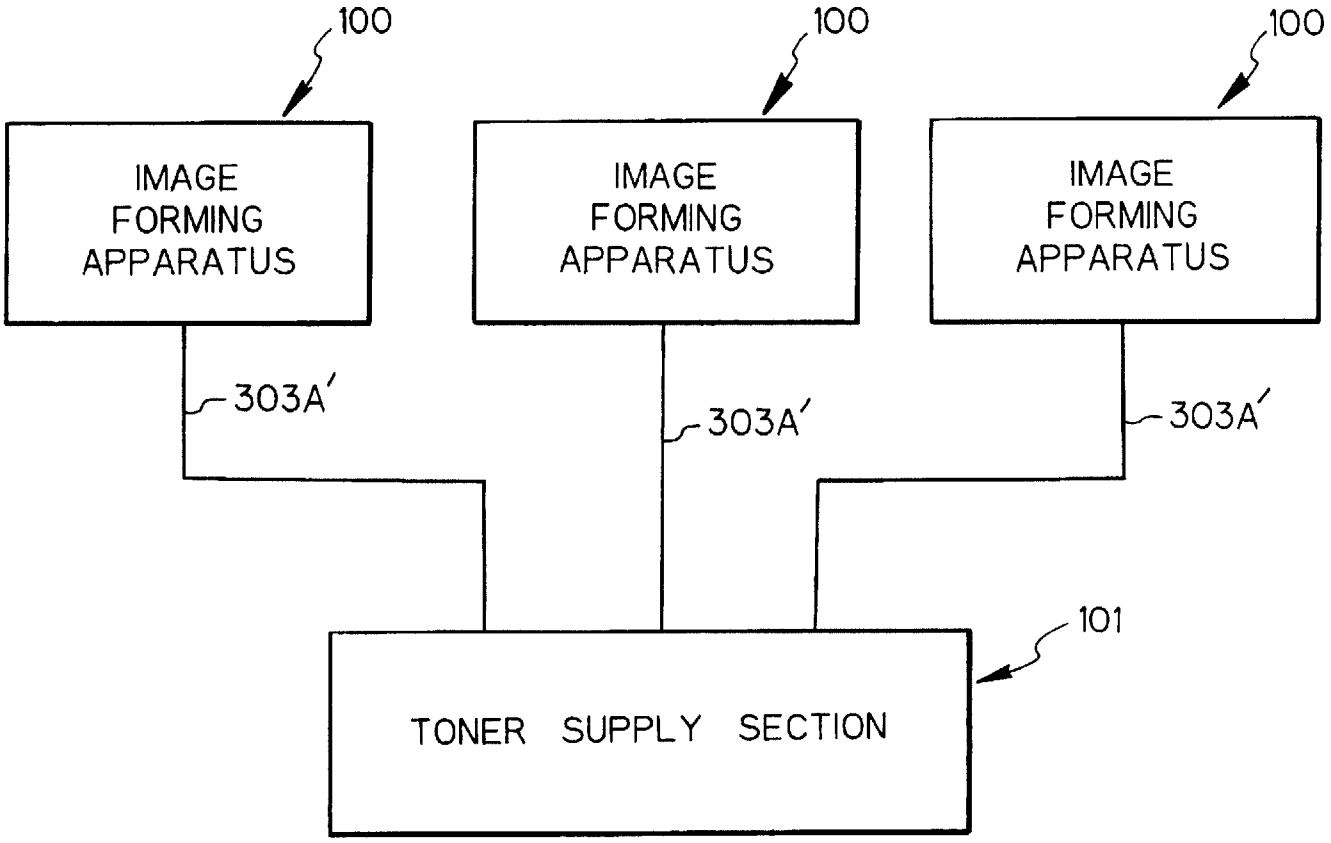
FIG. 1 is a block diagram schematically showing an image forming system embodying the present invention.

Referring to FIG. 1 of the drawings, an image forming system embodying the present invention is schematically shown. As shown, the system has a plurality of image forming apparatuses 100 and a single toner supply section 101 shared by the apparatuses 100. The toner supply section 101 is representative of a developer source for the centralized control of toner supply to developing devices included in the apparatuses 100.

Figure 2:
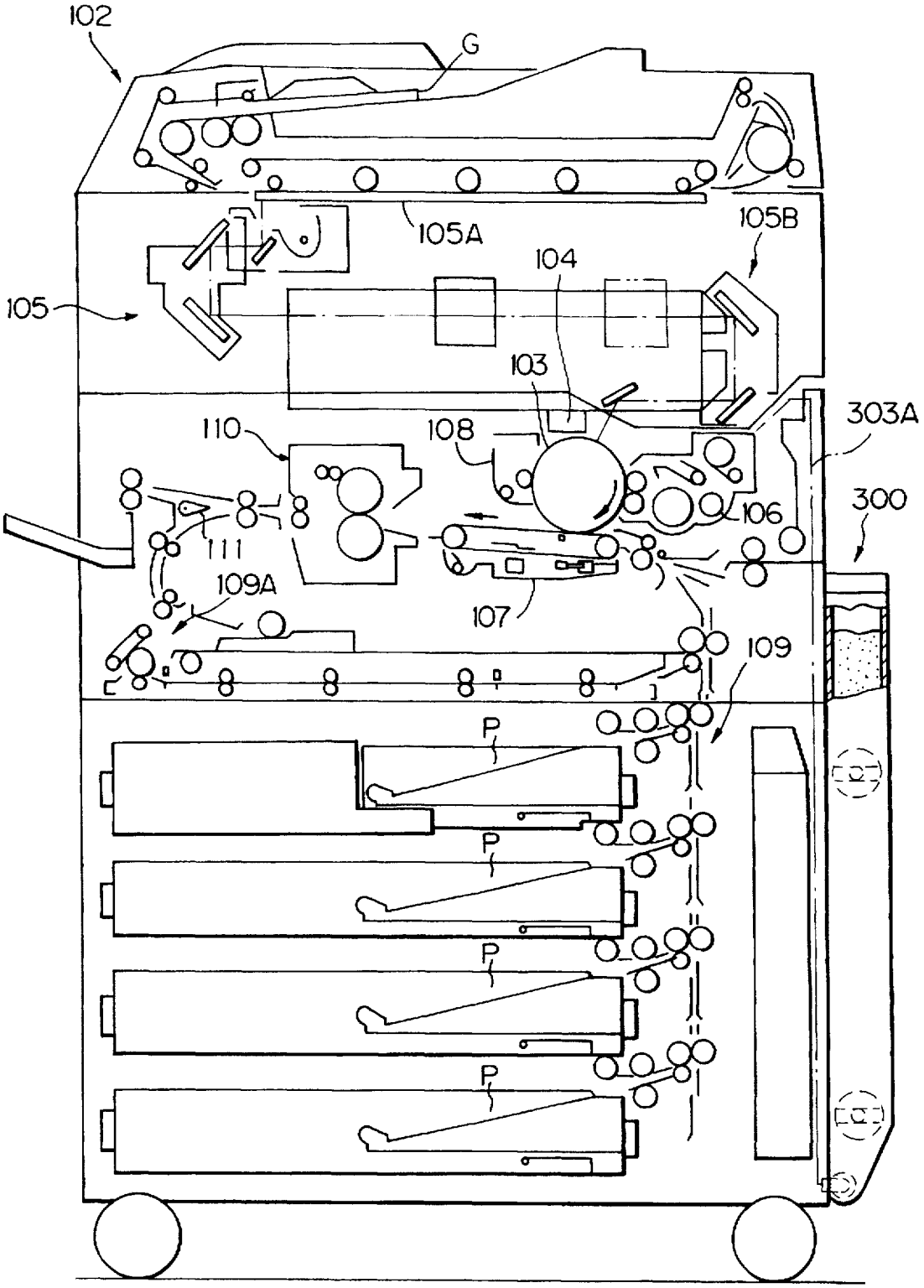
FIG. 2 is a section of an image forming apparatus applicable to the system of FIG. 1 and implemented as a copier by way of example.

The apparatuses 100 are each implemented as an electrophotographic copier by way of example, as shown in FIG. 2. As shown, the copier, generally 102, has a photoconductive element in the form of a drum 103. A charger 104, optics 105 for exposure, a developing device 106, an image transfer and transport device 107 and a cleaning device 108 are sequentially arranged around the drum 103 in the direction in which the drum 103 rotates (indicated by an arrow in FIG. 2).

A document is positioned on a glass platen 105A mounted on the top of the copier 102. The optics 105 has an optical exposing mechanism 105B including a light source for illuminating the document, mirrors, and a lens. The mechanism 105B electrostatically forms a latent image representative of the document on the drum 103. The developing device 106 develops the latent image. The developed image is electrostatically transferred from the drum 103 to a paper or similar recording medium P fed from a paper feed device 109. The paper P carrying the image thereon is conveyed to a fixing device 110 adjoining the image transfer and transport device 107. After the image has been fixed on the paper P by the fixing device 110, the paper P is driven out of the copier 102. The paper feed device 109 has a plurality of cassettes each being loaded with papers of particular size. Papers of desired size are sequentially fed from one of the cassettes.

The copier 102 has a mechanism for forming images on both sides of the paper P in a duplex copy mode. Specifically, a path selector or pawl 111 is located downstream of the fixing unit 110 in the direction in which the paper P is transferred from the transport device 107 to the fixing device 110 (indicated by an arrow in FIG. 2). The path selector 111 selects either a path leading to the outside of the copier 102 or a turn-over path 109A assigned to the duplex copy mode. When the selector 111 selects the turn-over path 109A, the paper P is again brought to the drum 103 via the path 109A.

Figure 3:
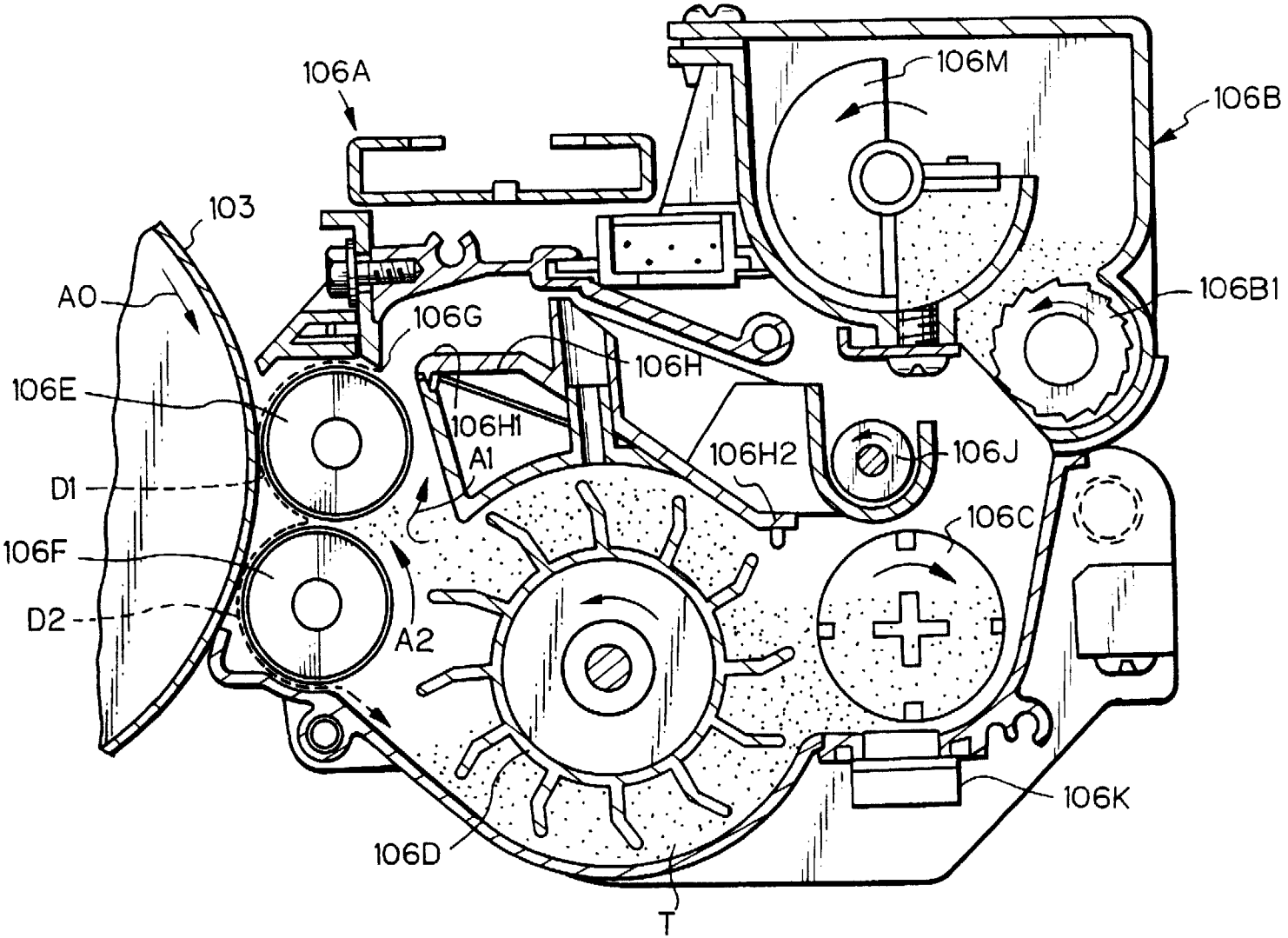
FIG. 3 is a section showing a specific configuration of a developing device included in the apparatus of FIG. 2.

FIG. 3 shows the developing device 107 in detail. The developing device 107 is operable with a two-ingredient type developer, i.e., a mixture of magnetic toner and magnetic carrier. Fresh toner is fed from the toner supply section 101, FIG. 1, to the developing device 106. As shown, the device 107 is generally made up of a casing or developing section 106A and a toner replenishing section 106B. The casing 106A adjoins the drum 103 which is rotatable in the direction indicated by an arrow AO. The toner replenishing section 106B is mounted on the casing 106A.

An agitator roller 106C and a paddle wheel 106D are disposed in the casing 106A. The agitator roller 106C charges the toner and carrier to opposite polarities by agitating and mixing them together. The paddle wheel 106D scoops up the charged toner and carrier, i.e., developer. A toner supply roller 106B1 is positioned in the toner supply section 106B. When the toner concentration of the developer existing in the casing 106A decreases, the roller 106B1 is rotated in the direction indicated by an arrow so as to drive fresh toner T toward the agitator roller 106C. It is to be noted that the magnetic toner T may be replaced with nonmagnetic toner.

A pair of developing rollers 106E and 106F are respectively positioned at the upstream side and downstream side in the direction of rotation AO of the drum 103 in the vicinity of the paddle wheel 106D. The developing rollers 106E and 106F each has a sleeve rotatable counterclockwise as viewed in FIG. 3, and a magnet roller fixed in place within the sleeve. The sleeve is formed of aluminum, stainless steel or similar nonmagnetic material. The magnet roller has a plurality of magnetic poles arranged in the circumferential direction thereof. The poles may be implemented by ferrite magnets, rubber magnets or a mixture of nylon powder and ferrite powder.

A doctor blade 106G is located at a position preceding a position where a given point on the periphery of the developing roller 106E faces the drum 103. The doctor blade 106G formed of metal serves to regulate the thickness of a magnet brush formed on the developing roller 106E. A separator 106H adjoins the doctor blade 106G. Specifically, the separator 106H adjoins the doctor blade 106G at one end 106H1 of its extension and overlies the agitator roller 106C at the other end 106H2 of the extension. A rotatable screw 106J is positioned at the end 106H2 of the separator 106H.

The paddle wheel 106D in rotation scoops up the developer and releases it toward the developing roller 106E due to a centrifugal force. A part of the developer is directly fed to the roller 106E and deposited thereon, as indicated by an arrow A1 in FIG. 3. The rest of the developer partly impinges on the other developing roller 106F, rebounds, and then deposits on the developing roller 106E due to the magnetic force of the roller 106E. To feed the developer to the roller 106E from the roller 106F, it is necessary to increase the amount in which the developer rebounds away from the roller 106F. This can be done if the paddle wheel 106D is rotated at a relatively high speed in order to increase the centrifugal force.

The sleeve of the developing roller 106E in rotation conveys the developer to a first developing region D1 where the roller 106E faces the drum 103. At this instant, the doctor blade 106G regulates the thickness of the developer on the roller 106E. The developer reaching the region D1 is moved to a position where the magnetic force of the roller 106E is weak. As a result, the developer is transferred to a second developing region D2 where the roller 106F faces the drum 103, as indicated by a phantom line in FIG. 3. This is ascribable to the rotation of the sleeve of the roller 106F and the magnetic force of the magnet roller of the roller 106F. Then, the developer is moved away from the region D2 to a position where the magnetic force of the roller 106F does not act. Consequently, the developer is let to fall onto the bottom of the casing 106A and is again agitated by the paddle wheel 106D.

The developer scraped off by the doctor blade 106G is guided by the separator 106H toward the screw 106J located at the end 106H2 of the separator 106H. The screw 106J in rotation causes the developer to drop onto the agitator roller 106C. For this purpose, the end 106H2 is formed with a slot facing the agitator roller 106C.

The magnet rollers of the developing rollers 106E and 106F are configured such that a repulsive electric field due to the magnetic poles of the same polarity is formed at the position where the rollers 106E and 106F are closest to each other. In this condition, the developer moved away from the developing region D1 is handed over from the roller 106E to the roller 106F due to the above electric field.

A toner concentration sensor 106K is mounted on the casing 106A in the vicinity of the agitator roller 106. The sensor or toner concentration sensing means 106K is responsive to the toner concentration, i.e., toner and carrier mixture ratio of the developer. In the illustrative embodiment, a coil is disposed in the developer in the casing 106A, so that the sensor 106K senses the toner concentration of the developer on the basis of a change in the inductance of the coil.

Figure 4:
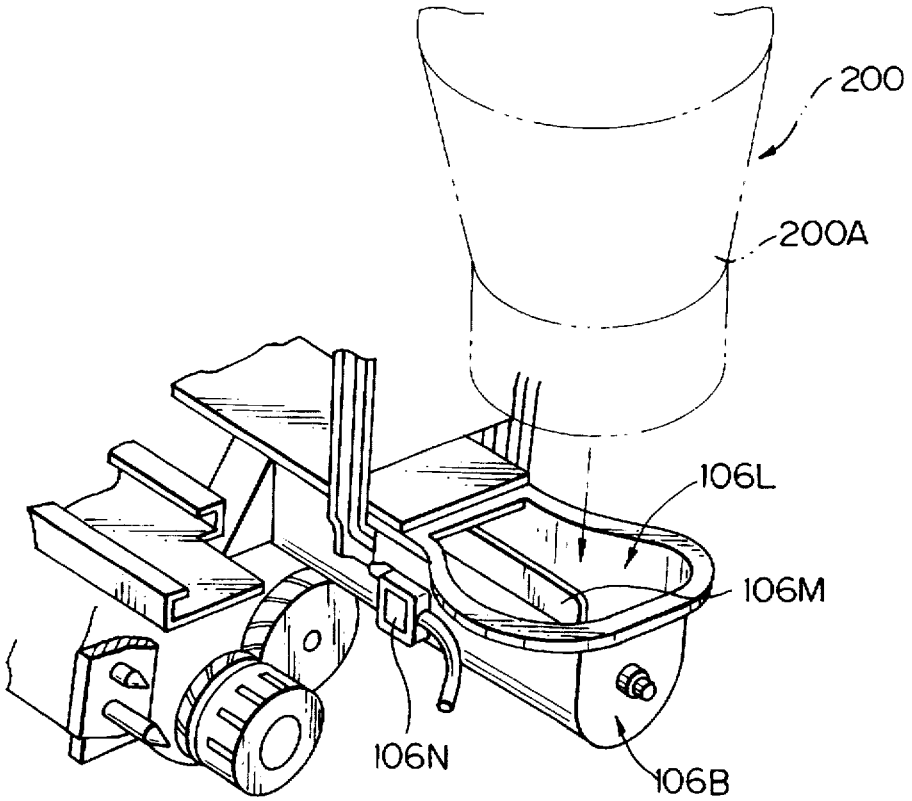
FIG. 4 is a perspective view showing a developer replenishing section included in the developing device of FIG. 3.

A part of the toner replenishing section 106B is positioned outside of the copier 102. This part corresponds to one axial end of an agitator 106M disposed in the section 106B. As shown in FIG. 4, a toner supply opening 106L is formed in the above part of the section 106B. Toner supplying means 200, which will be described, has a toner/air separating portion 200A to be removably mounted to the opening 106L.

As shown in FIG. 4, a piezoelectric pressure sensor 106N senses the amount of toner existing in the replenishing section 106B in terms of the packing pressure of toner in the section 106B. When the sensor 106N does not sense any pressure, it is determined that the amount of toner in the section 106B is short. Because the replenishing section 106B is partly positioned outside of the copier 102, the structural parts relating to the toner replenishment of the developing device 106 occupy a minimum of height within the copier 102.

FIGS. 5–8 show the toner supplying means 200 including the toner/air separating portion 200A in detail. As shown, the supplying means 200 is implemented as a unit independent of the developing device 106 and is used to supply toner to the replenishing section 106B.

Figure 5:
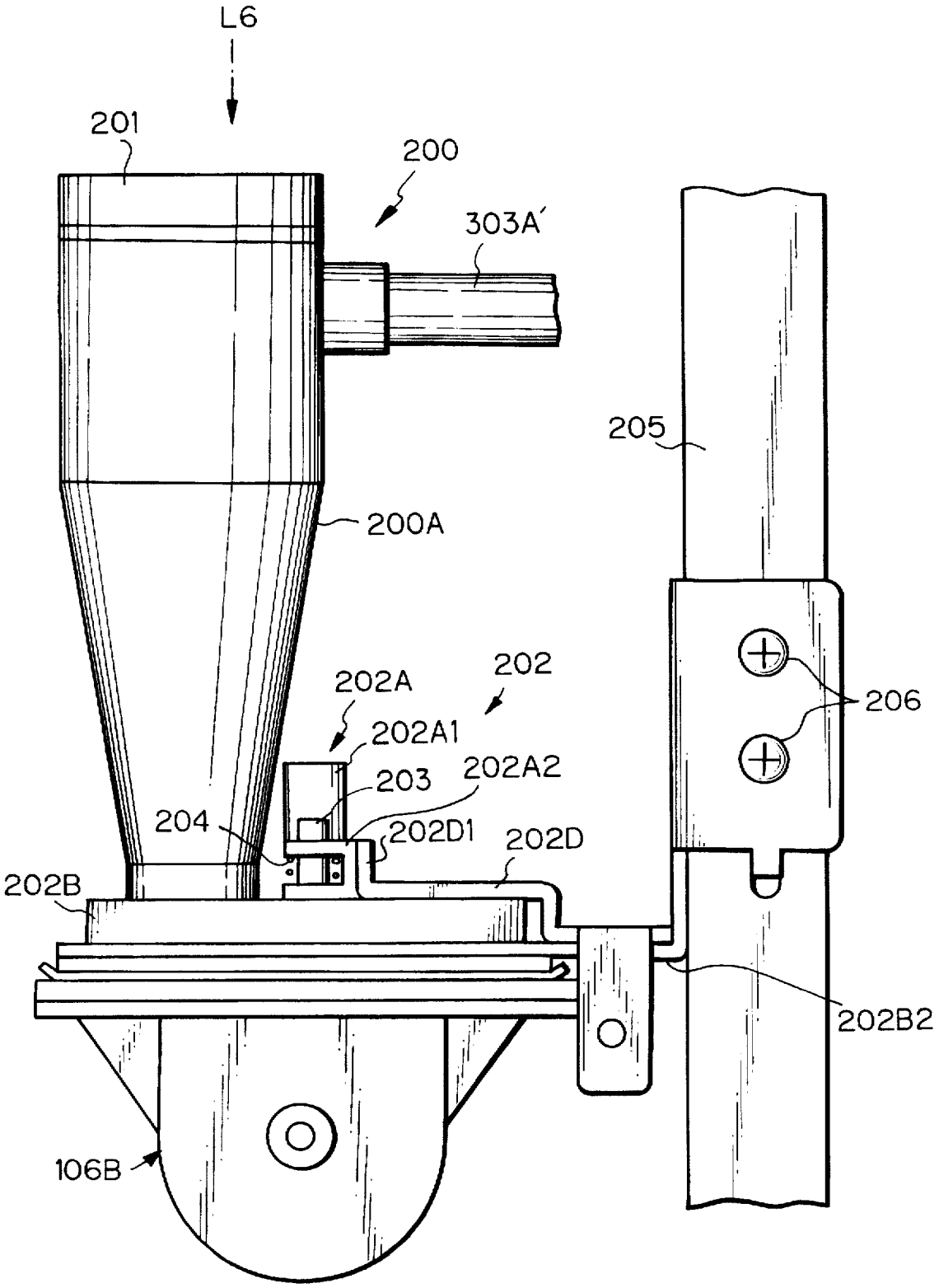
FIG. 5 is an external view of toner supplying means corresponding to a developer replenishing section included in the developing device of FIG. 3.

As shown in FIG. 5, the toner/air separating portion 200A is implemented as a funnel-like hopper. The hopper 200A separates toner and air fed under pressure from a toner source which will be described, and causes only the toner to drop into the replenishing section 106B due to gravity by a so-called cyclone system.

Figure 7:
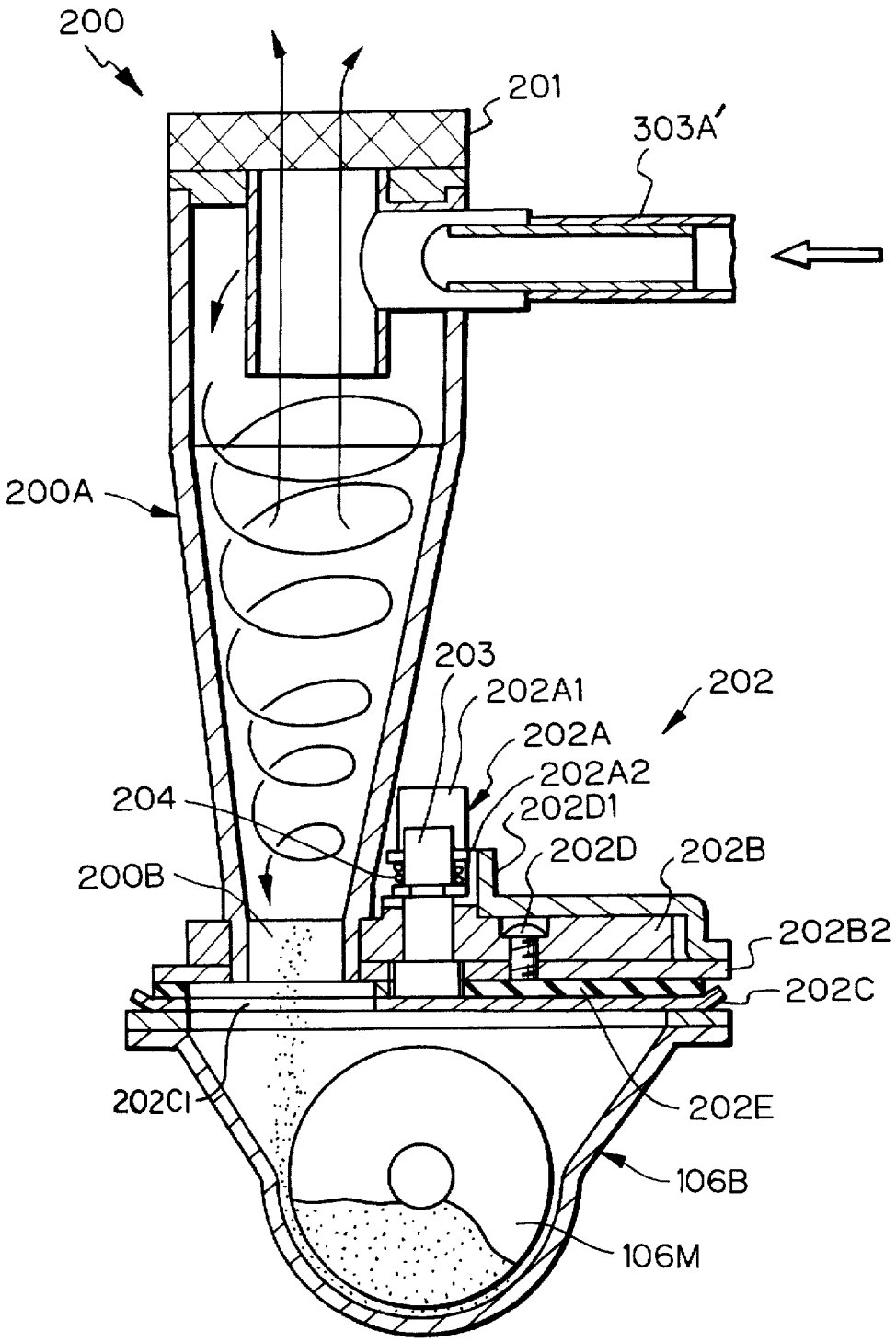
FIG. 7 is a section of the toner supplying means of FIG. 5.

An auxiliary pipe 303A' (see FIG. 5) is connected at one end thereof to the upper portion of the toner/air separating portion 200A at a position eccentric to the center, as viewed in a cross-section. As shown in FIG. 7, an opening 200B is formed in the bottom of the separating portion 200A and communicatable to the opening 106B. In this configuration, a toner and air mixture under pressure flows into the separating portion 200A from the pipe 303A'. On imping on the inner wall of the separating portion 200A, the mixture sequentially drops while whirling round due to the configuration of the portion 200A and the unique position of the outlet of the pipe 303A', as indicated by an arrow in FIG. 7. Air having a small specific gravity rises while the toner having a great specific gravity drops. As a result, the toner is separated from air.

As shown in FIG. 7, a filter 201 is fitted on the upper end of the separating portion 200A in order to discharge only air separated from the toner. Opening/closing means 202 is positioned at the lower end of the separating portion 200A in order to selectively open or close the opening 200B. Because air is discharged to the outside via the filter 201 in a depressurized state, the toner is prevented from being entrained by air.

Figure 8:
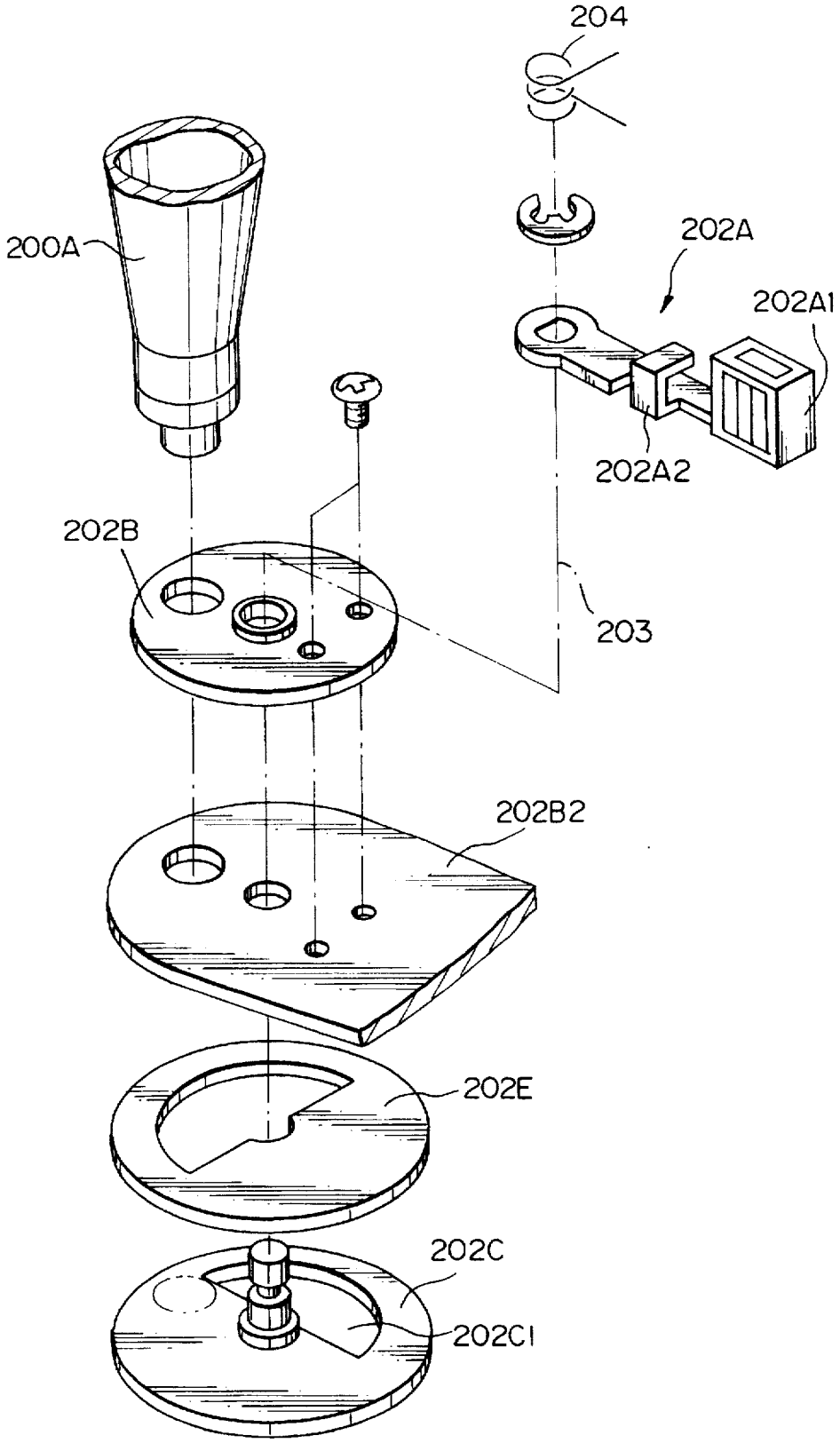
FIG. 8 is an exploded perspective view showing an opening/closing member included in the toner supplying means of FIG. 5.

The opening/closing means 202 has a locking member 202A, a toner supplying means support member 202B, a shutter member 202C, and a stop member 202D. As shown in FIGS. 7 and 8, the locking member 202A is bodily rotatable about a shaft 203. A knob 202A1 is fitted on the end of the member 202A remote from the shaft 203. A generally U-shaped locking portion 202A2 extends out from the member 202A intermediate between the shaft 203 and the knob 202A1. A spiral spring 204 is wound round the shaft 203 and anchored to the locking portion 202A2 at its one end. In FIG. 7, the other end of the spring 204 abuts against the outer wall of the separating portion 200A. Therefore, the locking portion 202A is constantly biased clockwise, as viewed in FIG. 6, to abut against an abutment 202D1 included in the stop member 202D.

Figure 6:
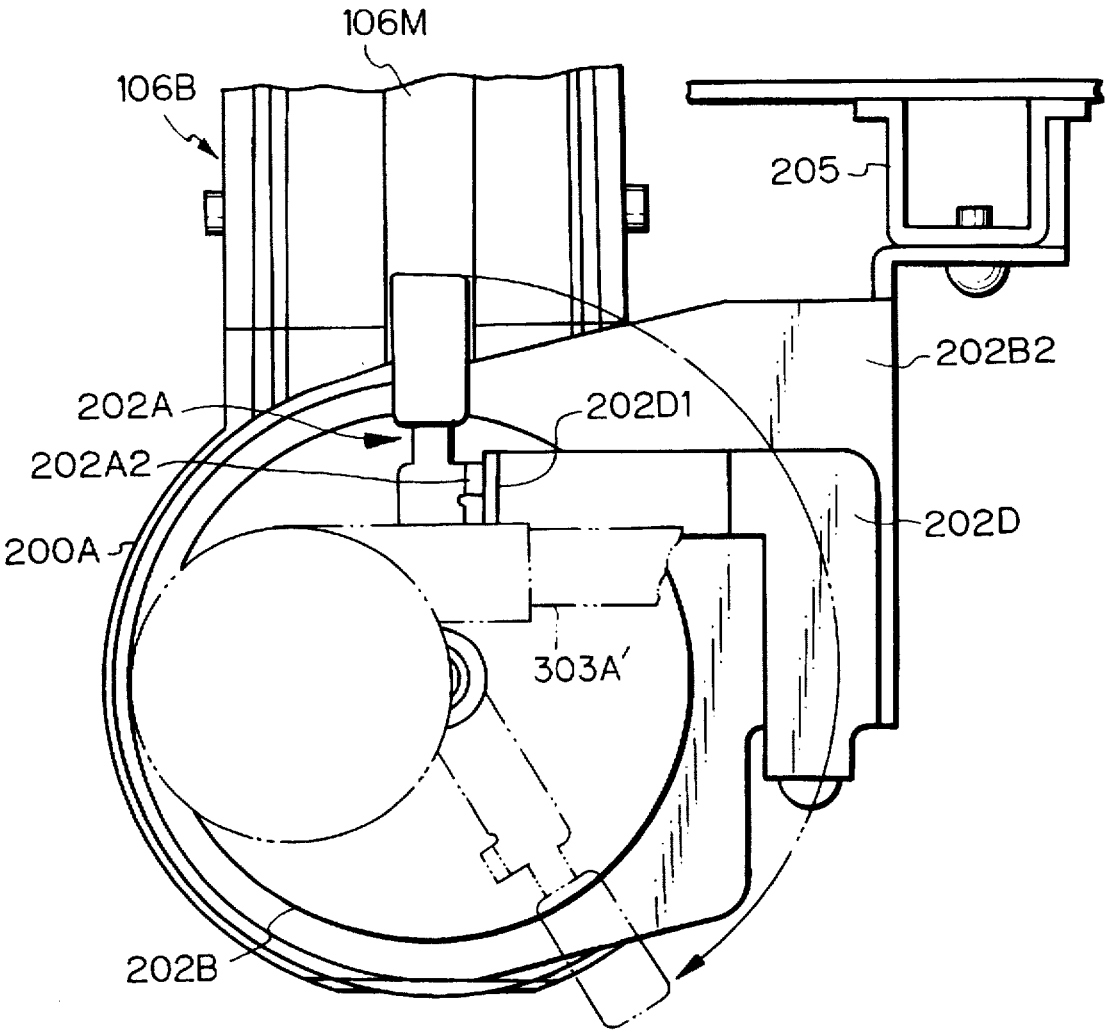
FIG. 6 is a section as seen in a direction L6 shown in FIG. 5.

The support member 202B is fastened to a base 202B2 by screws. As shown in FIGS. 5 and 6, the base 202B2 is implemented by a sheet metal member and affixed to a stationary bracket 205 by screws 206 at its one end. The stop member 202D is removably fastened by screws to a bent portion extending out from the base 202B2.

In FIGS. 6, 7 and 8, when the stop member 202D is fastened to the support member 202B, the abutment 202D1 of the stop member 202D faces the locking portion 202A2 of the locking member 202A and thereby restricts the rotation of the member 202A.

As shown in FIG. 7, the support member 202B is formed with a hole for receiving the lower end of the separating portion 200A. This hole is selectively opened or closed by the shutter member 202C.

In FIG. 8, the shutter member 202C is implemented as a disk joined with the shaft 203 so as to be rotatable integrally with the locking member 202A. A sectorial opening 202C1 (see FIG. 7) is formed in the shutter member 202C and communicatable to the opening 200B of the separating portion 200A.

As shown in FIG. 6, the opening 202C1 is positioned such that it faces the opening 200B when the locking piece 202A2 of the locking member 202A abuts against the abutment 202D1 of the stop member 202D. This position is illustrated in FIG. 7. In this condition, the toner can be introduced into the toner replenishing section 106B of the developing unit 106 from the separating portion 200A.

When the stop member 202D is removed, the locking member 202A is moved from a position indicated by a solid line in FIG. 6 to a position indicated by a dash-and-dots line due to the action of the spring 204. As a result, the opening 202C1 of the shutter member 202C is brought out of alignment with the opening 200B of the separating portion 200A, i.e., the shutter member 202C closes the opening 200B. This isolates the inside of the separating portion 200A from the outside and thereby prevents the toner from leaking from the portion 200A. In FIG. 7, the reference numeral 202E designates a cushion member for allowing the shutter member 202C to rotate relative to the base 202B1 while setting up seal therebetween.

Figure 9:
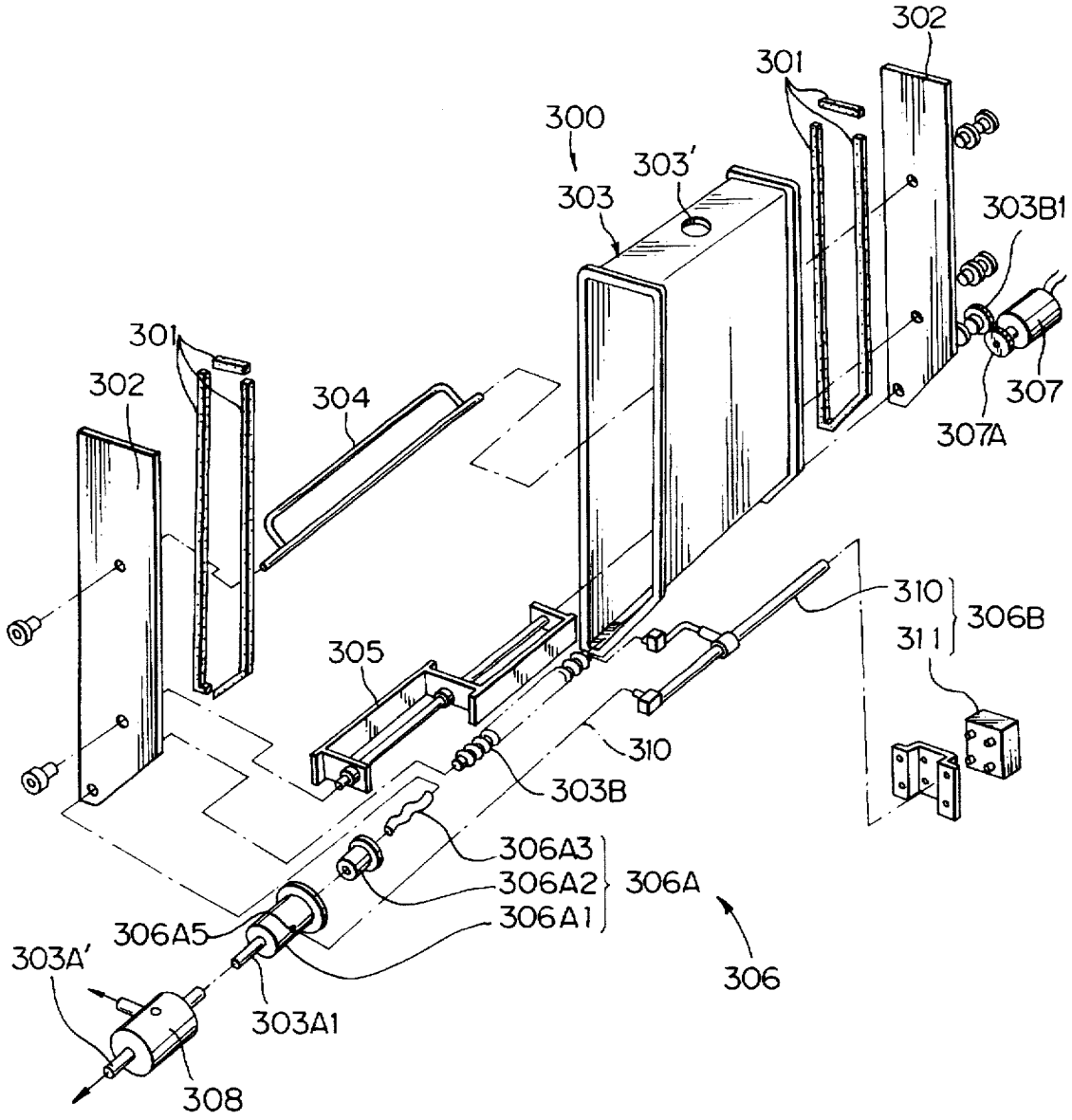
FIG. 9 is an exploded perspective view showing toner supplying means corresponding to a developer supply mechanism applicable to the system of FIG. 1.
Figure 10:
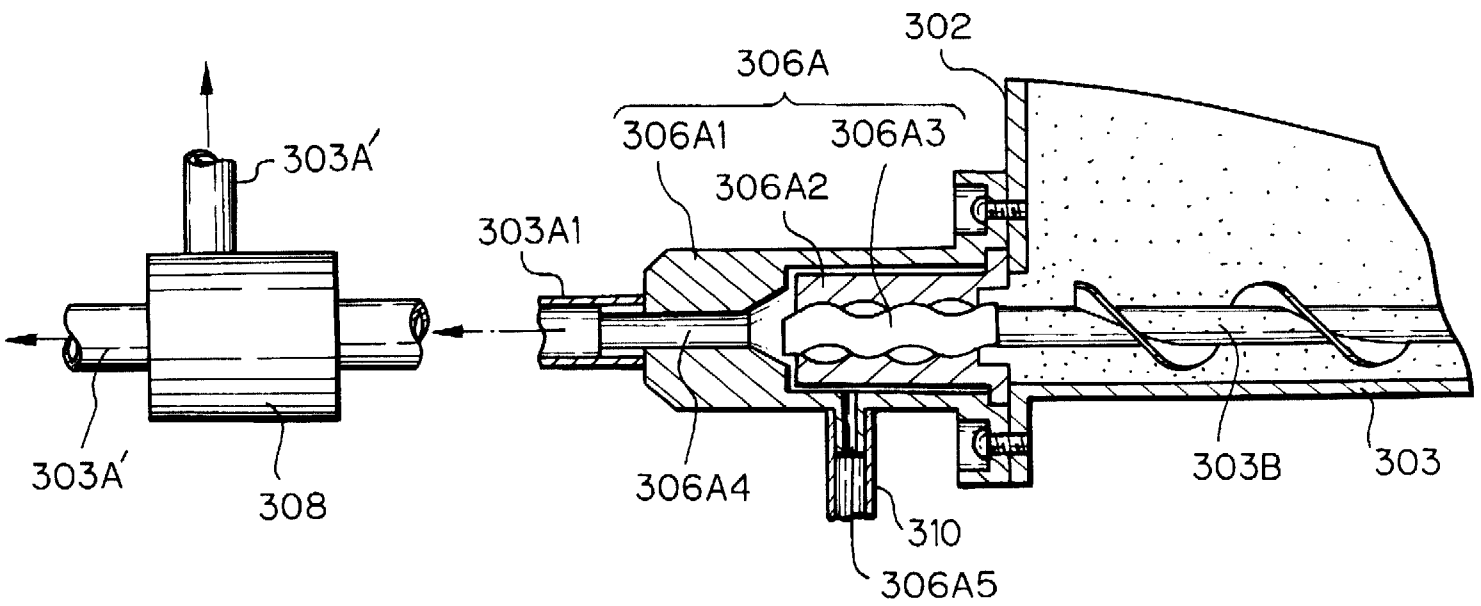
FIG. 10 is a fragmentary section of toner moving means corresponding to developer moving means applicable to the system of FIG. 1.

FIGS. 9 and 10 show a toner source 300 for feeding the toner and air under pressure to the toner supplying means 200. The toner source 300 is a single unit shared by the copiers or image forming apparatuses 102, as stated with reference to FIG. 1. The toner source 300 is connected to the toner replenishing section 106B of each developing device 106 by the respective auxiliary pipe 303A' which forms a part of toner conveying means. As shown in FIG. 2, the source 300 is mounted on one of the image forming apparatuses. The source 300 is capable of collectively controlling the supply of toner to the replenishing sections 106B of all the copiers 102 included in the system.

As shown in FIG. 9, the toner source 300 has a toner container or box 303 having opposite side walls 302 affixed thereto via seals 301. A toner supply opening 303' is formed in the top wall of the box 303. The bottom wall of the box 303 with respect to the direction perpendicular to the direction in which the side walls 302 are mounted is inclined, as illustrated. A first and a second agitating member 304 and 305, respectively, are positioned one above the other in the box 303. The agitating members 304 and 305 cooperate to charge toner in the box 303 by friction while preventing the toner from solidifying, i.e., obviating toner blocking. Toner moving means 306 is also disposed in the box 303 in close proximity to the bottom. The toner moving means 306 has a screw pump 306A and air feeding means 306B.

As shown in FIG. 10, the screw pump 306A has a stator 306A2 and a spiral rotor 306A3. The stator 306A2 is disposed in a holder 306A1 mounted on the side wall 302. The rotor 306A3 has a spiral portion on its outer periphery. The spiral portion is received in a spiral groove formed in the inner periphery of the stator 306A2. The rotor 306A3 is formed of rubber or a similar elastic material and joined with one end of a screw 303B disposed in the box 303, so that it is rotatable integrally with the screw 303B. A gear 303B1 is mounted on the other end of the screw 303B remote from the rotor 306A3. The gear 303B1 is held in mesh with a drive gear 307A mounted on the output shaft of a motor 307.

In FIG. 10, when the motor 307 is energized, it causes the rotor 306A3 to rotate. As a result, the spiral portion of the rotor 306A3 moves in the spiral groove of the stator 306A2, driving the toner coming out of the end of the screw 303B along the axis of the rotor 306A3. An axial passage 306A4 is formed in the stator 306A2. A major pipe 303A1 is connected to the opening of the passage 306A4 and also forms a part of the previously mentioned toner conveying means.

An electromagnetic distributor valve 308 is connected to the main pipe 303A1. Branch passages corresponding in number to the image forming apparatuses are formed in the distributor valve 308. The auxiliary pipes 303A' respectively connected to the developing devices 106 of the copiers 102 are each connected to one of the branch passages of the valve 308; that is, the pipes 303A' correspond in number to the copiers 102. The main pipe 303A1 and auxiliary pipes 303A', constituting the toner transport means, are formed of vinyl chloride, nylon, Teflon or a similar material which is relatively flexible and durable to toner. This allows the source 300 and the developing devices 106 of the copiers 102 to be interconnected without regard to their positional relation. A controller 400, which will be described, operates the valve 308 in such a manner as to select a particular toner transport direction.

A small gap exists between the inner periphery of the holder 306A1 and the outer periphery of the stator 306A2 and is communicated to the passage 306A4. An air passage 306A5 is communicated to the above gap.

As shown in FIG. 9, air under pressure is fed from an air pump or air feeding means 311 to the air passage 306A5 via a tube 310. In this configuration, the toner in the box 303 is conveyed by the screw 303B toward the rotor 306A3 of the screw pump 306A and then driven out of the box 303 by the pump 306A. Moreover, the toner flows in the passage 306A4, FIG. 10, while being scattered by air coming in via the air passage 306A5. Consequently, the toner is entrained by air to the distributor valve 308 via the main pipe 303A1. Then, the toner is transported from the valve 308 to the toner replenishing section 106B of the developing device 106 via a particular one of the branch passages.

Figure 11:
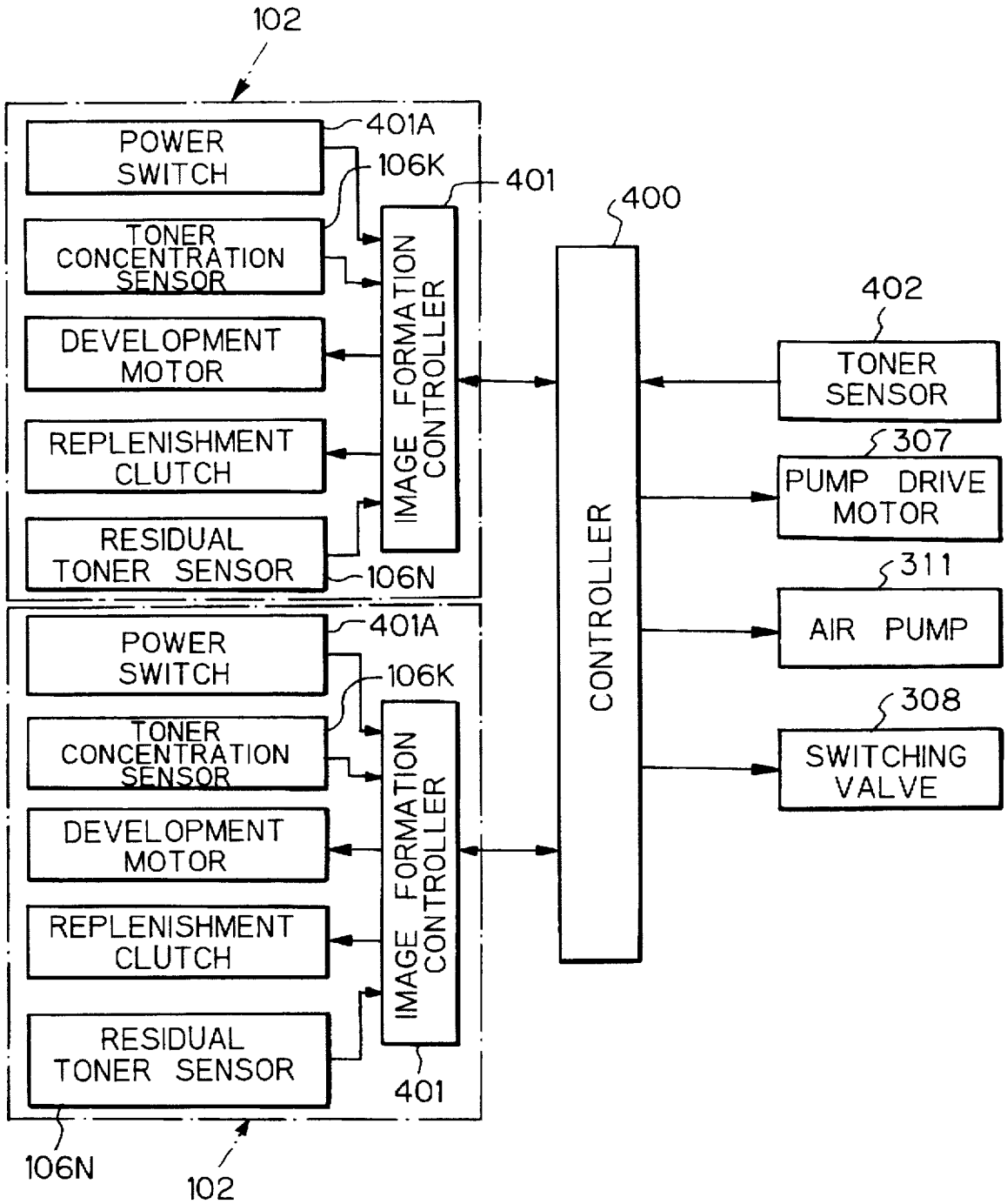
FIG. 11 is a block diagram schematically showing a control arrangement applicable to the system of FIG. 1.

As shown in FIG. 11, the controller 400 controls the distributor valve 308 and air pump 311. The controller 400 is connected to an image formation controller 401 built in each of the copiers 102 shown in FIG. 2. FIG. 2 shows two copiers 102 by way of example.

In FIG. 11, in each copier 102, a power switch 401A, a residual toner sensor 106N (see FIG. 4) and the toner concentration sensor 106K, FIG. 3, are connected to the image formation controller 401. The residual toner sensor 106N is mounted on the toner replenishing section 106B of the developing device 103, FIG. 3. When the output of the sensor 106K shows that the toner concentration of the developer is lowered, the controller 401 drives a motor for rotating the toner supply roller 106B1, FIG. 3, and a clutch for coupling and uncoupling the drive from the motor. As a result, the toner is replenished from the replenishing section 106B into the casing 106A. Further, when the toner remaining in the replenishing section 106B is short as indicated by the residual toner sensor 106N, the controller 401 sends a corresponding signal to the controller 400.

A toner sensor 402 is included in the toner source 300, FIG. 9, and responsive to the presence/absence of toner in the box 303. The output of the toner sensor 402 is also fed to the controller 400. In response to the output of the controller 401 and that of the sensor 402, the controller 400 sends control signals to the motor 307, distributor valve 308, and air pump 311 shown in FIG. 9.

Assume that the replenishing section 106B, FIG. 3, has reached a toner near-end condition in which the amount of toner remaining in the section 106B is below a preselected amount or in which the toner would be used up if further replenished a small number of times. Then, only if toner is present in the box 303, the controller 400 sends a drive signal to the members for feeding the toner from the box 303.

The controller 400 continuously sends the drive signals to the motor 307, distributor valve 308 and air pump 311 until the toner replenished into the developing device 106 reaches a preselected amount.

In addition, at the beginning and end of operation of each copier 102, the controller 400 drives the air pump 311 independently of the other members joining in the toner supply. This is to prevent the toner from cohering in the opening 200B of the toner/air separating portion 200A, FIGS. 5–7. Specifically, when the air supply is interrupted, toner-containing air causes the toner to drop toward the opening 200B due to gravity. Such toner is apt to sequentially accumulate around the opening 200B and cohere in the form of a block, thereby stopping up the opening 200B. In this condition, should the toner be replenished again, it would be blocked on the toner transport path and would thereby increase the load acting on the rotor 306A3 of the screw pump 306A; in the worst case, the rotor 306A3 would stick due to burning. In light of this, when the screw pump or toner moving means 306A is caused to begin or stop operating, the air pump 311 is activated before the beginning of operation or is continuously operated for a certain period of time after the end of operation.

The controller 401 of each copier 102 controllably operates a motor for driving the agitator and other members of the developing device 106 joining in development (labeled DEVELOPMENT MOTOR in FIG. 11), and a clutch associated with the toner supply roller 106B1 of the toner replenishing section 106B (labeled REPLENISHMENT CLUTCH in FIG. 11).

Figure 12:
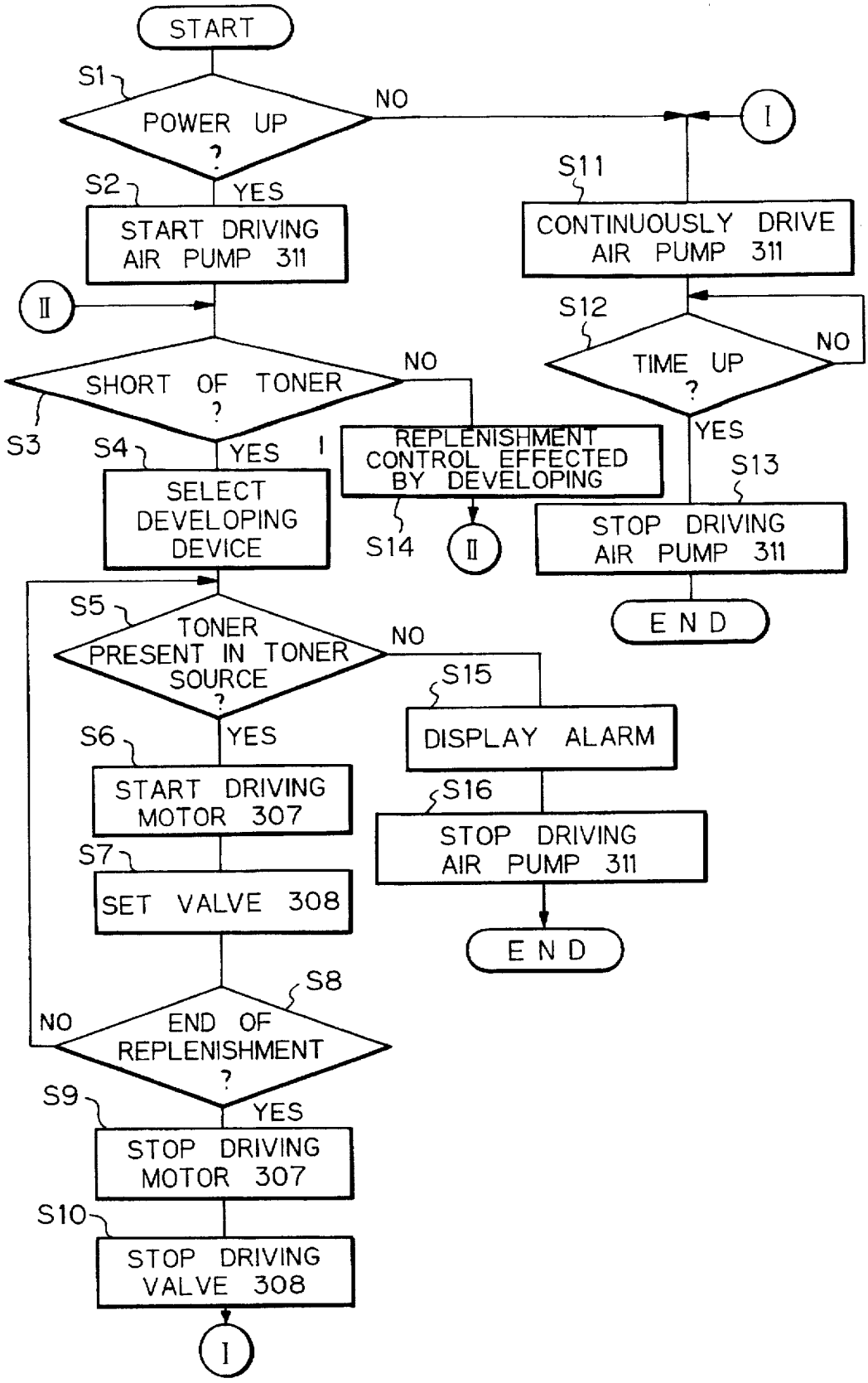
FIG. 12 is a flowchart demonstrating a specific operation of a controller included in the arrangement of FIG. 11.

A specific operation of the controller 400 will be described with reference to FIG. 12. As shown, the controller 400 determines whether or not the copier 102 is powered up (step S1). If the answer of the step S1 is positive (Y), the controller 400 starts driving the air pump 311 (step S2) in order to blow away the cohered toner on the toner transport path. This may be done when the amount of toner remaining in the replenishing section 106B is short, as will be described later.

Assume that during the course of toner replenishment control in the developing unit 106, the residual toner sensor 106N shows that the toner remaining in the replenishing section 106B is short (Y, step S3). Then, the controller 400 selects the developing device 106 short of toner (step S4) and then determines the amount of toner remaining in the source 300 (step S5). If toner is present in the source 300 (Y, step S5), then the controller 400 starts energizing the motor 307 and switches the distributor valve 308, so that the toner can be fed out to a particular path terminating at the above developing device 106 (steps S6 and S7).

The controller 400 determines, on the basis of the output of the residual toner sensor 106N, whether or not the toner supply to the replenishing device 106B has ended (step S8). If the answer of the step S8 is Y, then the controller 400 turns off the motor 307 and distributor valve 308 before turning off the air pump 311 (steps S9 and S10). The time up to the stop of operation of the air pump 311 is counted by a timer (steps S11–S13).

If the answer of the step S3 is negative (N), meaning that the developing device 106 is not short of toner, then the controller 400 allows the device 106 to replenish the toner on the basis of ordinary concentration control (step S14). During the toner replenishment control, the residual toner sensor 106N monitors the varying amount of toner. If no toner is left in the source 300 (N, step S5), the controller 400 displays an alarm on an operation and display panel, not shown, mounted on the copier 102. Then, the controller 400 stops driving the air pump 311 on the elapse of a certain period of time (steps S15 and S16).

As stated above, the toner source 300 is a single unit independent of and shared by the copiers 102 included in the image forming system. This makes it needless for the individual copiers 102 to deal with the amount of toner available in its developing device 106 and thereby promotes easy management.

Even if no toner is left in the source 300, it is not necessary to interrupt image formation under way in the developing device 106 only if the toner concentration in the device 106 is stable. As a result, a defective image ascribable to the interruption of image formation in the developing device 106 is obviated.

While the embodiment has been described in relation to a two-ingredient type developer or toner and carrier mixture, it is, of course, practicable with a single-ingredient type developer.

Figure 13:
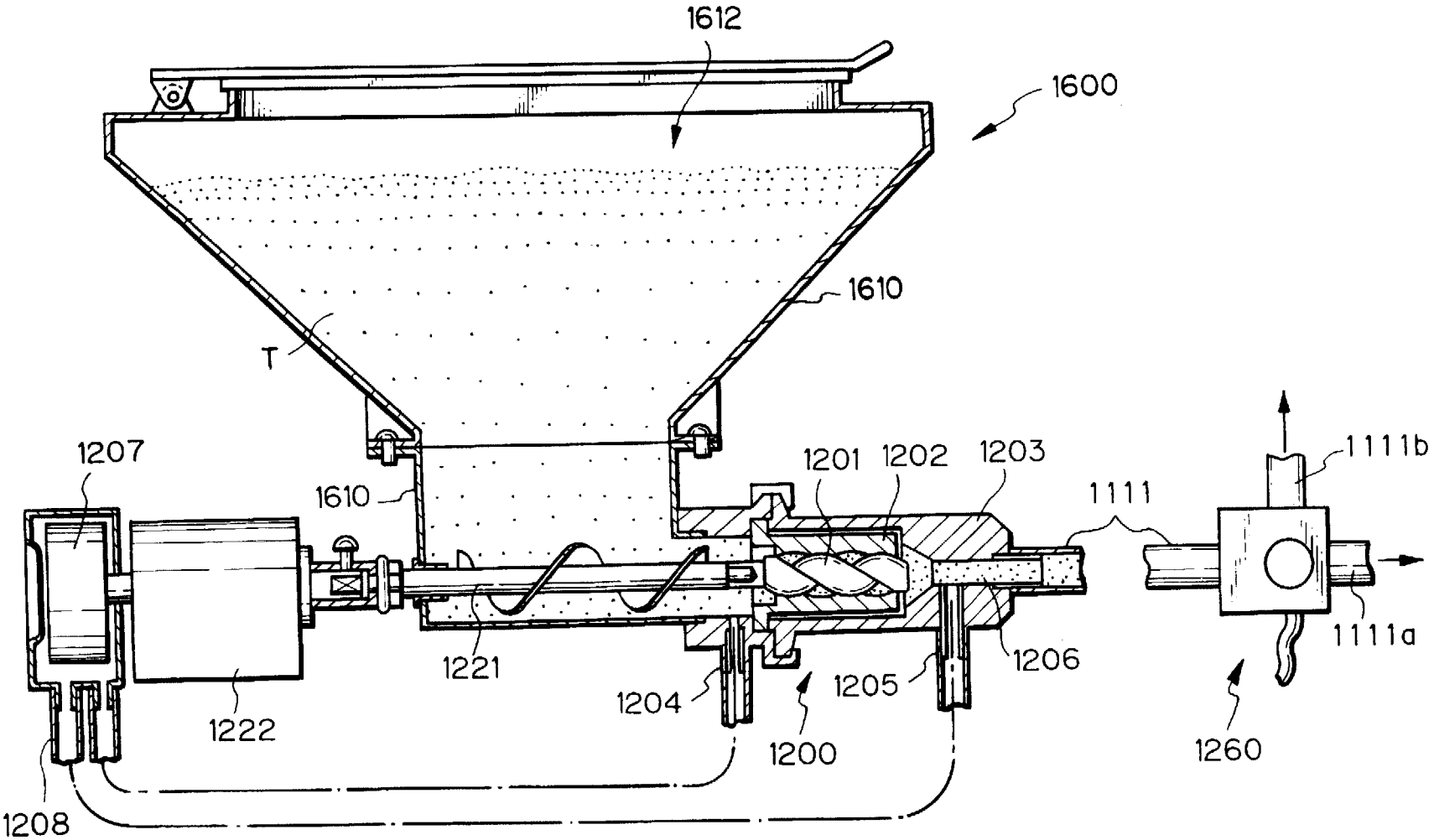
FIG. 13 is a section showing another specific configuration of the developer supply section.

Referring to FIG. 13, a modification of the toner source or developer storage and supply device 300 will be described.

As shown, developer storing means, generally 1600, has a casing 1610 storing a developer T. The developer T is introduced into the casing 1610 via an opening 1612 formed in a part of the casing 1610.

A horizontal screw 1221 is disposed in the casing 1610 and driven by a motor 1222 to function in the same way as the screw 303B, FIG. 10. The screw 1221 surely conveys the developer T to a powder pump unit 1200. The pump unit 1200 is similar in function as the screw pump 306A, FIG. 10, and is made up of a rotor 1201, a stator 1202, and a holder 1203. The screw 1221 is engaged with one end of the rotor 1201 at one end and engaged with the output shaft of the motor 1222 at the other end. In the pump unit 1200, the rotor 1201 is connected to the motor 1222 by the screw 1221 and surrounded by the stator 1202. The stator 1202 is retained by the holder 1203.

A gap of about 1 mm exists between the outer periphery of the stator 1202 and the inner periphery of the holder 1203. The gap is communicated to a passage or developer outlet 1206. An air pipe 1205 is communicated to a fan 1207 at one end and to the passage 1206 at the other end. The fan 1207 is driven by the motor 1222 and has an outlet port 1208 formed in its casing. The fan 1207 feeds compressed air to the pump unit 1200 via the piping 1205 at a rate of about 1 liter to 3 liters for a minute. The compressed air promotes the fluidity of the developer T and allows it to be more surely transported by the pump unit 1200.

In FIG. 13, switching means 1260 plays the role of developer distributing and control means and is implemented by an electromagnetic valve. The developer coming out of the pump unit 1200 is routed through a pipe 1111, corresponding to the main pipe 303A1 shown in FIG. 10, to the switching means 1260. Subsequently, the developer is distributed to destinations selected by the switching means 1260. For example, the developer is fed to one copier 102, FIG. 2, via a pipe **1111*a* corresponding to one of the auxiliary pipes 303A', FIG. 10, and is fed to another copier 102 via a pipe 1111*b* corresponding to the other pipe 303A'. Of course, the switching means 1260 may be configured to distribute the developer T to three or more image forming apparatuses or may even be replaced with a plurality of separate switching means. The pipes 1111*a* and 1111*b*, like the pipes 303A'**, are made of soft vinyl chloride, nylon Teflon or similar material which is flexible and durable to toner.

Because the developing devices 106 of the copiers 102 and developer storing means 1600 are connected by flexible pipes, each copier 102 can be laid out with a minimum of limitation, saves space, and enhances easy maintenance.

Figure 14:
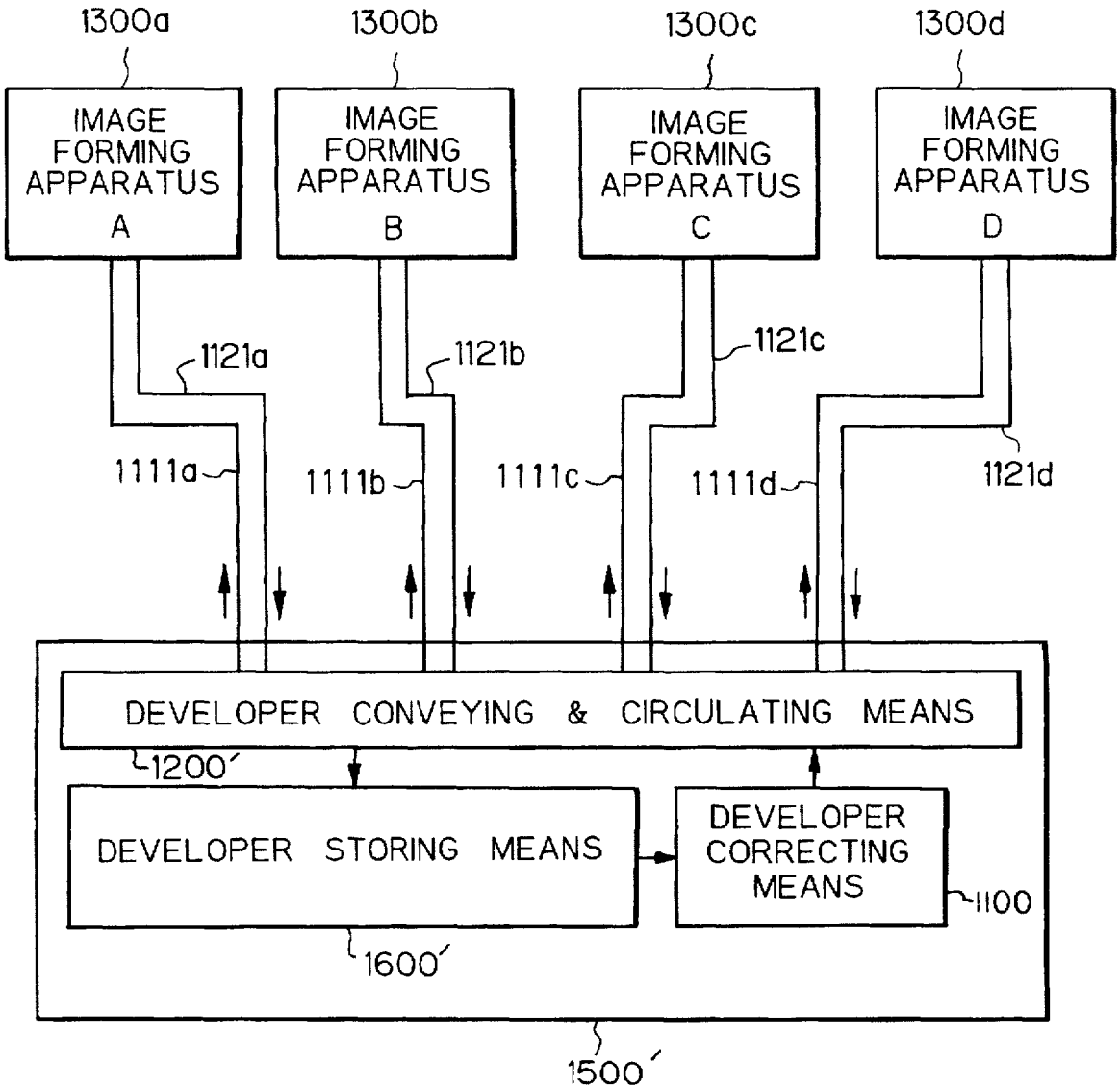
FIG. 14 is a block diagram schematically showing another embodiment of the present invention.

Referring to FIG. 14, an alternative embodiment of the present invention is shown. As shown, the system has a plurality of image forming apparatuses 1300*a*, 1300*b*, 1300*c* and 1300*d* and a single developer storage and circulation device 1500'. The device 1500' has developer correcting means 1100, developer conveying and circulating means 1200', and developer storing means 1600'. The device 1500' is a unit separate from the apparatuses 1300*a*–1300*d* and situated at a different place from the apparatuses 1300–1300*d*. The device 1500' corrects the developer, selectively distributes the corrected developer to the apparatuses 1300*a*–1300*d*, and collects the excessive developer from the apparatuses 1300*a*–1300*d*. The developer correcting means 1100 includes a unit for replenishing fresh toner.

It is to be noted that the terms "correcting the toner" refer to, among others, adjusting the toner and carrier mixture of the developer so as to correct the toner concentration and the amount of charge. Paper dust and other impurities introduced into the developer are removed by impurity removing means, not shown, during the course of circulation of the developer. The correcting means 1100 has the previously mentioned toner replenishing means, a member for agitating toner and carrier, and a toner concentration sensor 1250 (see FIG. 16). If desired, the toner concentration sensor 1250 may be replaced with an image density sensor 1250' (see FIG. 16).

Figure 16:
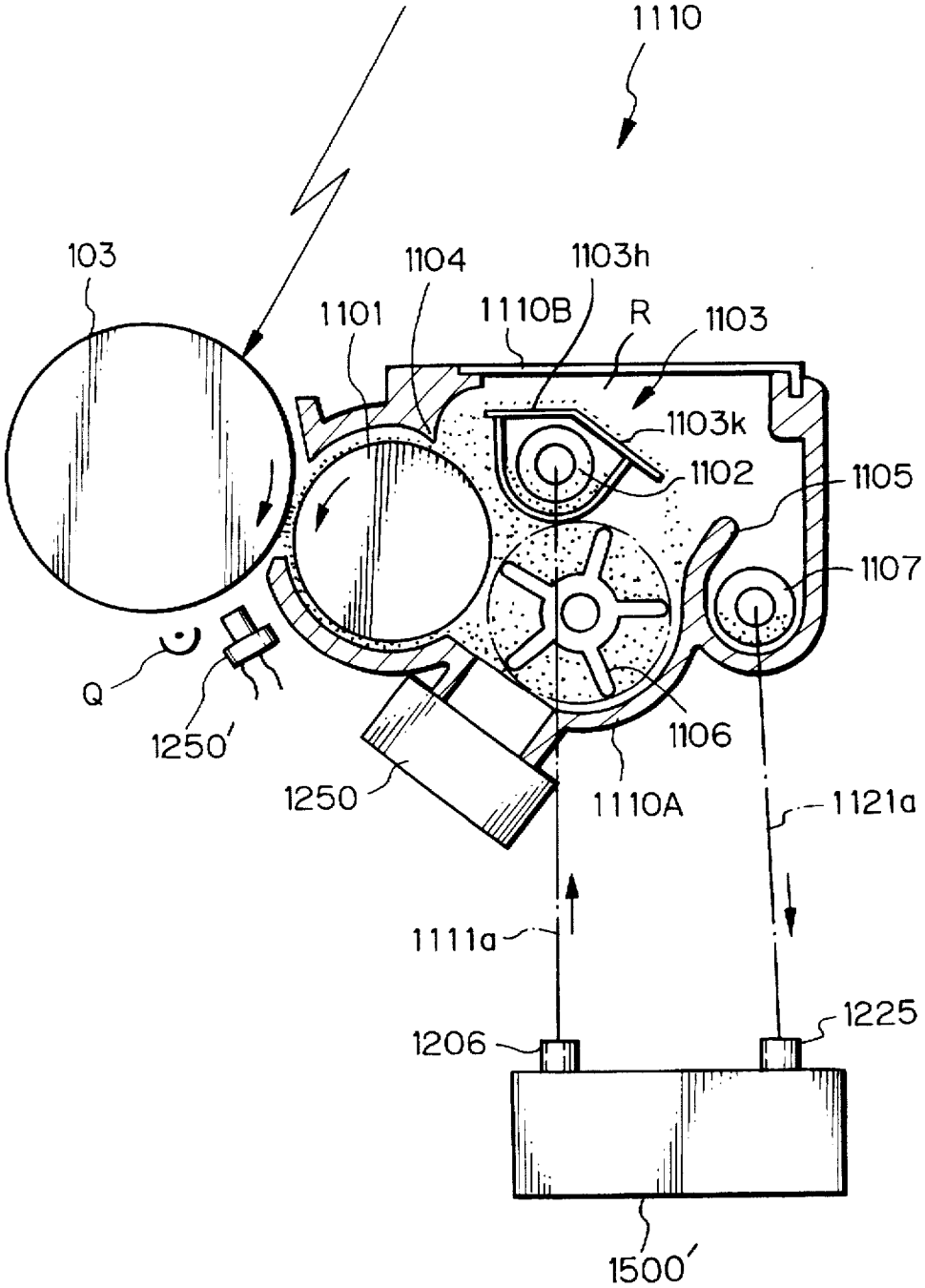
FIG. 16 is a section of a developing device disposed in the body of each image forming apparatus included in the system of FIG. 14.
Figure 17:
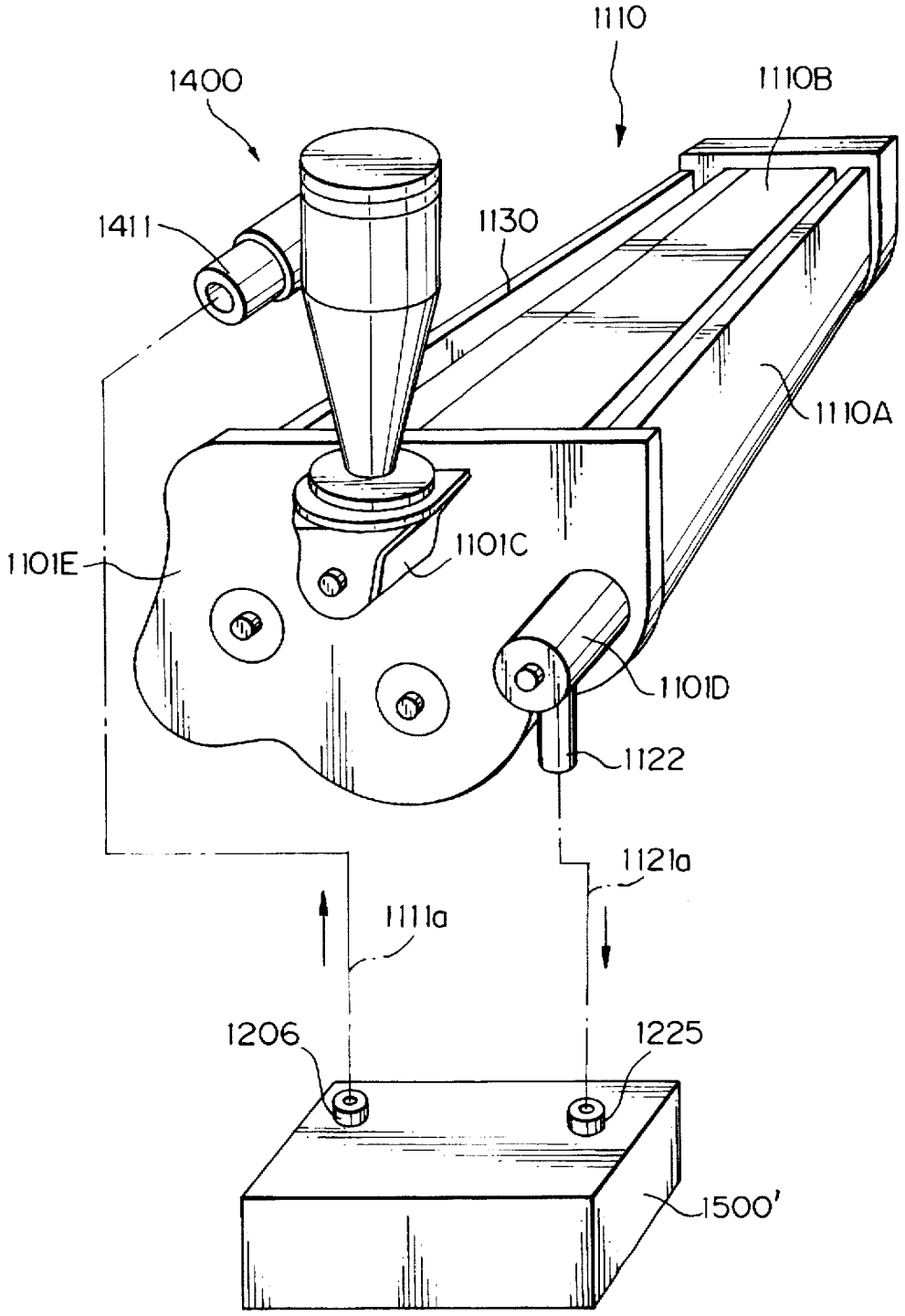
FIG. 17 is a perspective view of the developing device shown in FIG. 16.

In FIG. 14, supply pipes 1111*a*, 1111*b*, 1111*c* and 1111*d* communicate the device 1500' to the apparatuses 1300*a*–1300*d*, respectively. On the other hand, collection pipes 1121*a*, 1121*b*, 1121*c* and 1121*d* respectively communicate the apparatuses 1300*a*–1300*d* to the device 1500'. Specifically, as shown in FIGS. 16 and 17, the apparatuses 1300*a*–1300*d* each has a developing device 1110. The developing device 1110 and developer conveying and circulating means 1200' communicate with each other by the supply pipes 1111*a*–1111*d* and collection pipes 1121*a*–1121*d*.

Figure 15:
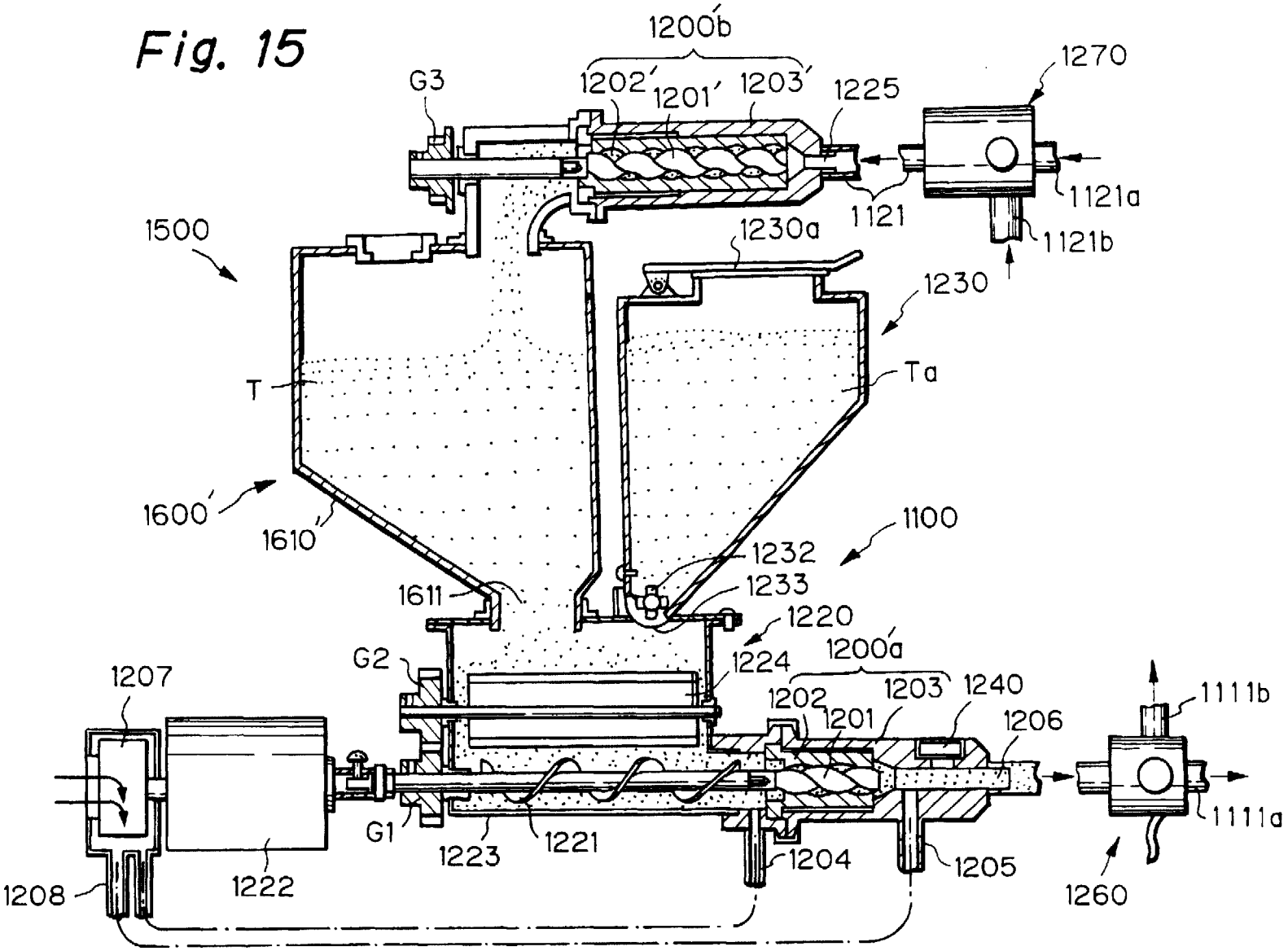
FIG. 15 is a section showing a specific configuration of a developer storage and circulation device corresponding to a developer supply section included in the system of FIG. 14.

FIG. 15 shows the developer storage and circulation device 1500' specifically. As shown, the developer storing means 1600' is implemented as a storage member 1610'. The developer collected from the developing devices of the apparatuses 1300*a*–1300*d* via the pipes 1121*a*–1121*d*, respectively, is returned to the storage member 1610' via developer collecting means including switching means 1270, a pipe 1121, and a powder pump unit 1200'*b*. The switching means 1270 is implemented by an electromagnetic valve. The developer collected in the storage member 1610' is fed to the developer correcting means 1100 and developer conveying means 1200'*a*.

An agitating unit 1220 is disposed below the developer storing means 1600'. In the agitating unit 1220, a horizontal screw 1221 and an agitating member 1224 are rotated by a motor 1222 so as to agitate the developer introduced into the unit 1220 from the storage member 1610'. A toner supply unit 1230 stores fresh toner Ta and includes a toner supply member implemented as a screw 1232. The screw 1232 is rotated by a conventional control circuit in response to the output of a toner concentration sensor 1240. As a result, the fresh toner Ta is fed from the unit 1230 to the unit 1220 via an opening 1233.

The screw 1221, agitating member 1224 and toner supply unit 1230 constitute the developer correcting means 1100 and cooperate to correct the toner concentration of the developer and the amount of charge of the developer. The corrected developer is fed to the powder pump unit 1200'*a*.

Again, the powder pump unit 1200'*a* is constituted by the screw pump having the rotor 1201, stator 1202, and holder 1203. The pump unit 1200'*a* is identical with the pump unit 1200, FIG. 13, except for the addition of the toner concentration sensor 1240 and will not be described specifically in order to avoid redundancy. The developer coming out of the pump unit 1200' has its toner concentration sensed by the sensor 1240. Subsequently, the developer is delivered to switching means 1260 via an outlet 1206 and pipe 1111. The switching means 1260 distributes the developer to the developing devices of a plurality of image forming apparatus, as stated earlier.

The developer collected from the developing devices via the pipes 1121*a*–1121*d* is sucked into the pump unit 1200'*b* and then introduced into the storage member 1610'. In the pump unit 1200'*b*, the rotor 1200'*b* rotates in the opposite direction to the rotor 1201 of the pump 1200'*a*, thereby conveying the developer in the opposite direction (from the right to the left in FIG. 15). This, coupled with the fact that the rotor 1201' and stator 1202' are longer than the rotor 1201 and stator 1202, causes the pump 1200'*b* to exert a higher suction pressure than the pump 1200'*a*. Further, the switching means 1270 and control means, not shown, selectively open and close valves such that only the developer from the image forming apparatus in operation is collected. For example, in FIG. 14, assume that the apparatus 1300*a* is in operation while the apparatus 1300*b* is out of operation. Then, the switching means 1270 opens its valve associated with the pipe 1121*a* while closing its valve associated with the pipe 1121*b*.

As stated above, in the storage and circulation device shown in FIG. 15, the developer conveying and circulating means 200' has the developer conveying means for conveying the developer to the developing devices of a plurality of image forming apparatuses, and the developer collecting means for collecting the excess developer from the developing devices. The conveying means includes the pump unit 1200'*a*, pipe 1111, and switching means 1260 while the collecting means includes switching means 1270, pipe 1121, and pump unit 1200'*b*. The conveying and circulating means 200' is capable of delivering the developer to the apparatuses while collecting it from the same. The developer collected from the apparatuses is received in the storage member 1610', lowered due to gravity, dropped through the opening 1611, and then corrected by the correcting means 1100.

The capacity of the storage member 1610' may be increased in order to increase the interval between the replacements of the developer. If the storage member 1610' is implemented as a removable cartridge, then it can be handled and maintained with ease. Further, the storing means 1600' may be constructed independently of the agitating unit 1220. This will minimize the crushing and diffusion of the developer ascribable to mechanical hazards, e.g., stresses during the course of agitation. In addition, it is possible to reduce the load acting on the the motor 1222, to reduce the temperature elevation of the developer, to miniaturize the device, to set up a uniform toner concentration in a short period of time, and to uniformalize the amount of charge.

Because the developer is agitated not only in the developing device but also in the developer correcting unit, the toner concentration and charge of the developer are more surely uniformalized. This renders the image quality stable and promotes the effective use of the developer. As a result, the developer is provided with greater durability while the interval between consecutive maintenances is increased.

In the above image forming system, when the carrier deteriorates due to a long time of use, the developer must be entirely drawn out of the storage and circulation device 1500'. In such a case, the pipe 1111 is removed from the switching means 1260 and connected to a waste developer container, and then the motor 1222 is energized. As a result, the developer is substantially entirely collected in the above container and may be discarded, recycled or otherwise dealt with, as desired. The collection of the developer may also be effected at the time of, e.g., the replacement or repair of the various constituent parts, so that the developer will be absent on the parts and will not fly about.

The above procedure renders the collection of the developer far more efficient than the conventional procedure in which the entire developing unit is removed from the machine body, then the unit is disassembled, and then the developer is collected by manual operation. The developer storing means 1600', developer conveying and circulating means 1200' and developer correcting means 1100 shown in FIG. 14 and constituting the developer storage and circulation device are implemented as a single unit independent of the developing devices 1110 of the copiers. This, coupled with the fact that the storage and circulation device is simply connected to the developing devices 1110 by the supply pipes 1111*a*–1111*d* and collection pipes 1121*a*–1121*d*, reduces the limitation on the place where the storage and circulation device is to be located. In addition, efficient storage of the developer, easy replacement of the developer, easy assembly, and high productivity including adjustment are promoted. The enhanced freedom of layout allows even the toner supply unit 1230 to be located at any position where the user can easily supply fresh toner into the unit 1230.

To further promote the ease of toner supply, the toner supply unit 1230 may be implemented as a removable toner cartridge. Because the configuration of the toner cartridge does not depend on the configuration of the developing unit 1110, easy toner supply is achievable. In addition, the capacity of the unit 1230 is open to choice. Consequently, the cost is reduced due to the further enhanced productivity and noticeable economic effects. Moreover, the increase in capacity promotes easy maintenance by the user.

FIG. 16 shows another specific configuration relating to the developing unit shown in FIG. 3. As shown, the developing unit 1110 and developer storage and circulation device 1500' constitute a developing device in combination. Arranged around the drum 103 are the developing device 1110 and other conventional electrophotographic processing means including charging means, exposing means, image transferring means, cleaning means, and charge dissipating means. A latent image formed on the drum 103 is developed by the developing device 1110 to turn out a toner image. Assume that the developing device 1110 stores a dry two-ingredient type developer and effects magnet brush development by way of example.

A developing sleeve 1101 is made up of a sleeve and a stationary magnet roller as conventional. The developer is fed from the storage and circulation device 1500', FIGS. 14 and 15, to the developing device 1110 via the supply pipe 1111*a*. In the developing device 1110, the developer is conveyed by a conveyor 1102 in parallel to the sleeve 1101 and fed to the entire periphery of the sleeve 1101 via a slot formed in a guide member 1103. A regulating member 1104 causes the developer to form a uniform layer of optimal thickness on the sleeve 1101. The excess developer scraped off by the member 1104 is guided to another regulating member 1105 along a path R defined by the upper surfaces 1103*h* and 1103*k* of the guide member 1103 and a lid 1110B. The regulating member 1105 guides a part of the developer to an agitating member 1106 and the other developer to a developer collecting member 1107. The developer used to develop the latent image is recirculated to the sleeve 1101 by way of the agitating member 1106. On the other hand, the developer reaching the collecting member 1107 is collected in the storage and circulation device 1500' via the collection pipe 1121*a* and other members constituting the collecting means.

The regulating member 1105 is used to store a constant amount of developer in the developing device 1101, to further stabilize the charge of the developer, and to insure the uniform supply of the developer to the sleeve 1101. Specifically, the regulating member 1105 is configured and positioned such that when the excess developer increases, it is led more to the collecting member 1107 than to the agitating member 1106, but when the amount of excess developer is small, it is led to the agitating member 1106. The agitating member 1106 serves to further stabilize the charge of the developer, and to insure the uniform supply of the developer to the sleeve 1101, as stated above. Particularly, even when the developer fed by the conveyor 1102 is irregular in amount, the developer can be fed to the sleeve 1101 stably.

The sensor 1250 responsive to the toner concentration of the developer in the developing device 1110 or the sensor 1250' responsive to the density of the toner image formed on the drum 103 is used to control the toner supply in the storage and circulation device 1500'. The sensor 1250 or 1250' is auxiliary to the sensor 1240 disposed in the device 1500'.

Figure 18:
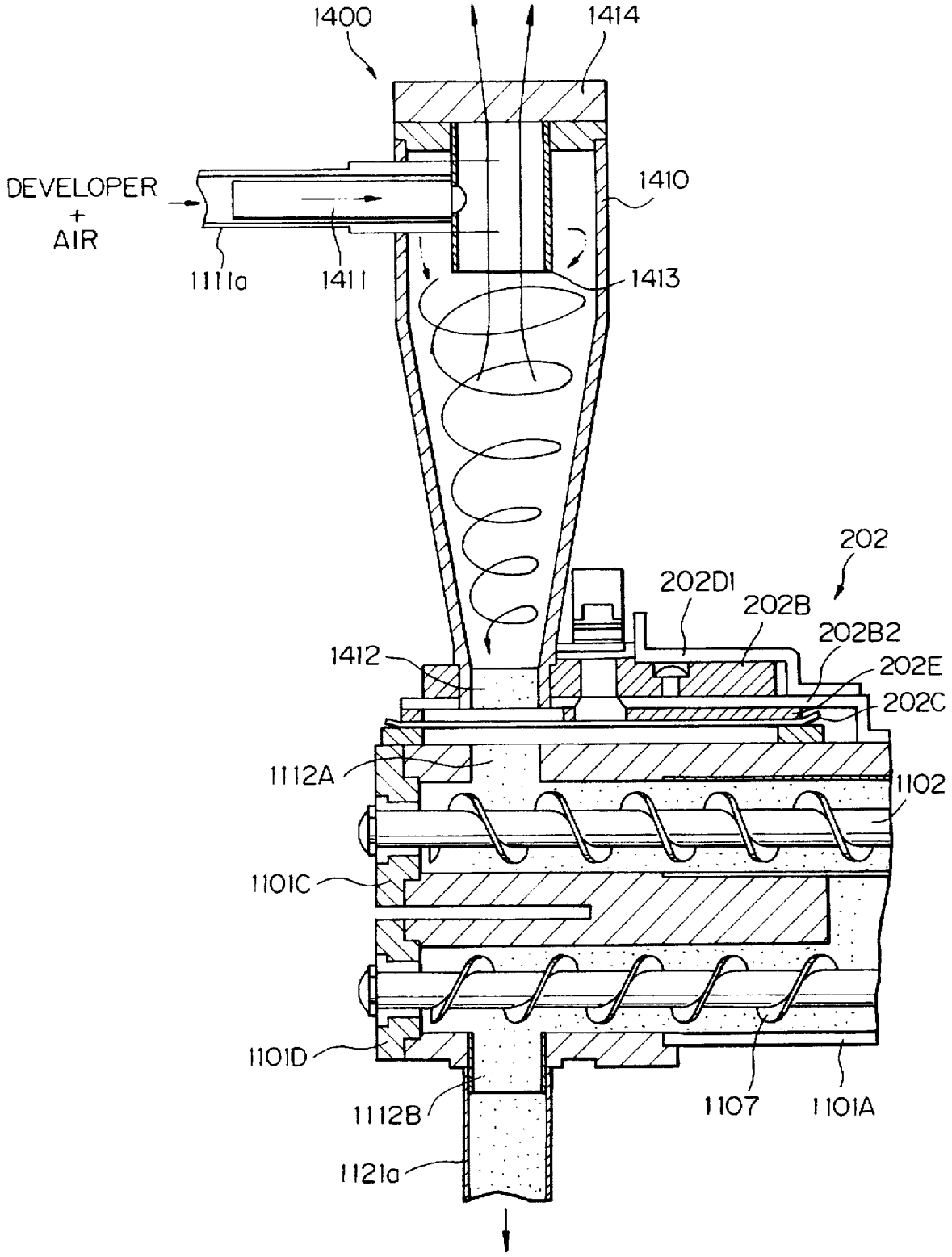
FIG. 18 is a fragmentary section of developing means and developer gathering means shown in FIGS. 15 and 16.

FIG. 17 shows the developing device of FIG. 16 in a perspective view while FIG. 18 shows the essential portion of the device of FIG. 17 together with developer collecting means. As shown, the developing device 1110 has a casing 1110A having opposite ends thereof closed by end walls. One end wall 1101E is partly protruded in a cylindrical configuration so as to form through bores for receiving the screw portion of the conveyor 1102 (see FIG. 18) and that of the collecting member 1107 (see FIG. 18). The ends of the shafts of the members 1102 and 1107 are respectively rotatably supported by lid members 1101C and 1101D which close the above through bores.

As shown in FIG. 18, an inlet 1112A and an outlet 1112B are respectively formed at the intermediate portions of the above bores perpendicularly to the axes of the bores. A developer collecting device 1400, which will be described, is directly received in the inlet 1112A. A developer outlet 1206 (see FIG. 17) is formed in the storage and circulation device 1500' and communicated to the inlet 1112A via the supply pipe 1111*a* (see FIG. 17) and collecting means 1400. Also, a developer inlet 1225 (see FIG. 17) is formed in the device 1500' and communicated to the outlet 1112B via the collection pipe 1121*a* (see FIG. 17).

The above arrangement simplifies the developing device to a noticeable degree. Moreover, because only the developing sleeve and the screws for developer supply and collection should be driven, the developing device is miniature, simple, low cost, reliable, power saving, and easy to maintain. Of course, the entire image forming apparatus achieves the previously stated advantages.

Because the development is effected with the optimized developer at all times, the quality of development and therefore the image quality is high and stable.

In the illustrative embodiment, the toner supply and developer agitation are effected by the structure dependent of the developing device and, in addition, are spaced from the developing unit. This obviates the scattering of the toner and developer particular to the conventional developing device. Consequently, defective images are eliminated, and the image quality is stable. In addition, the interval between consecutive maintenances is increased to enhance reliability.

The developer collecting device 1400 will be described with reference to FIG. 18. As shown, the device 1400 has a hopper 1410 for separating air and toner by the cyclone dust collection system, and a shutter portion or opening/closing means for opening and closing the bottom opening of the hopper 1410.

The developer is fed from the collection and circulation device 1500' by compressed air. Should the developer be directly introduced into the developing device, it would be blown out of the unit due to air under pressure and would thereby contaminate the inside of the machine, damage images, and obstruct safety operation. To obviate these problems, the developer collecting device 1400 separates the developer from air and allows it to be fed into the developing device alone.

In FIG. 18, the developer and air mixture flowing through the supply pipe 111*a* is admitted into the hopper 1410 via a hole 1411 formed in the upper portion of the hopper 1410. While the mixture whirls round along the inner wall of the hopper 1410, the developer drops due to gravity and reaches the conveyor 1102 via a hole 1412 and the inlet 1112A. The conveyor 1102 feeds the developer into the developing unit 1110.

On the other hand, air separated from the developer is discharged to the outside of the device 1400 via an exhaust member 1413 and a filter 1414. Therefore, not only is the developer stably fed into the developing device 1110, but also the developer and air mixture is depressurized. This prevents the developer from flying out of the developing unit 1110.

The developer collecting device 1400 is constructed into a unit in order to facilitate, among other things, the replacement of the developer and the maintenance of the arrangement around the photoconductive drum. Particularly, implementing each of the device 1400 and developing device 1110 as a unit is extremely important from the efficient work standpoint. This, however, has been difficult to be done because the device 1400 is filled with the developer which is extremely easy to fly about.

In light of the above, the embodiment uses a shutter mechanism similar to the opening/closing means 202 described with reference to FIGS. 5–7. The shutter mechanism is also designated by the reference numeral 202. The shutter mechanism 202 will not be described in order to avoid redundancy.

Figure 19:
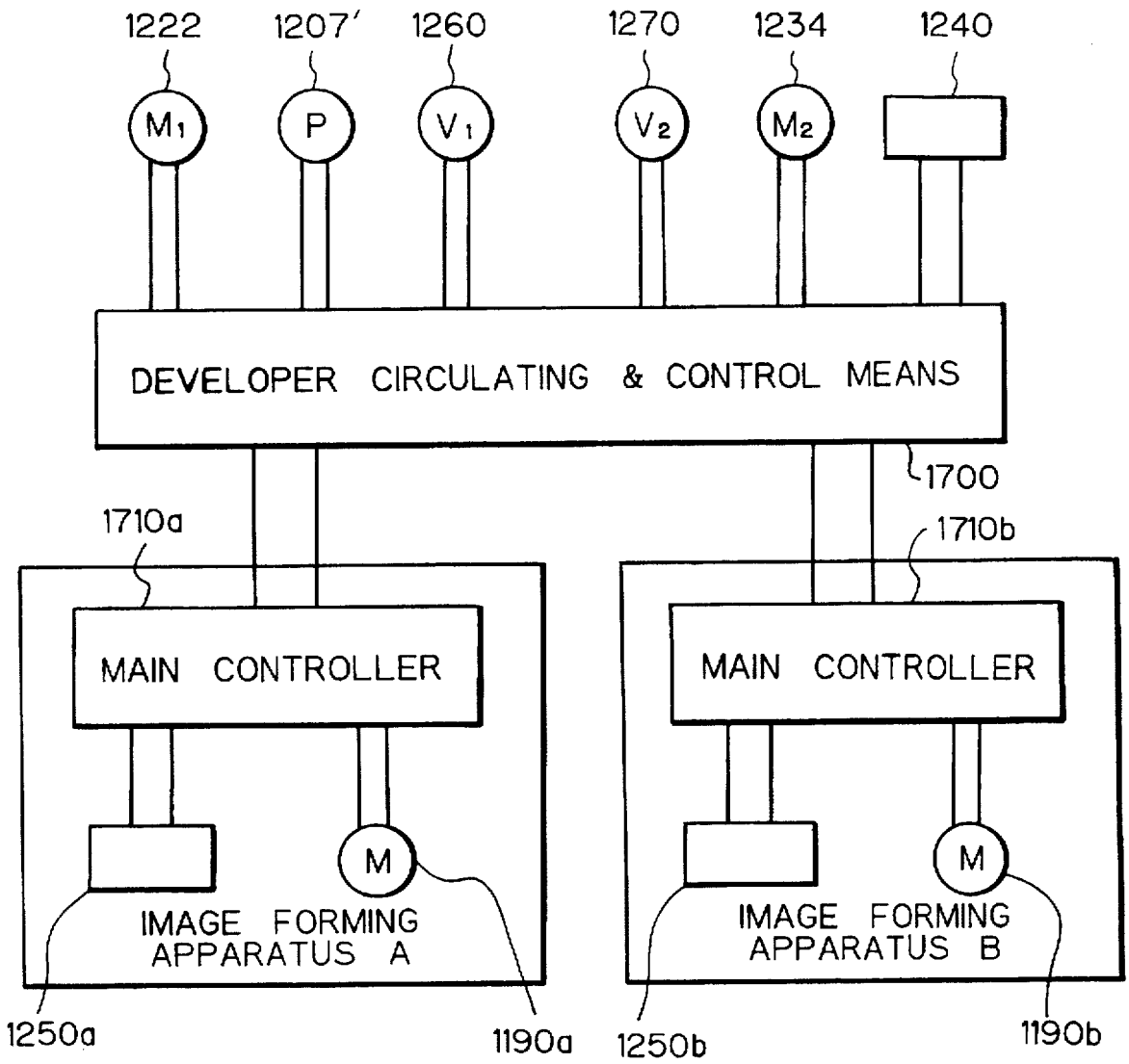
FIG. 19 is a block diagram schematically showing a control arrangement included in the embodiment of FIG. 14.

Referring to FIG. 19, another embodiment of the present invention will be described. In the illustrative embodiment, the developer storage and circulation device is assumed to have the construction shown in FIG. 15 and to feed the developer to a plurality of image forming apparatuses. In the control system of FIG. 19, main controllers 1710*a* and 1710*b* control respective copiers, printers or similar image forming apparatuses while an auxiliary controller 1700 controls the storage and circulation device.

The auxiliary controller 1700 is connected to the main controllers 1710*a* and 1710*b* which control image forming apparatuses A and B, respectively. The controller 1700 controllably drives the storage and circulation device 1500' including the motor 1222 for driving the powder pump, motor 1234 for driving the toner supply member 1232, air pump 1207', electromagnetic valve or switching means 1260, and electromagnetic valve or switching means 1270.

Basically, the main controllers 1710*a* and 1710*b* inform the auxiliary controller 1700 of the operating conditions of the respective apparatuses A and B and represented by the ON signals of developing device drive motors 1190*a* and 1190*b*. The controller 1700 determines which of the apparatuses A and B needs developer supply (circulation) by arithmetic operations and control processing, and then operates the valve 1260. As a result, the developer is fed to the apparatus A or B which needs developer supply and is in operation. At the same time, the controller 1700 operates the valve 1270 such that the developer is fed to and collected from the same apparatus A or B, thereby collecting the developer from the apparatus A or B.

If desired, the ON signals of the developing device drive motors 1190*a* and 1190*b* and representative of the operating conditions of the apparatus A and B may be replaced with the ON signals of main drive motors.

While the embodiment has been shown and described as circulating the developer through two image forming apparatuses A and B, the developer may, of course, be circulated through three or more image forming apparatuses.

In FIG. 15, the sensor 1240 mounted on the storage and circulation device 1500' is implemented by a piezoelectric sensor responsive to the toner concentration of the developer being fed out of the device 1500'. If the sensed toner concentration is lower than a preselected value, the motor 1234 of the developer correcting means 1100 is energized. When the toner concentration increases above the preselected value, the toner supply is interrupted in response to the output of a toner concentration sensor 1250*a* or 1250*b* (collectively represented by 1250 in FIG. 16) built in the apparatus A or B.

By the above control, the developer is stored in the developing device 1110, FIG. 6, with a constant toner concentration and capable of developing images stably at all times. Assume that the toner concentration sensed by the sensor 1240 is below the preselected value, and that such an occurrence exceeds a predetermined number of times or continues over a preselected period of time. Then, it is determined that toner is absent in the toner supply unit 1230. In this case, a message alerting the operator to the above condition is displayed on an operation and display panel. This allows fresh toner to be replenished into the storage and circulation device 1500' at an adequate time.

Another embodiment of the present invention is as follows. This embodiment is similar to the above embodiment except for the control over the pump drive motor 1222, supply switching means 1260 and collection switching means 1270 included in the storage and circulation device 1500', FIG. 15.

In FIG. 19, the sensors 1250*a* and 1250*b* of the image forming apparatuses A and B (corresponding to the sensor 1250 shown in FIG. 16) are each implemented as a piezoelectric sensor responsive to the toner concentration of the developer. When the toner concentration of the developer in the developing device 1110 is below a preselected value, the associated main controller 1710*a* or 1710*b* sends a signal to the auxiliary controller 1700. In response, the controller 1700 causes the developer to be fed only to the source A or B of the signal (corresponding to 1300*a* or 1300*b* of FIG. 14) while causing the developer to be collected from the same. For this purpose, the controller 1700 switches the valves 1260 and 1270 and drives the motor 1222 and air pump 1207'. When the toner concentration in the developing device 1110 exceeds the preselected value, the controller 1700 stops driving the motor 1222, i.e., air pump 1207', thereby stopping the circulation of the developer.

In this embodiment, the developer in the device 1500' is provided with a toner concentration higher than the ordinary toner concentration. Therefore, when the developer is replenished on the decrease in toner concentration as in the case of ordinary toner replenishment, it is possible to minimize the amount of developer to be transported. This successfully reduces the capacity and size of the powder pump and thereby reduces the drive load. In addition, the duration of operation of the powder pump is reduced, compared to the case wherein the pump is continuously operated while the image forming apparatuses are in operation. This saves energy, extends the life of the pump parts, and reduces hazards to the developer.

Another embodiment of the present invention will be described. In this embodiment, the pump drive motor 1222, FIG. 19, is implemented by a pulse motor, so that the auxiliary controller 1700 can control the rotation speed of the powder pump. Specifically, the controller 1700 changes the frequency of pulses to be sent to the pulse motor 1222 in accordance with the number of developing unit drive motors in operation or the condition of the valve 1260. As a result, the rotation speed of the motor 1222, and therefore the amount of developer supply, is changed.

For example, assume that the apparatuses A and B (1300*a* and 1300*b*) shown in FIG. 14 each need developer supply at a rate of 100 g/min. Then, if only one of the apparatuses A and B is operating, the controller 1700 sends to the motor 1222 pulses whose frequency causes the motor 1222 to rotate at a speed matching the rate of 100 g/min. However, when the apparatuses A and B are both in operation, the controller 1700 sends to the motor 1222 pulses whose frequency causes the motor 1222 to rotate at a speed matching a rate of 200 g/min. It is to be noted that the relation between the rotation speed of the motor 1222 and the amount in which the developer is transported is determined by, e.g., experiments beforehand. Branch ports formed in the valve 1260 must have their radii and angles selected such that the developer is delivered to both the apparatuses A and B in the same amount. Conversely speaking, the branch ports may each be provided with a particular configuration (radius and angle) when the required amount of developer supply differs from the apparatus A to the apparatus B.

Assume that the powder pump and air pump 1207' shown in FIG. 19 are driven independently of each other. Then, the two pumps may each be started and stopped at a particular timing, as in the control system shown in FIG. 11. This will free the developer from cohesion or blocking on the transport path which would cause the pumps to stick due to burning.

As stated above, in the above image forming system, the developer storage and circulation device should only be connected to the bodies of image forming apparatuses by the supply pipes and collection pipes and cables. Obviously, therefore, the device can be implemented as a unit independent of the apparatus bodies. It follows that by connecting the device to the developing devices of a plurality of image forming apparatuses, it is possible for a single storage and circulation device to control the circulation of the developer through all the developing devices.

Another embodiment of the present invention will be described hereinafter. This embodiment is characterized in that not only is the developer supplied to the developing device 106, FIGS. 2 and 3, but also it is collected from the cleaning device 108, FIG. 2, and is then again delivered to the device 106.

Figure 20:
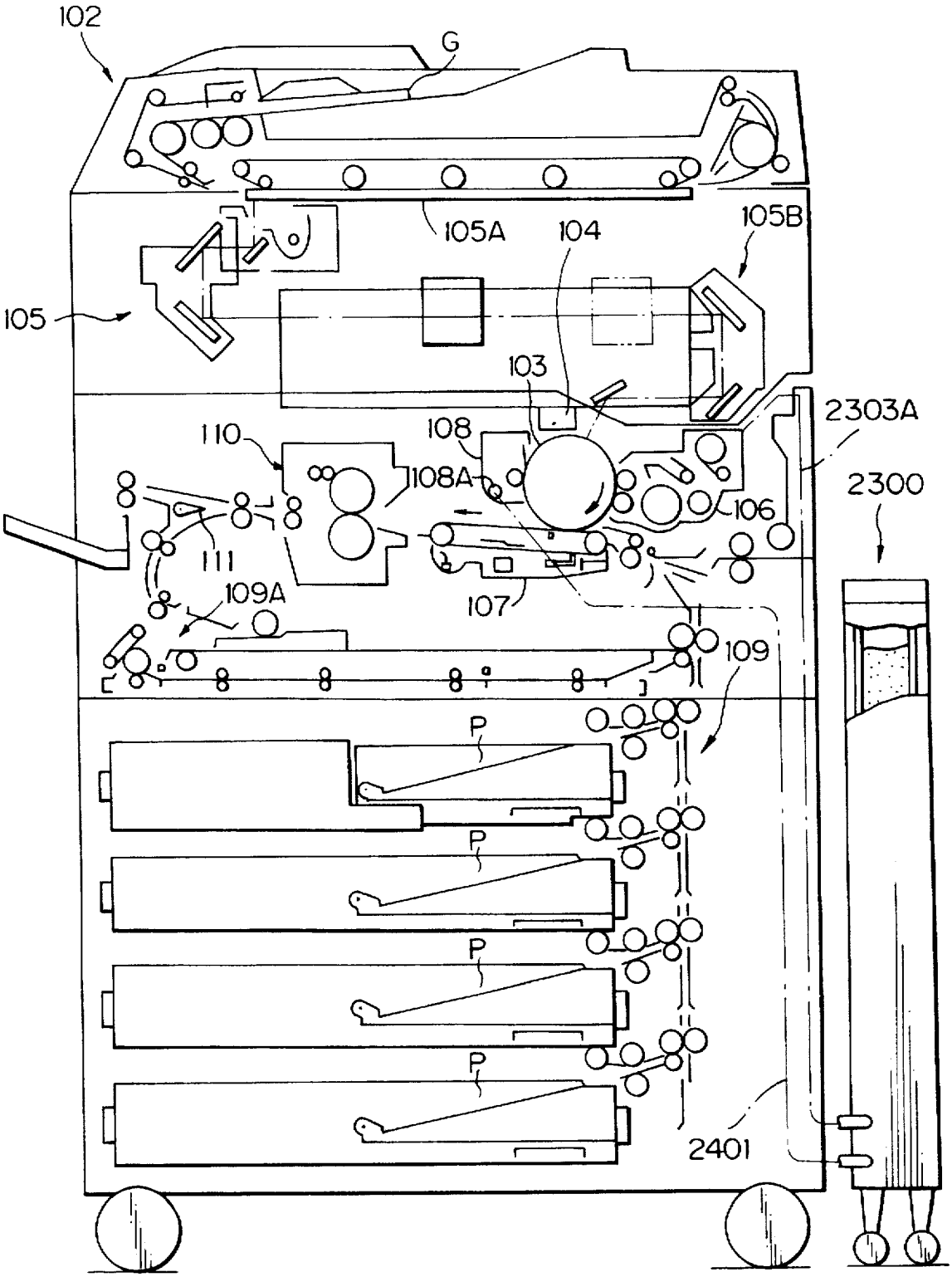
FIG. 20 is a section of a copier included in another embodiment of the present invention.

FIG. 20 shows the copier 102 similar in construction to the copier 102 of FIG. 2. The toner replenishing section 106B, FIG. 3, is partly located outside of the copier 102 independently of the developing device 106, as in the arrangement shown in FIG. 4. One axial end of the agitating member 106M, FIG. 3, corresponds to the part of the section 106B located outside of the copier 102. As shown in FIG. 20, a flexible pipe 2303A forming a part of toner conveying means is connected to the outboard end of the section 106B. The other end of the pipe 2303A is connected to a developer supply device or developer source 2300. Because the section 106B is partly located outside of the copier 102, the height occupied by the parts of the developing device 106 joining in the toner supply is reduced in the copier 102.

In the illustrative embodiment, the developer supply device or developer supplying means 2300 replenishes toner into the two-ingredient type developer stored in the developing device 106. As shown in FIG. 20, the device 2300 is mounted on one of the copiers 102. The device 2300 feeds fresh toner by use of compressed air. The device 2300 will be described in detail with reference to FIG. 21 and successive figures.

Figure 21:
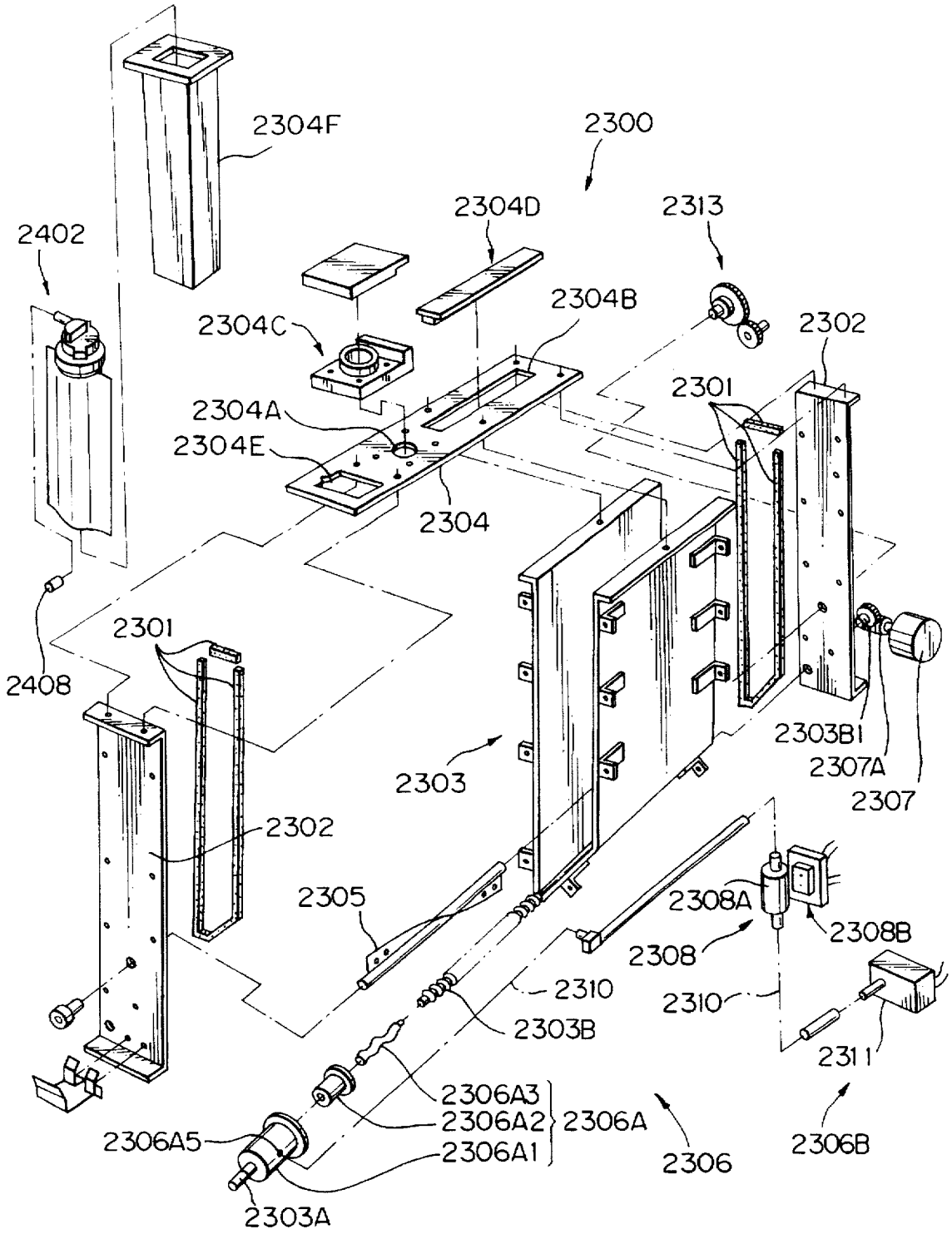
FIG. 21 is an exploded perspective view showing the general construction of a developer supply device included in the copier of FIG. 20.

As shown in FIG. 21, the device 2300 has a casing or box 2303 to which opposite side walls 2302 are affixed with the intermediary of seal members 2301. The top of the box 2302 is implemented as a removable ceiling member 2304. The ceiling member 2304 is joined with the box 2302 via the side walls 2302. The bottom of the box 2303 is inclined downward, as illustrated.

The ceiling member 2304 is formed with holes 2304A and 2304B. An adaptor 2304C is removably received in the hole 2304A in order to mount a toner container which will be described. A filter 2304D capable of closing the opening 2304B is replaceably fitted in the opening 2304B. A hole 2304E is also formed in the ceiling member 2304. A receptacle is fitted in the hole 2304E so as to receive the toner container or toner storing member.

Toner conveying means 2306 is disposed in the box 2303 in the vicinity of the bottom. Agitating and conveying means 2305 is also disposed in the box 2303, but below the conveying means 2306. The agitating and conveying means 2305 agitates toner stored in the box 2303 to thereby obviate toner blocking. The conveying means 2306 conveys the toner from the box 2303 toward the developing device 106.

The toner conveying means 2306 has the construction shown in FIGS. 9 and 10. Specifically, the conveying means 2306 has a screw pump 2306A coaxial with a screw 2303B extending in the box 2303, and air feeding means 2306B for allowing a screw pump 2306A to feed the toner by air under pressure.

Figure 22:
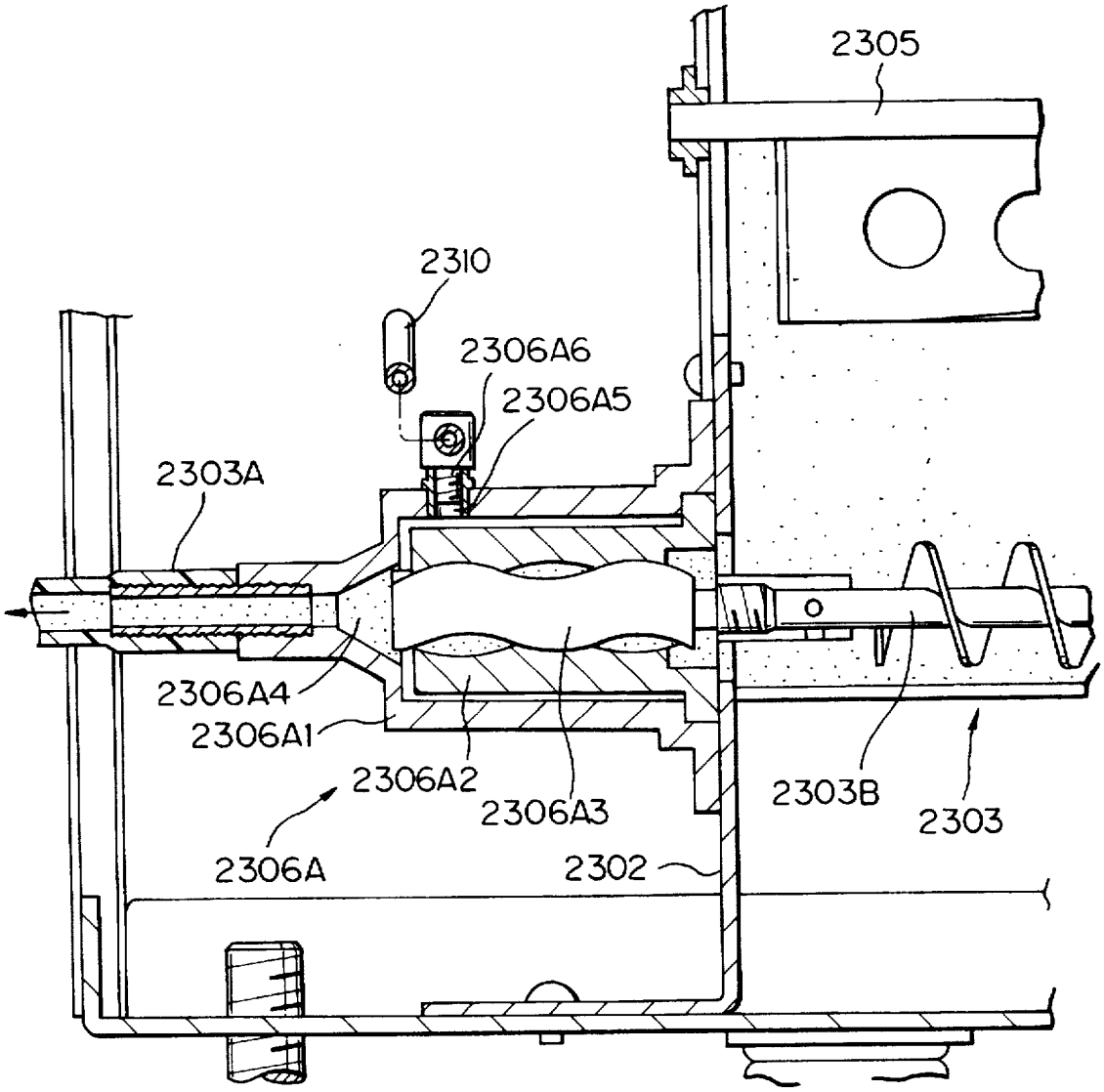
FIG. 22 is a fragmentary section of a powder pump included in the device shown in FIG. 21.

The screw pump 2306A constitutes a powder pump for moving the toner. As shown in FIG. 22, the pump 2306A1 has a holder mounted on the side wall 2302, a stator 2306A2 received in the holder 2306A1, and a spiral rotor 2306A3. The rotor or toner conveying member is coaxial with the screw 2303B and received in a spiral groove formed in the inner periphery of the stator 2306A2. The rotor 2306A3 formed of rubber or a similar elastic material has one axial end thereof joined with the end of the screw 2303B, so that the rotor 2306A3 is rotatable integrally with the screw 2303B.

In FIG. 21, a gear 2303B1 is mounted on the other end of the screw 2303B remote from the rotor 2306A3. The gear is held in mesh with a drive gear 2307A mounted on the output shaft of a drive motor 2307.

As shown in FIG. 22, the stator 2306A2 is formed with an axially extending passage 2306A4 communicated to the spiral groove. A pipe 2303A is connected to the outboard end of the passage 2306A4 and made of vinyl chloride, nylon, Teflon or a similar material which is relatively flexible and durable to the toner. It follows that the developer supply device 2300 and the developing unit 106 of the copier 102, FIG. 20, can be connected together without regard to their positional relation.

As shown in FIG. 22, a gap as small as about 1 mm exists between the inner periphery of the holder 2306A1 and the outer periphery of the stator 2306A2, as in the configuration shown in FIG. 10 or 13. The gap is communicated to the passage 2306A4. Further, an air passage 2306A5 is communicated to the above gap. A tube 2310 is connected to the air passage 2306A5 via a connector 2306A6. An air pump 2311 (see FIG. 21) is connected to the tube 2301 and serves as the air feeding means 2306B.

The air pump 2311 shown in FIG. 21 is so set as to discharge compressed air at a rate of 0.5 liter to 1 liter for a minute. In this condition, a vacuum is generated at the outlet side of the screw pump 2306A. The vacuum makes it easy for the screw 2303B to convey the toner in the box 2303 toward the rotor 2306A3 of the pump 2306A. The fluidity of the toner is enhanced by air from the air pump 2311 as soon as the toner enters the screw pump 2306A. The toner is fed under pressure from the box 2303 toward the pipe 2303A.

The air pump 2311 is driven independently of the members joining in the toner supply. This is to free the screw pump or powder pump 2306A from excessive loads. Specifically, assume that the screw pump 2306A stops conveying the toner and feeding compressed air. Then, although air filling the pipe 303A together with the toner is discharged, the toner deposits on the bottom of the pipe 303A with the result that the bulk density of the toner increases. When the toner is conveyed afterwards, it is blocked by the cohered toner. As a result, an excessive load acts on the rotor 2304A3 in the screw pump or toner moving mans 2306A, causing the rotor 2304A3 to stick.

In light of the above, before the screw pump 2306A starts operating, the air pump 2311 is operated. Also, on the elapse of a certain period of time after the end of operation of the screw pump 2306A, the air pump 2311 is operated. This successfully prevents the toner from cohering. By so controlling the air pump 2311, it is possible to discharge the toner out of the pipe 2303A by air. As a result, the pipe 2303 is prevented from being stopped up by the toner.

Figure 23:
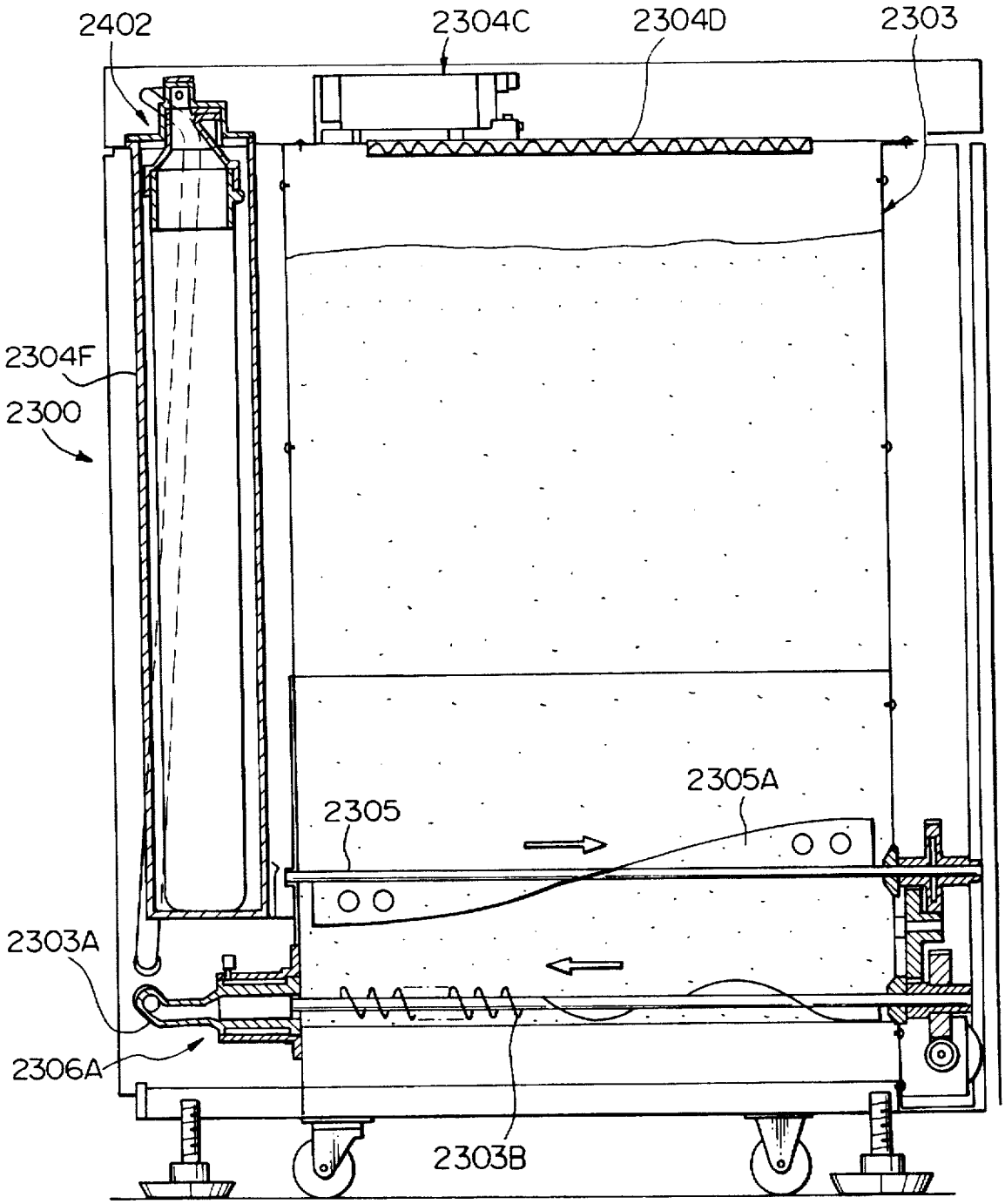
FIG. 23 is a section showing agitating and conveying means, a conveyor screw and a developer collecting section shown in FIG. 21.

As shown in FIG. 23, the screw 2303B has a spiral blade whose lead varies along the shaft extending into the box 2303. Specifically, the lead is smaller at the side adjoining the screw pump 2306A than at the other side. The screw 2303B is so configured as to avoid bridging when the toner cannot smoothly drop due to gravity in accordance with the residual amount of toner, and to convey the toner toward the screw pump 2306A.

Specifically, when the amount of toner remaining in the box 2303 is great, the toner freely drops due to its heavy weight. However, the fall of the toner relying on gravity becomes difficult as the amount of toner remaining in the box 2303 decreases. Moreover, when the toner is difficult to drop, the agitating member scrapes off only a part of the toner positioned at the locus of its rotation; the other part of the toner remains in the cohered state, i.e., bridges. In addition, the toner conveyed by the screw 2303B is pressed against the inner surface of the end wall of the box 2303. The resulting pressure acting on the toner, as well as temperature elevation, aggravates the cohesion of the toner.

In the illustrative embodiments, the number of turns of the screw 2303B is selected as follows. In the range of the screw 2303B where the the number of turns is small, the toner is smoothly conveyed with a minimum of obstruction. In the other range where the number of turns is great, the displacement of the toner and the force acting on the toner are increased. In this configuration, the screw 2303B increases the displacement of the toner and the force acting on the toner in its portion adjoining the screw pump 2306A, thereby insuring the amount of toner to be supplied to the developing device 106. In the portion remote from the pump 2306A, the screw 2303B allows the toner to move toward the pump 2306A in a sufficient amount by reducing the cohesion thereof.

In FIG. 23, the agitating and conveying means 2305 has a spiral blade 2305A disposed in the box 2303. The blade 2305A has less than two turns, preferably about one half of a turn, in the axial direction of the means 2305 with respect to the length of the shaft portion existing in the box 2303; the small number of turns means a great lead. The great lead prevents the toner from bridging due to cohesion and thereby drives all the toner remaining in the box 2303 without regard to its amount.

Figure 24:
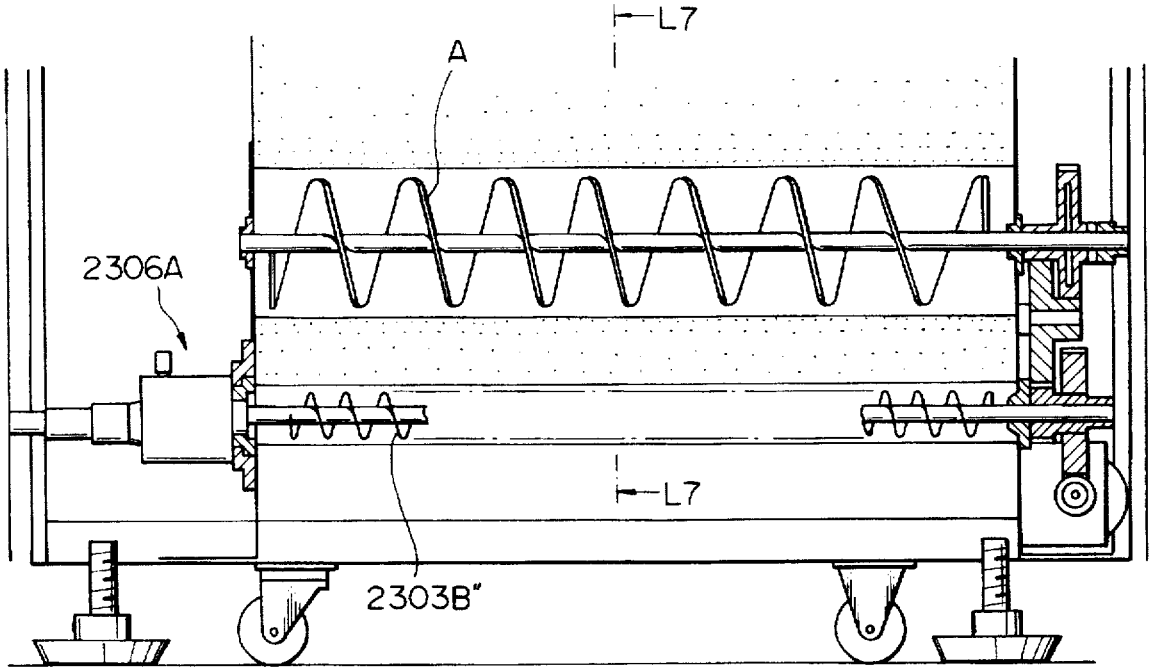
FIG. 24 is a fragmentary section showing a specific developer supply device with which the characteristic features of the device shown in FIG. 21 are compared.
Figure 26:
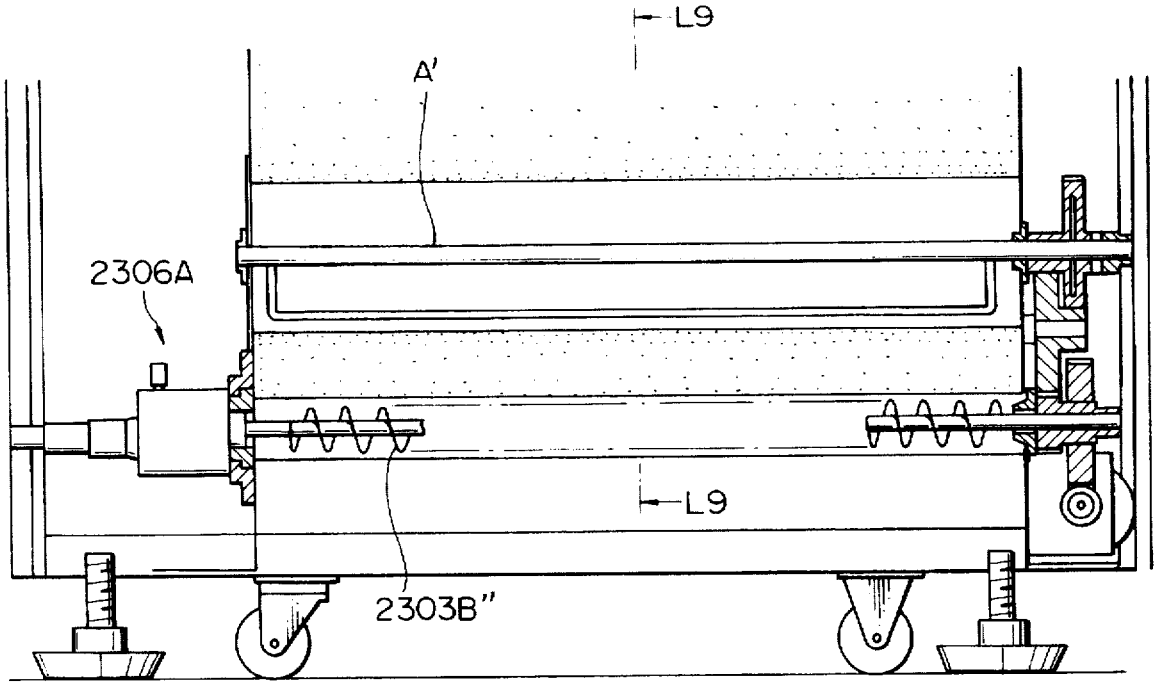
FIG. 26 is a fragmentary section showing another specific developer supply device for comparison.

FIGS. 24 and 26 each show another specific configuration of the agitating means. In FIG. 24, the agitating means has an agitating blade A having a relatively small lead. In FIG. 26, the agitating means has a rod member A' for loosening the toner. The problem with the agitating members A and A' is that the toner coheres around the range in which the members A and A' move, depending on the amount of toner accumulated in the box 2303. Such toner brides without moving. In FIGS. 24 and 26, a screw 2303B" is assumed to have a spiral blade having the same pitch in the axial direction.

Figure 25:
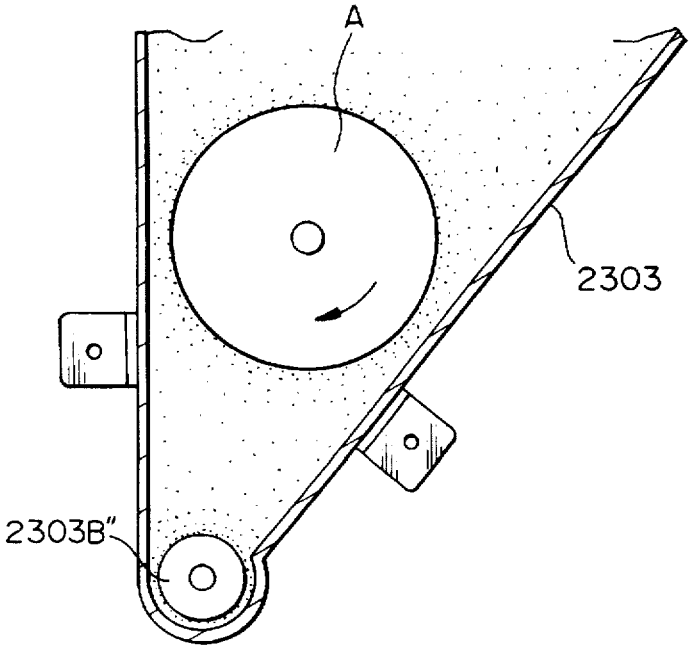
FIG. 25 is a section as seen in a direction L7 shown in FIG. 24.
Figure 27:
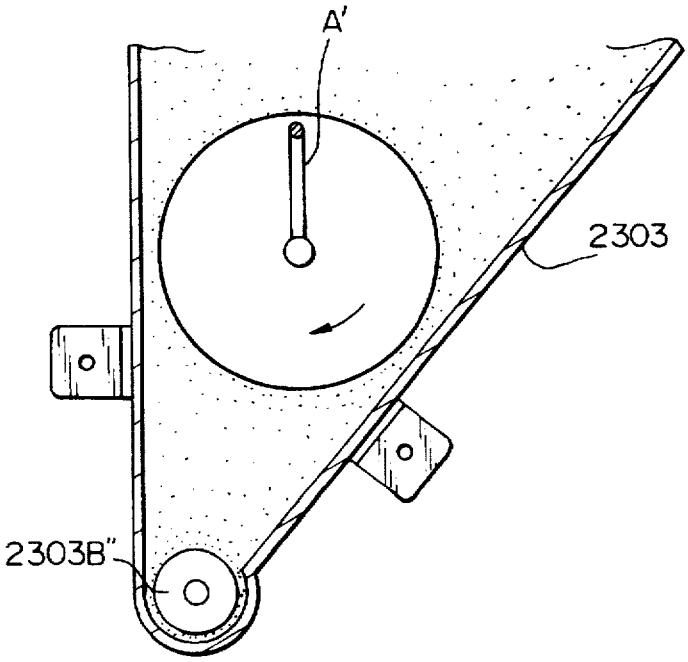
FIG. 27 is a section as seen in a direction L9 shown in FIG. 26.

Specifically, as long as the amount of toner accumulated in the box 2303 is great, the agitating member A or A', like the screw 2303B, allows the toner to enter the locus of its rotation due to gravity because the toner is heavy. Therefore, the member A or A' successfully drives the toner toward the screw 2303B" while agitating it in a desirable manner. However, when the toner in the box 2303 decreases, it is difficult for the toner to drop because of a decrease in weight. In this condition, the toner around the locus of rotation of the member A or A' is apt to cohere in its accumulated state between the inclined bottom of the box 2303 and the wall portion facing it. As a result, as shown in FIG. 25 or 27, the toner around the locus of rotation bridges and does not enter the locus of rotation. The bridging obstructs agitation and conveyance and thereby prevents the toner from being driven toward the screw 2303B.

By contrast, the blade 2305A of the agitating and conveying means 2305, FIG. 23, has a small lead. When the means 2305 is in a halt, it broadens, in the axial direction, the range over which the toner can drop, as indicated by arrows in FIG. 28. Moreover, when the means 2305 is rotated, it exerts an axial moving force on the dropping toner; in addition, it draws the dropped toner thereinto, as indicated by arrows in FIG. 29. The toner drawn into the means 2305 is subjected to forces tending to force it outward in the tangential directions of the blade 2305A.

Figure 28:
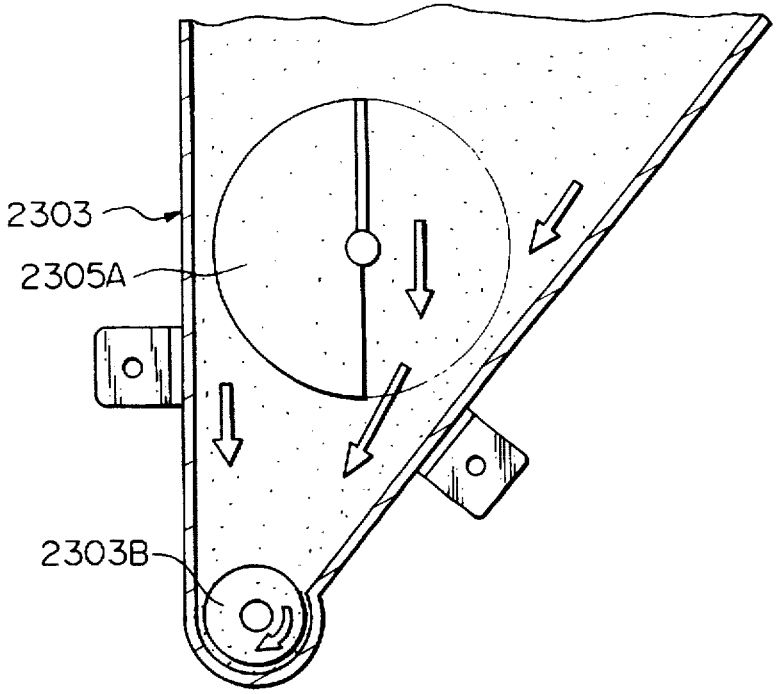
FIG. 28 is a section corresponding to FIG. 7 and for describing the operation of a characteristic feature of the device shown in FIG. 21.
Figure 29:
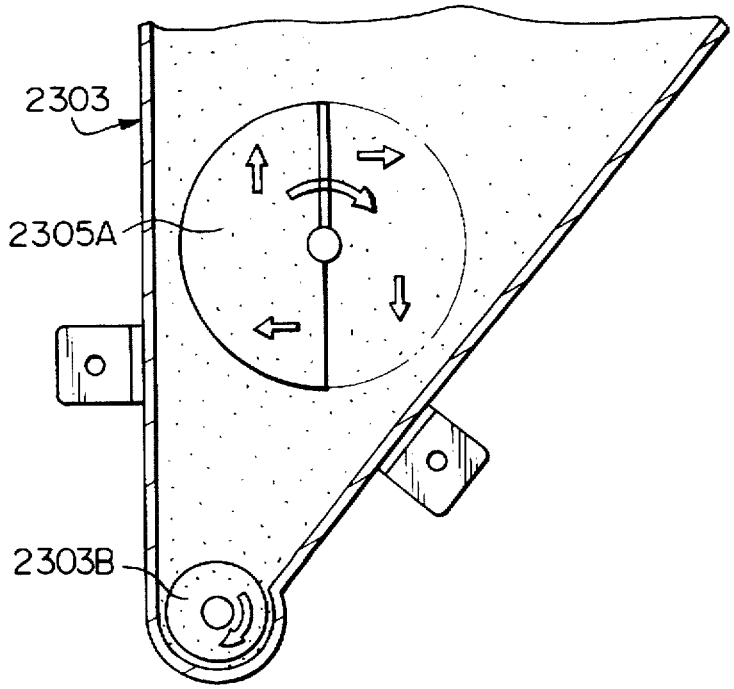
FIG. 29 is a section corresponding to FIG. 25 and for describing another operation of the characteristic feature of the device shown in FIG. 21.

As shown in FIGS. 28 and 29, when the blade 2305A is rotated, it not only moves the toner in the axial direction, but also moves it in directions tangential to the locus of rotation. Hence, even if the amount of toner remaining in the box 2303 is small, the toner moved in the tangential directions destroy the toner remaining in the vicinity of the blade 2305. As a result, the toner tending to bridge is moved toward the screw 2303B. In addition, the toner being moved toward the screw 2303B is agitated by the blade 2305A and charged thereby. In this manner, the toner remaining in the box 2303 can be brought to the screw 2303 without regard to its amount. Particularly, even when the toner level in the box 2303 is below the agitating and conveying means 2305, FIG. 21, the toner can be brought to the portion occupied by the screw 2303B. This insures the transfer of the toner to the conveying means 2306A and thereby supplies the toner to the developing unit 106 stably.

As long as use is made of toner having high fluidity and capable of dropping smoothly due to gravity, the previously stated agitating member A or A' which is simple in configuration may be used.

In the illustrative embodiment, the agitating and conveying means 2305 and toner conveying means 2306 are rotated in opposite directions to each other. This successfully prevents the toner from concentrating at a single position in the axial direction of the screw 2303B and conveying means 2305.

Figure 30:
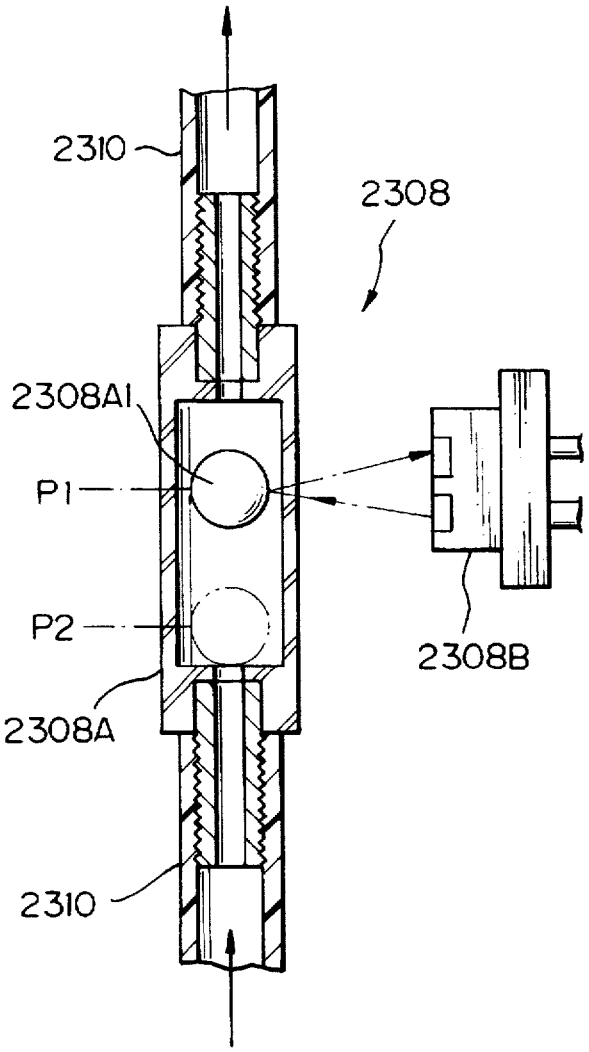
FIG. 30 is a section showing an air pressure sensor included in the device of FIG. 21.

As shown in FIG. 21, an air pressure sensor 2308 is located in the vicinity of the tube 2301 connected to the air pump 2311. The sensor 2308 senses the blow pressure of the air pump 2311. As shown in FIG. 30, the sensor 2308 has a measuring member 2308A connected to a part of the tube 2310, and a sensing member 2308B facing the member 2308A.

The measuring member 2308A is a transparent hollow cylindrical member having an air passage communicated to the tube 2310. A spherical float 2308A1 is disposed in the air passage. When the blow pressure of the air pump 2311 is adequate, the float 2308A1 floats to a position P1 where it does not stop the upper end of the tube 2310. When the blow pressure is not adequate, the float 2308A1 moves to a position P2 below the position P1. The float 2308A is formed of light resin or stainless steel or a similar metal and configured such that it can move between the positions P1 and P2 in accordance with the flow pressure.

The sensing member 2308B is implemented by a reflection type optical device capable of sensing the float 2308A located at the position P1. Specifically, when the float 2308A reaches the position P1, the sensing member 2308B determines that the blow pressure is adequate in response to the resulting change in the reflection from the float 2308A. If desired, the sensing member 2308B may be a pressure sensor capable of sensing a blow pressure on the basis of vacuum acting on the wall of the air passage of the measuring member 2308A. The pressure sensor will simplify the sensor structure, compared to the float scheme. Further, the sensing member 2308B may be of a magnetic sensing type, so that the float 2308A1 can be formed of a magnetic material.

Figure 31:
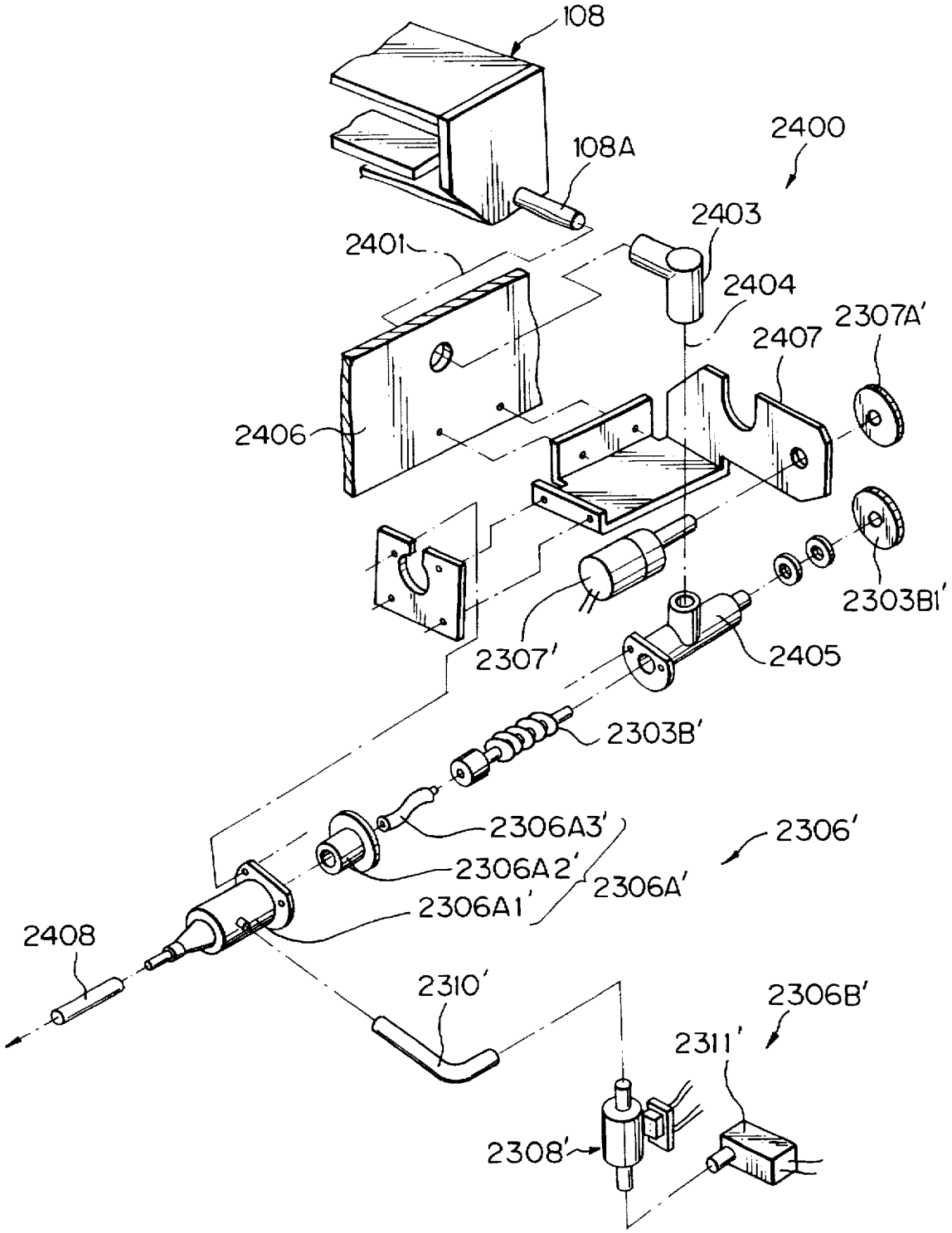
FIG. 31 is a fragmentary section of developer conveying means included in the developer collecting section of FIG. 23.

The cleaning device 108 shown in FIG. 20 is provided with developer collecting means 2400 shown in FIG. 31. The collecting means 2400 collects the toner removed from the photoconductive drum. In the illustrative embodiment, because the collecting means 2400 serves to collect the toner, it will be referred to as toner collecting means hereinafter. As shown in FIG. 20, the cleaning device 108 includes a toner outlet pipe 108A. As shown in FIG. 31, the toner collecting means 2400 is connected to the cleaning device 108 by a pipe 2401 connected to the pipe 108A and forming the other part of the toner conveying means. This connection is indicated by a dash-and-dots line in FIG. 20. In this embodiment, the toner collecting means 2400 is accommodated in the same housing as the developer supply device 2300, FIG. 21.

As shown in FIG. 31, the toner collecting means 2400 has toner conveying means 2306' (distinguished from the toner conveying means 2306, FIG. 22, by apostrophe) for conveying the toner from the cleaning device 108, and the previously mentioned developer container 2402, FIG. 21. The toner conveyed by the conveying means 2306' is collected in the container 2402, as will be described specifically later. The conveying means 2306' is identical in configuration as the conveying means 2306 of the developer supply section. The pipe 2401 connected to the pipe 108A of the cleaning unit 108 at one end is connected to a toner receiving member or elbow member 2403 at the other end. The member 2403 is connected to a hopper 2405 by a pipe 2404.

Figure 32:
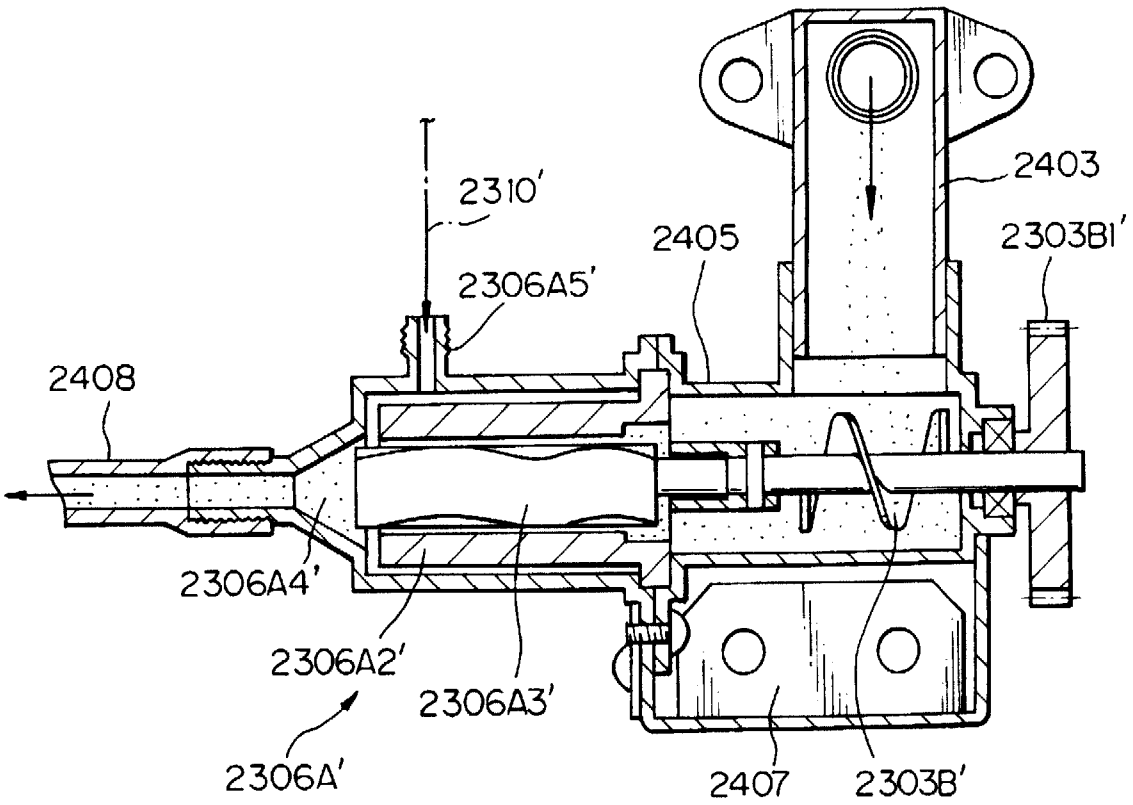
FIG. 32 is a fragmentary section of the conveying means shown in FIG. 31.

Specifically, the toner conveying means 2306' has a screw pump 2306A' coaxial with a screw pump 2303B', and an air pump 2311'. The air pump 2311' constitutes the feeding means 2306B' for feeding air under pressure. As shown in FIG. 32, the hopper 2405 is mounted on a support member 2407 (see FIG. 31) mounted on a side wall 2406 (see FIG. 31). The screw pump 2306A' constituting a powder pump for moving the toner includes a stator 2306A2' and a spiral rotor 2306A3'. The stator 2306A2' is received in the hopper 2405. The rotor or toner conveying member 2306A3' is coaxial with the screw 2303B' and has its spiral portion received in a spiral groove formed in the inner periphery of the stator 2306A2'. The rotor 2306A3' is formed of rubber or a similar elastic material and has its one end joined with the end of the shaft of the screw 2303B' extended into the hopper 2405.

As shown in FIG. 32, a gear 2303B1' is mounted on the end of the shaft of the screw 2303B' remote from the rotor 2306A3'. The gear 2303B1' is held in mesh with a drive gear 2307A mounted on the output shaft of a drive motor 2307'. The motor 2307' is mounted on the support member 2407, FIG. 31. When the rotor 2306A3' is rotated by the motor 2307', its spiral portion moves in the spiral groove of the stator 2306A2', moving the toner coming out of the screw 2303B' in the axial direction of the rotor.

As shown in FIG. 32, a passage 2306A4' is formed in the stator 2306A2' and communicated to the spiral groove of the stator. A pipe 2408 is connected to the open end of the passage 2306A4' and made of vinyl chloride, nylon, Teflon or a similar material which is relatively flexible and durable to toner. Therefore, the toner container 2402 which will be described and the cleaning unit 108 can be connected to each other without regard to their positional relation.

As shown in FIG. 32, a gap as small as about 1 mm exists between the inner periphery of the hopper 2405 and the outer periphery of the stator 2306A2' and is communicated to the passage 2304A4'. An air passage 2306A5' is communicated to the above gap. A tube 2310' shown in FIGS. 31 and 32 is connected to the air passage 2306A5' at one end and connected to an air pump 2311' at the other end. The air pump 2311' corresponds to the air feeding means 2306B'.

The air pump 2311' is so set as to feed compressed air at a rate of about 0.5 liter to 1 liter for a minute. The compressed air generates a vacuum at the outlet side of the screw pump 2306A'. The vacuum makes it easy for the screw 2303B' to convey the toner in the hopper 2405 toward the rotor 2306A3' of the pump 2306A'. The fluidity of the toner is enhanced by air from the air pump 2311' as soon as the toner enters the screw pump 2306A'. The toner is fed under pressure from the hopper 2405 toward the pipe 2408.

An air pressure sensor 2308' is located in the vicinity of the tube 2310' connected to the air pump 2311'. The sensor 2308' is identical in configuration with the sensor 2308, FIGS. 21 and 30, and is responsive to the blow pressure of the air pump 2311'. The air pump 2311' is driven independently of the members joining in the toner supply. This is to free the screw pump or powder pump 2306A' from excessive loads.

Figure 33:
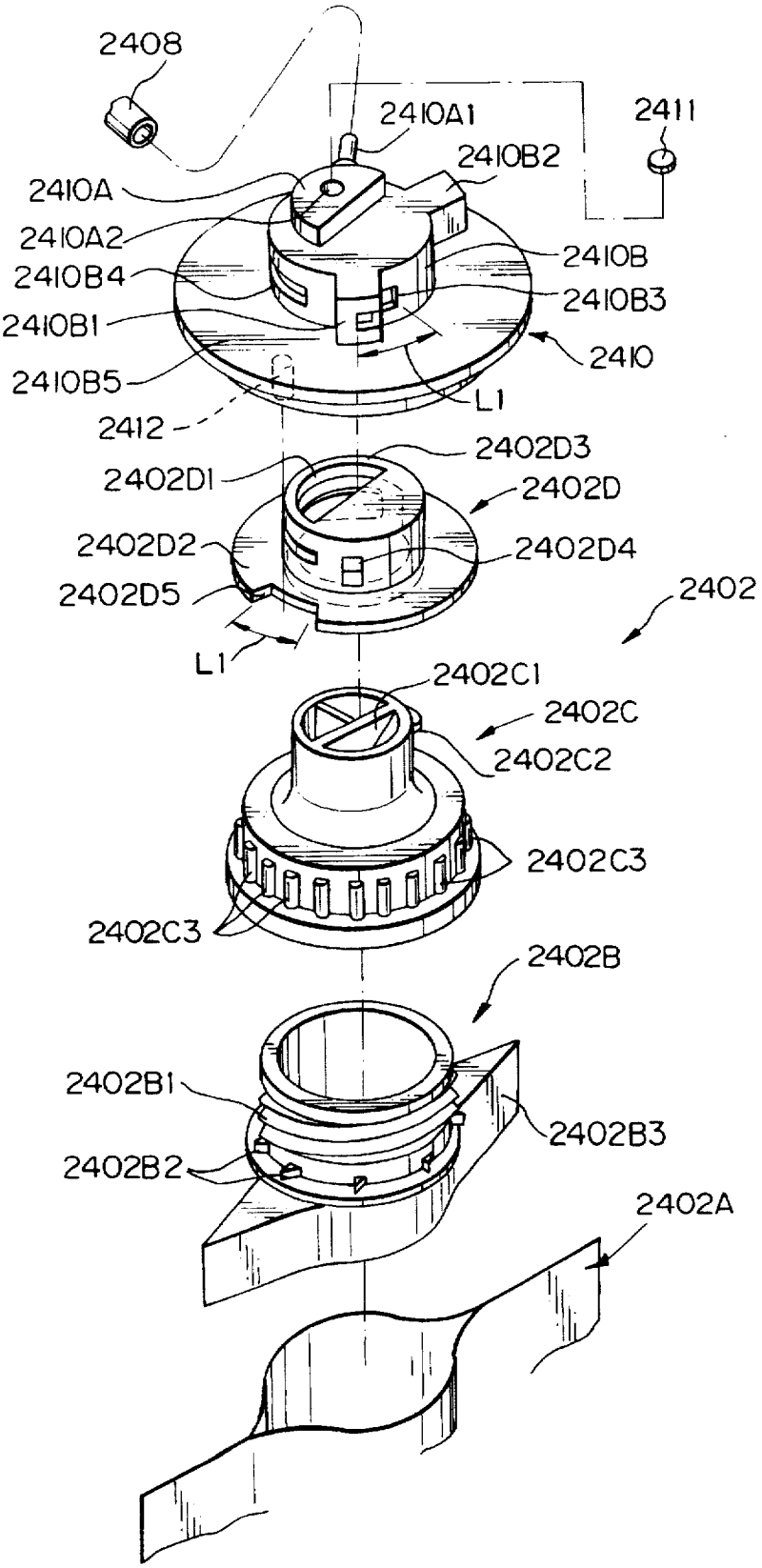
FIG. 33 is an exploded perspective view showing an essential part of the developer collecting section shown in FIG. 23.

Let the developer container 2402 be referred to as a toner container hereinafter because it is expected to collect the toner in the illustrative embodiment. As shown in FIG. 33, the pipe 2408 connected to the toner outlet side of the screw pump 2306A' at one end is connected to the toner container 2402 at the other end.

As shown in FIG. 23, the developer supply device 2300 located independently of the copier 102, FIG. 20, has a collection box 2304F adjoining the toner supply box 2303. The toner container 2402 is received in the box 2304F.

As shown in FIG. 33, the toner container 2402 has a bag 2402A for receiving the collected toner. A mouth portion 2402B, a support portion 2402C and a shutter portion 2402D are fitted on the bag 2402A. The bag 2402A is formed of polyethylene, nylon or a similar resin and has a capacity one-tenth to one-fifth of the capacity of the toner container 2303. This is because the cleaning unit 108 collects 10% to 20% of the toner replenished into the developing unit 106, as determined by experiments.

The mouth portion 2402B is implemented by a hollow cylindrical member. A male screw 2402B 1 is formed on the outer periphery of the mouth portion 2402B from the top toward the bottom. Locking lugs 2402B2 are also formed on the mouth portion 2402B. The mouth portion 2402B has at its bottom a connecting portion 2402B3 to be connected to the edge of the open end of the bag 2402A by, e.g., high frequency heating. Specifically, the connecting portion 2402B3 has the above hollow cylindrical portion at its center, and a flange portion extending downward from the cylindrical portion. The connecting portion 2402B3 tightly contacts the bag 2402A while opening the intermediate portion of the bag 2402A and sequentially closing the bag 2402A toward its opposite ends, as illustrated. The locking lugs 2402B2 are implemented as radially extending sawteeth positioned at equally spaced locations along the circumference of the mouth portion 2402B.

Figure 34:
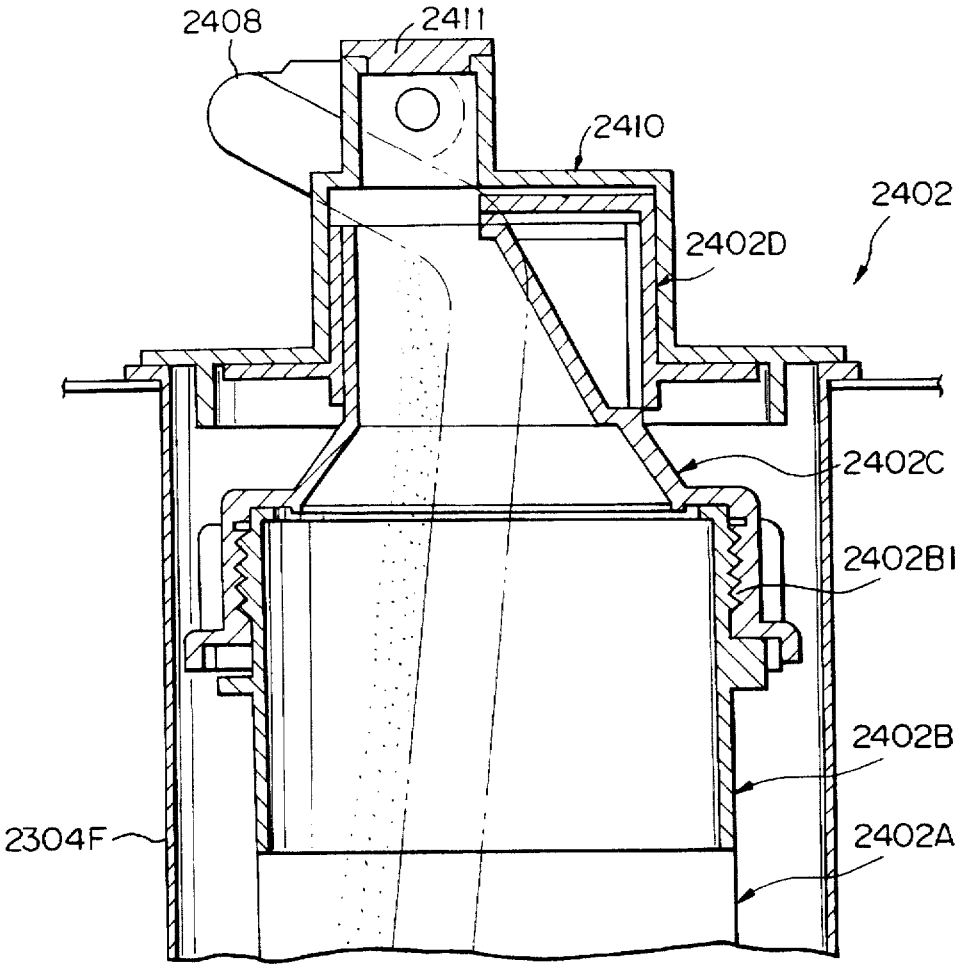
FIG. 34 is a section showing a specific condition in which the collecting section of FIG. 33 is mounted.

As shown in FIG. 34, the support portion 2402C is constituted by a hollow cylindrical member having a smaller diameter at its top than at its bottom, as viewed in a sectional side elevation; that is, it has a funnel-like shape positioned upside down. The support portion 2402C has a portion for supporting the mouth portion 2402B, and a portion for receiving the toner. The portion for supporting the mouth portion 2402B has a female screw, not shown, in its inner periphery and lugs, not shown, identical in phase with the lugs 2402B2. The portion for receiving the toner has a semicircular opening 2402C1 formed in its top.

As shown in FIGS. 33 and 34, the female screw of the support portion 2402C mates with the male portion 2402B1 of the mouth portion 2402B. The lugs of the support portion 2402C abut against the lugs 2402B2 in order to prevent the portion 2402C from turning in the direction opposite to the driving direction.

As shown in FIG. 33, the support portion 2402C has a cylindrical portion at its upper end. A lug 2402C2 extends radially outward from the periphery of the above cylindrical portion. The lower end of the support portion 2402C is implemented as another cylindrical portion having ribs 2402C3. The ribs 2402C3 are arranged at equally spaced locations along the circumference of the cylindrical portion. When the support portion 2402C is to be driven onto the mouth portion 2402B having the male screw 2402B1, the ribs 2402C3 are nipped by fingers. A semicircular opening 2402C1 is formed in the top of the upper cylindrical portion of the support portion 2402C. The opening 2402C1 is selectively opened or closed by the shutter portion 2402D which will be described. When the opening is opened, it forms a toner passage extending to the bag 2402A.

The shutter portion 2402D is a cylindrical member having a lower end coupled over and rotatable relative to the upper cylindrical portion of the support portion 2402C. A semicircular opening 2402D1 is formed in the top of the shutter portion 2402D. An annular flange 2402D2 is positioned intermediate between the axially opposite ends of the shutter portion 2402D. A circumferential groove 2402D3 is formed in the outer periphery of the shutter portion 2402D below the flange 2402D2. The groove 2402D3 includes a vertical groove into which the lug 2402C2 of the support portion 2402C is inserted from below.

Figure 35:
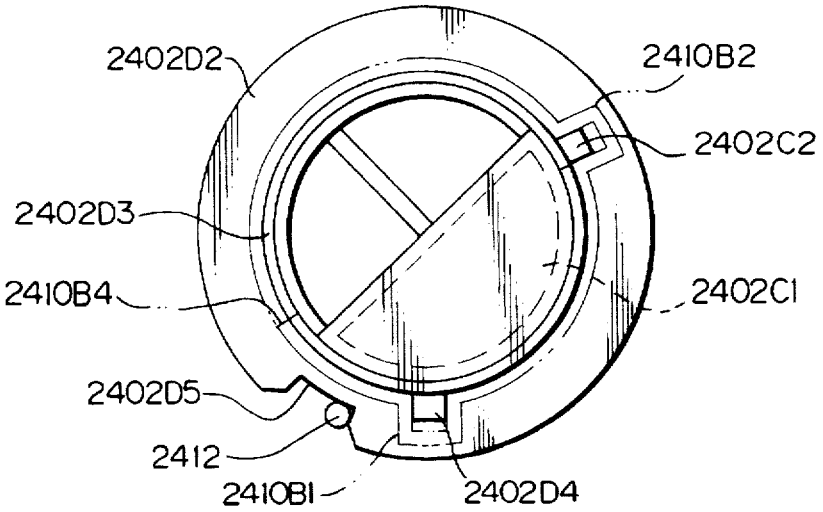
FIG. 35 demonstrates a specific operation of the collecting section shown in FIG. 33.
Figure 36:
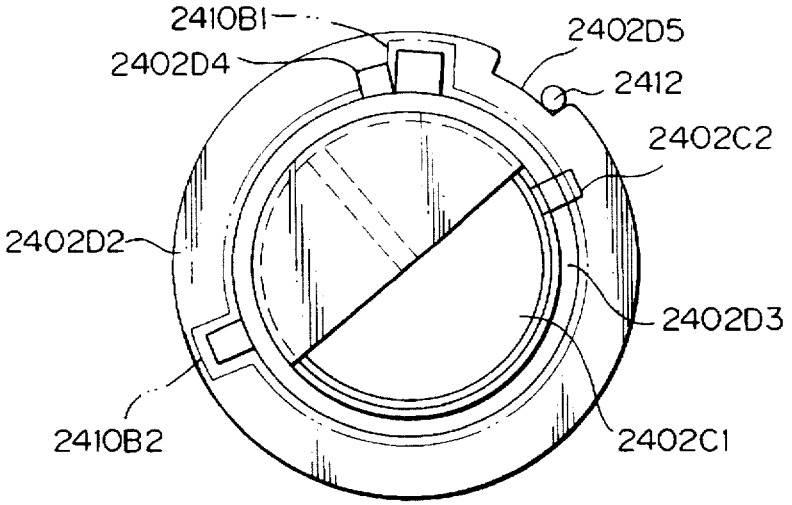
FIG. 36 is a view similar to FIG. 35, showing another specific operation of the collecting section.

As shown in FIGS. 35 and 36, the circumferential groove 2402D3 extends over an angle of 180 degrees from the position where the vertical groove is positioned. A lug 2402D4 protrudes radially from the shutter portion 2402D in the vicinity of the end of the groove 2402D3 and angularly spaced about 120 degrees from the beginning of the groove 2402D3.

As shown in FIG. 35, a notch 2402D5 is formed in the flange 2402D2 of the shutter portion 2402D in the vicinity of the end of the groove 2402D3. A drive pin 2412 extending out from a hopper 2410, which will be described, is received in the notch 2402D5. The shutter portion 2402D coupled over the support portion 2402C is rotatable over 180 degrees, i.e., half a rotation between the beginning and the end of the groove 2402D3 in which the lug 2402C2 is received. As a result, the semicircular opening 2402C1 of the support portion 2402C is selectively opened or closed. Specifically, as shown in FIG. 34, when the openings 2402C1 and 2402D1 are aligned, the toner can be introduced into the bag 2402A. The opening 2402C1 is closed when the openings 2402C1 and 2402D1 are deviated 180 degrees from each other, thereby preventing the toner from flying about.

As shown in FIG. 33, the hopper 2410 is a member for introducing the toner collected from the cleaning device 108 into the bag 2402. The hopper 2410 is removably fitted on the top of the shutter portion 2403D. The hopper 2410 has a collecting portion 2410A and a drive portion 2410B. The collecting portion 2410A is positioned at the top of the hopper 2410. The collecting portion 2410A has a semicircular bore communicated to a pipe 2410A1. The pipe 2408 communicated to the toner conveying means 2306', FIG. 31, can be connected to the pipe 2410A1. The above bore can face the openings 2402C1 and 2402D1 of the support portion 2402C and shutter portion 2402D, respectively. A hole 2410A2 is formed in the top of the collecting portion 2410A while a filter 2411 is fitted in the hole 2410A2.

The drive portion 2410B of the hopper 2410 is cylindrical and formed with radially extending lugs 2410B1 and 2410B2 on its outer periphery. The lugs 2410B1 and 2410B2 are angularly spaced 120 degrees from each other in matching relation to the beginning of the groove 2402D3 and lug 2402D4.

The lugs 2410B1 and 2410B2 are hollow. The lug 2410B1 corresponding in position to the lug 2402D4 of the shutter portion 2402D is formed with a first circumferential groove 2410B3 extending to the outer periphery of the cylindrical portion. The groove 2410B3 has a circumferential length L1 corresponding to the length L1 of the notch 2402D5 of the flange 2402D2 of the shutter member 2402D. A second circumferential groove 2410B4 is formed in the outer periphery of the above cylindrical portion and identical with the groove 2402D3 of the shutter member 2402D as to the beginning, end and length. The drive portion 2410B has a flange 2410B5 greater in diameter than the cylindrical portion at its lower end. The previously mentioned drive pin 2412 extends downward from the underside of the flange 2410B5.

To assemble the toner container 2402, the edge of the open top of the bag 2402A is affixed to the connecting portion 2402B3 of the mouth portion 2402B by heat. Then, the support portion 2402C is driven onto the mouth portion 2402B with the female screw mating with its male screw portion 2402B1. At this instant, the lugs 2402B2 of the mouth portion 2402B abut against the lugs of the support portion 2402C, thereby preventing the portion 2402C from turning in the opposite direction. Subsequently, the shutter portion 2402D is coupled over the upper end of the support portion 2402C; the lug 2402C2 of the support portion 2402C is received in the vertical groove of the shutter portion 2402D corresponding to the beginning of the circumferential groove 2402D3.

The hopper 2410 with the air filter 2411 is coupled over the shutter portion 2402D with its lugs 2410B1 and 2410B2 facing the lug 2402C2 of the support portion 2402C and the lug 2402D4 of the shutter portion, respectively. The hopper 2410 is connected to the pipe 2410A1 by the pipe 2408 extending from the toner conveying means 2306'. The opening/closing movement of the shutter 2402D is effected by the hopper 2410 which is operated by hand.

FIG. 35 shows the toner container 2402 in its assembled condition. As shown, the lugs 2402C2 of the support portion 2402C and the lug 2402D4 of the shutter portion 2402D are respectively received in the lugs 2410B1 and 2410B2 of the drive portion 2410B of the hopper 2410. The opening 2402C1 of the support portion 2402C and the opening 2402D1 of the shutter portion 2402D are not aligned.

To bring the openings 2401C1 and 2402D1 into alignment, the operator holds the support portion 2402C by one hand and then turns the hopper 2410 clockwise, as viewed in FIG. 33, by the other hand. At this instant, the lug 2402D4 of the shutter portion 2402D and received in the groove 2410B3 moves from the lug 2410B1 to the cylindrical portion smaller in diameter than the lug 2410B1. This prevents the shutter portion 2402D from dropping.

When the hopper 2410 is turned as stated above, the pin 2412 of the hopper 2410 abuts against the edge of the notch 2402D5 of the shutter portion 2402D and thereby causes the portion 2402D to rotate together with the hopper 2410. The two portions 2402 and 2410 are rotated until the lug 2402C2 of the portion 2402C abut against the edge of the groove 2402D3 of the portion 2402D and that of the groove 2410B2 of the hopper 2410; that is, they rotate 180 degrees or half a rotation. As a result, the openings 2402C1 and 2402D1 and therefore the collecting portion 2410A of the hopper 2410 and bag 2402A are communicated to each other, as shown in FIG. 36. The toner introduced via the collecting portion 2410A of the hopper 2410 has been mixed with air. However, because air is discharged via the air filter 2411, only the toner is admitted into the bag 2402A due to its own weight.

The hopper 2410 is removed from the shutter portion 2402 in the event of, e.g., replacement of the toner container 2402, as follows. The lug 2402D4 of the shutter portion 2402D and the lug 2402C2 of the support portion 2402C are removed from the hopper 2410 by a procedure opposite to the above procedure. As a result, the openings 2402C1 and 2402D1 are brought out of alignment, i.e., the shutter portion 2402D closes the opening 2402C1. This successfully prevents the toner from flying out of the bag 2402A.

Figure 37:
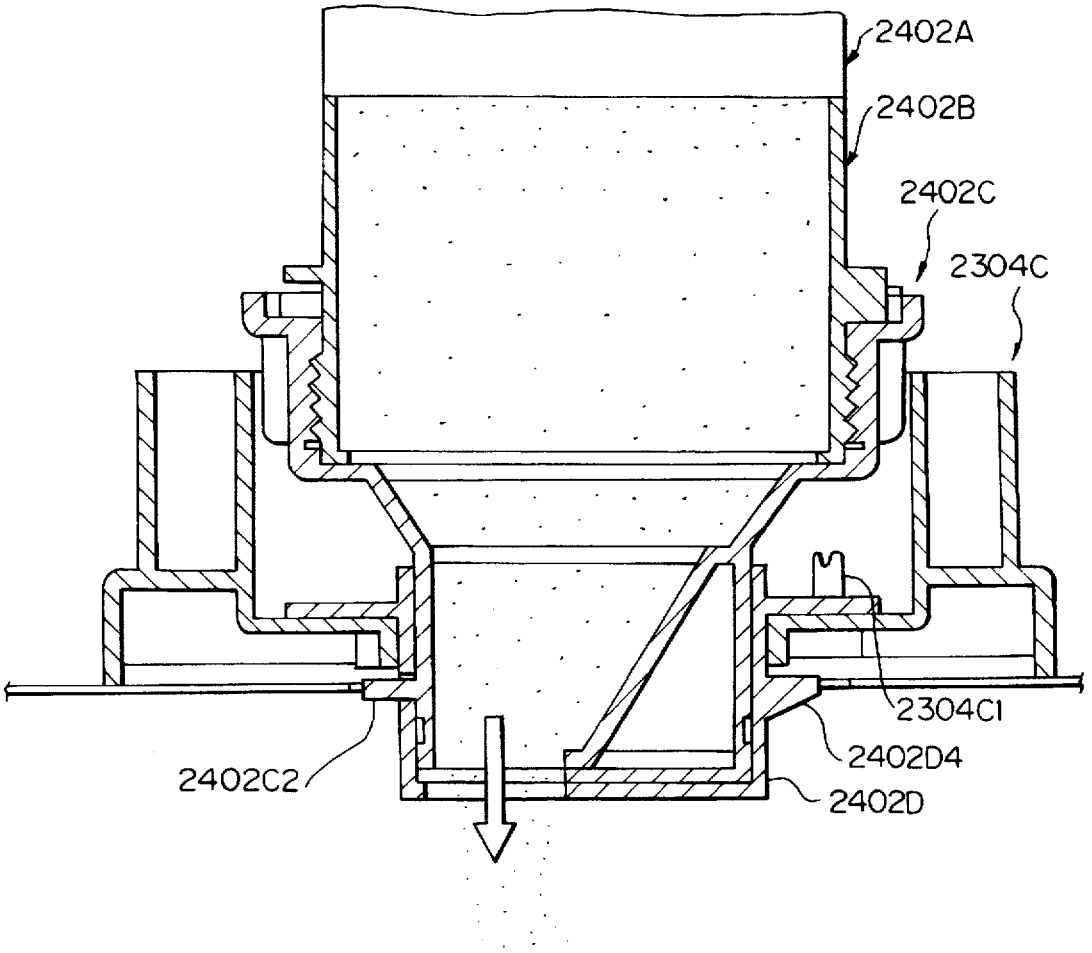
FIG. 37 is a section showing another specific condition in which the collecting section of FIG. 23 is mounted.

The toner container 2402 is used not only to collect the toner from the cleaning device 108, but also to recycle it. Specifically, as shown in FIG. 37, a pin 2304C1 is studded on the adaptor 2304C, FIG. 21, in order to rotate the shutter portion 2402D when the toner container 2402 without the hopper 2410 is mounted. More specifically, the pin 2304C1 corresponds to the drive pin 2412 of the hopper 2410. After the notch 2402D5 of the shutter portion 2402D has been engaged with the pin 2304C1, the portion 2402D is turned in the direction in which it unblocks the opening 2402C1 of the support portion Cl. As a result, the toner drops from the bag 2402A into the box 2303, FIG. 21. It is noteworthy that the toner containing portion in the form of the bag 2402A is foldable and therefore easy to transport and store.

While the toner container 2402A is formed of polyethylene, nylon or a similar resin in the embodiment, it may be implemented as a PET (polyethylene terephthalate) bottle or a similar hard bottle, if desired.

Figure 38:
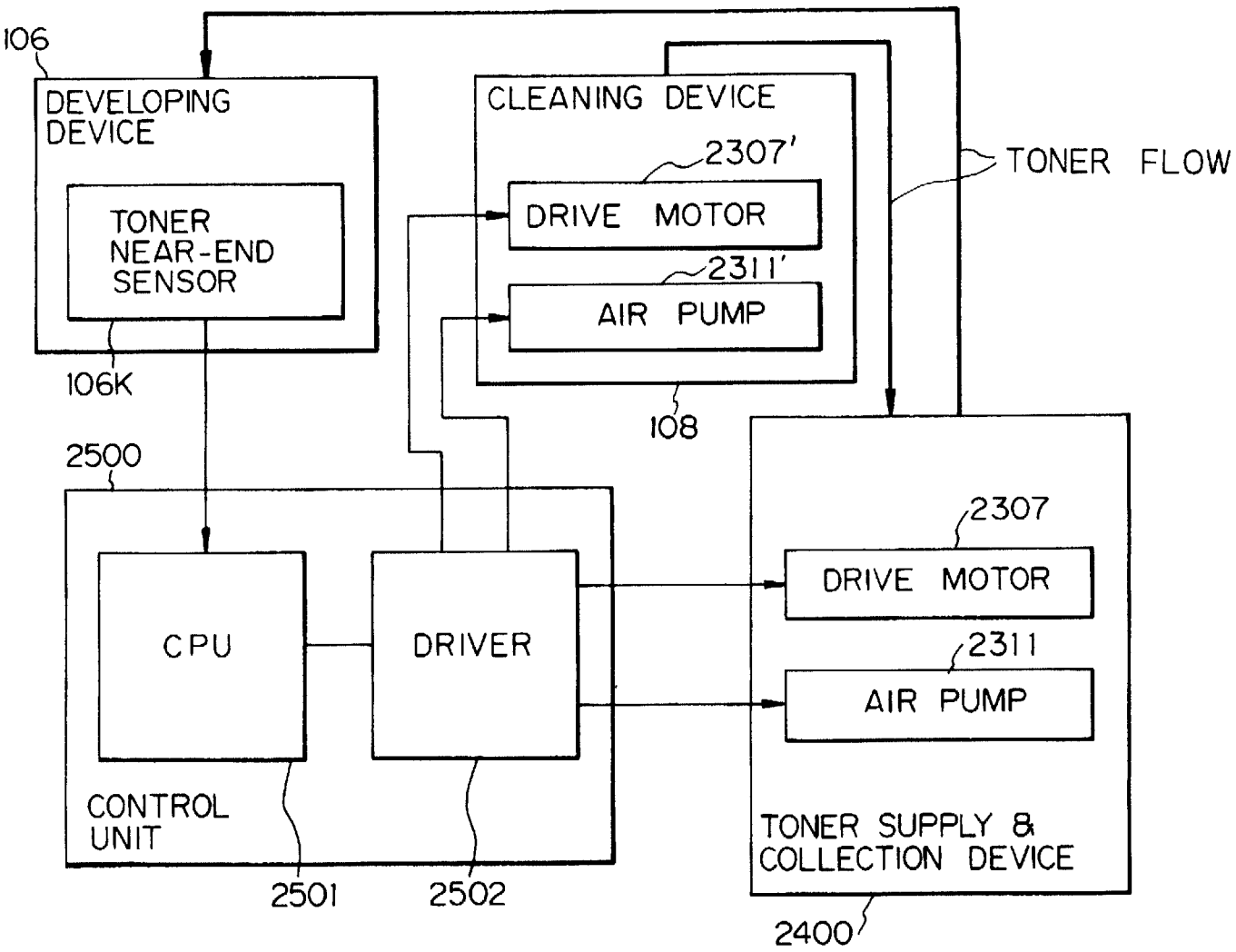
FIG. 38 is a block diagram schematically showing a control arrangement for controlling the supply device and collecting section shown in FIG. 23.

FIG. 38 shows a control system included in the illustrative embodiment for controlling the toner conveying means. As shown, the system has a control unit 2500 made up of a CPU (Central Processing Unit) 2501 and a driver 2502. The control unit 2500 controls the developing device 106, cleaning device 108, and toner supplying and collecting means 2400. The toner supplying and collecting means is identical with the toner collecting means 2400 stated earlier, but so named because it not only collects the toner but also allows it to be returned to the box 2303.

The toner concentration sensor 106K (labeled TONER NEAR-END SENSOR for convenience) of the developing unit 106 is connected to the CPU 2501 via an interface, not shown. In response to the output of the sensor 106K, the CPU 2501 causes the driver 2502 to drive the toner conveying means 306 and 2306' (see FIGS. 21 and 31) of the cleaning device 108 and toner supply and collection device 2400, and air pumps 2311 and 2311'. Further, the air pressure sensors 2308 and 2308' are connected to the CPU 2501 to allow it to monitor the operating conditions of the air pumps 2322 and 2322', although not shown in FIG. 38.

Figure 39:
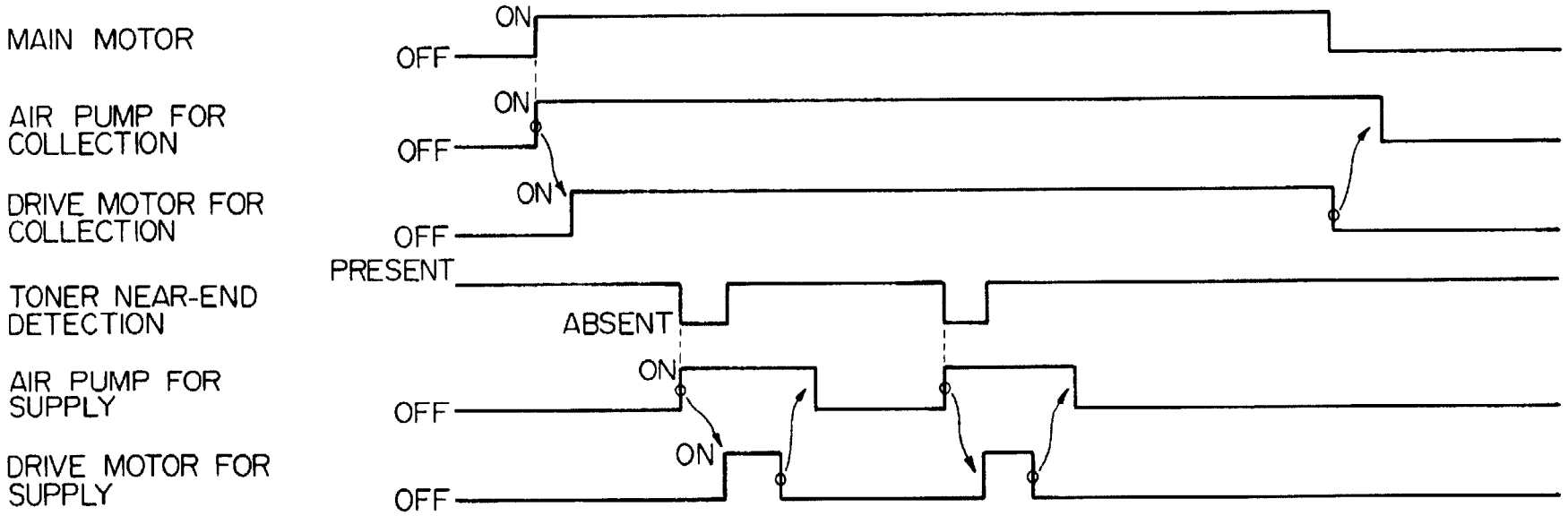
FIG. 39 is a timing chart demonstrating a specific operation of a control unit shown in FIG. 38.

The control unit 2500 controls the operation timings of the motors and air pumps of the toner conveying means 2306 and 2306', as shown in FIG. 39. As shown, when the main motor of the copier 102 starts rotating at the beginning of operation of the copier 102, the control unit 2500 drives the air pump 2311' of the toner conveying means 2306' in charge of toner collection. Then, on the elapse of a preselected period of time, the control unit 2500 drives the motor 2307' of the toner conveying means 2306'. When the operation of the copier 102 ends, the control unit 2500 stops driving the air pump 2311' on the elapse of a preselected period of time after the stop of rotation of the motor 2307'. As a result, the toner remaining in the toner conveying means 2306' and pipes connected thereto is blown away by compressed air. This prevents the residual toner from stopping up the collecting section and increasing the load on the toner conveying section to an excessive degree.

Assume that the output of the sensor 106K is indicative of a condition wherein the amount of toner available in the developing unit 1067 is or will soon become too small to guarantee a desired image density. Then, the control unit 2500 starts driving the air pump 2311 of the toner conveying means 2306 in charge of toner replenishment. Subsequently, on the elapse of a preselected period of time, the control unit 2500 starts driving the motor 2307. When the output of the sensor 106K shows that the developer in the developing unit 106 has reached an adequate toner concentration, the control unit 2500 stops driving the motor 2307 and then stops driving the air pump 2311 on the elapse of a preselected period of time. This also successfully exhausts the pipes of the residual toner.

Figure 40:
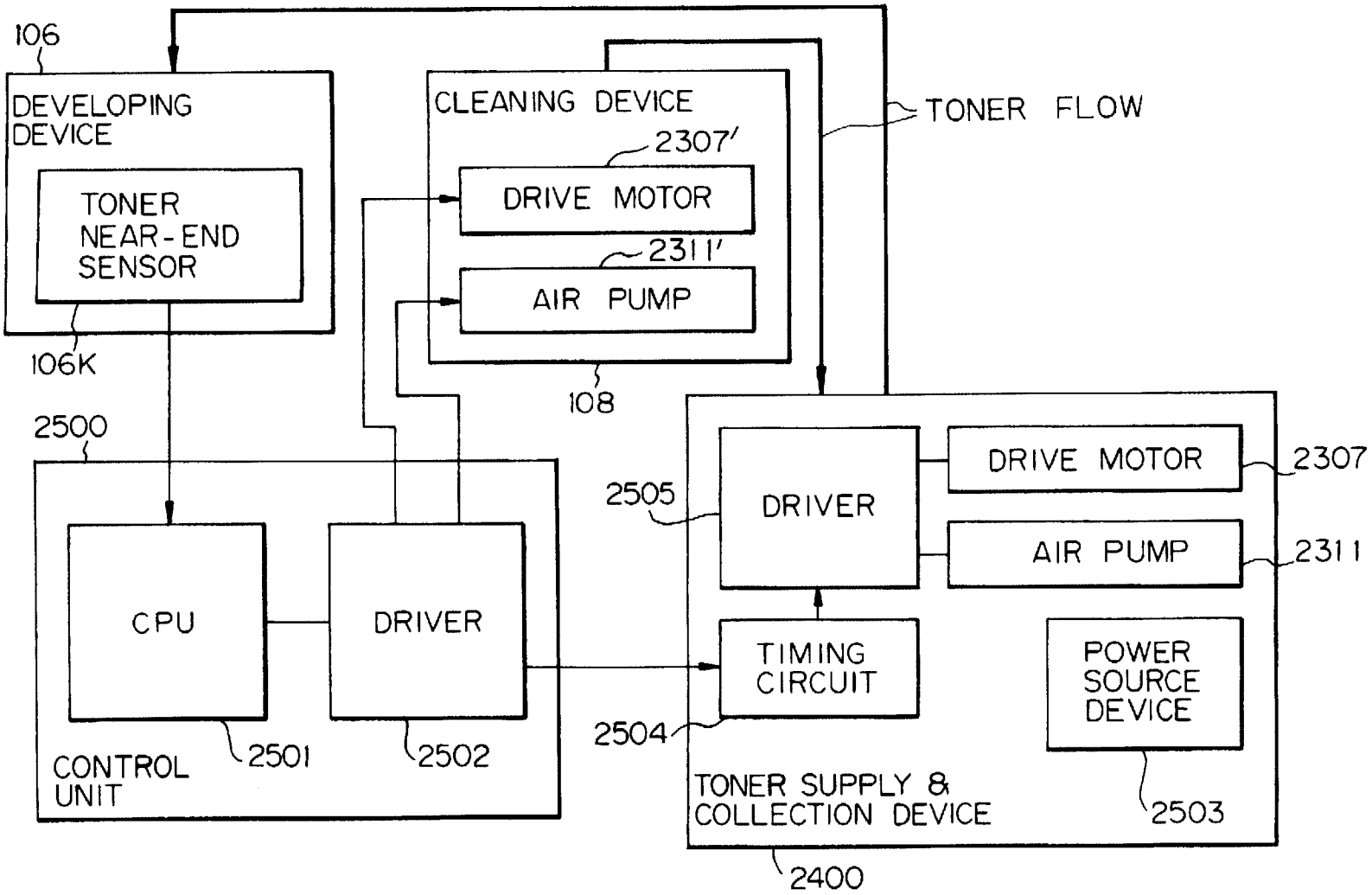
FIG. 40 is a block diagram showing a modification of the control arrangement of FIG. 38.

FIG. 40 shows a modification of the above control system. As shown, the toner supply and collection device 2400 is provided with a power source unit 2503 for driving the toner conveying means 2306 and 2306', a timing unit 2504 for setting timings relating to the air pumps and motors, and a driver 2502 for driving the air pumps and motors. The CPU 2501 shown in FIG. 40 sends a trigger signal to the device 2400 for controlling it. In response, the device 2400 itself sets the necessary operation timings. In this configuration, because a single electric wiring connecting the CPU 2501 to the device 2400 and assigned to the trigger signal suffices, the wiring is comparatively simple.

The systems shown in FIGS. 38 and 40 each execute the ON/OFF control of the air pumps 2311 and 2311' and motors 2307 and 2307' at preselected cycle timings, and then wait for the next trigger signal. Alternatively, the systems may be modified such that when the next signal representative of the toner near-end condition is input during the course of the above cycle, they continuously drive the motors of the toner conveying means. For the signal line, use may be made of an optical communication structure in order to obviate obstructions ascribable to wiring work and wirings.

As stated above, the embodiment makes it needless to accommodate a toner collecting and replenishing section in a copier and thereby prevents the copier from being increased in size. Particularly, it is not necessary to dispose a large capacity toner supply device in the copier. This prevents the copier from occupying an extremely broad space.

Because the toner collecting section and toner replenishing section and the copier are connected by flexible pipes, the above sections can be provided with large capacities without regard to the space available for the copier.

The members constituting the toner collecting section directly turn out the members for recirculating the collected toner. This eliminates the need for a toner collecting section and a toner replenishing section independent of each other. Therefore, the combined toner collecting section and replenishing section are miniature.

In summary, it will be seen that the present invention provides an image forming system having various unprecedented advantages, as enumerated below.

(1) The system controls a single developer supply section for supplying a developer to the developing devices of a plurality of image forming apparatuses without regard to the number of the apparatuses. This reduces the area to be exclusively assigned to toner replenishing sections.

(2) The system allows the developer supply section and the developing devices to be connected to each other without regard to their positional relation. This makes it needless to install a developer replenishing section in each image forming apparatus, thereby reducing the volume to be occupied by the developing device in each apparatus.

(3) A developer transport mechanism is arranged within a developer replenishing section. Hence, the replenishing section and developing section can be maintained independently of each other. It follows that a mechanism for developer replenishment can be maintained alone with ease.

(4) The developer replenishing mechanism is removable from the developing device and closes, when removed, its opening communicating to the developing device. This prevents the developer from flying about and contaminating the surroundings in the event of maintenance of the replenishing section.

(5) When the developer to be replenished is absent in the developing device and only if it is present in the supply section, the developer begins to be delivered to the developing device. At this instant, air feeding means is controllably driven at the beginning and end of operation of the image forming apparatus. Therefore, when the developer is implemented as a toner and carrier mixture, among others, the cohesion of the toner which would result in the defective operation of the replenishing mechanism is obviated. This successfully prevents the operating efficiency from being lowered when use is made of a plurality of image forming apparatuses.

(6) A single developer storage and circulation device is shared by a plurality of image forming apparatuses and capable of delivering and collecting the developer from all of them. This reduces the space to be occupied by the individual apparatus, the duration of the nonoperating state of the apparatus, and the interval between the consecutive replacements of the developer.

(7) The system promotes the free layout of the developing means and developer storage and circulation device and allows them to be surely and easily connected to each other. Further, the system simplifies the arrangement of the developing means and developer storage and circulation device, while enhancing easy maintenance of the device.

(8) The system guarantees the transport of the developer from the storage and circulation device to the developing means and the collection thereof from the latter to the former. Further, the system insures the accurate and reliable supply of the developer to the developing means, promotes the free layout of the developing means and storage and circulation device, insures and simplifies connection, simplifies the configuration of the developing means and that of the device, facilitates the assembly of the device, and enhances productivity and easy maintenance.

(9) The system surely distributes the developer to the developing means and simplifies the configuration of the developing means and that of the storage and circulation device.

(10) The system is practicable with a minimum of cost.

(11) The system delivers a constant amount of developer to the individual image forming apparatus without regard to the condition of use of the apparatus, thereby enhancing the accuracy of developer supply.

(12) Developer collecting means and developer supplying means are provided independently of the image forming apparatus. This prevents the apparatus from increasing in size and space. In addition, because the collecting means and supplying means can be maintained independently of the apparatus, the duration of a nonoperating state of the apparatus is reduced.

(13) The collecting means and supplying means are located at a single position and implemented by common members for the storage of the developer. As a result, developer moving mechanisms and members included in the two means are common to each other, so that reliable collection and supply is enhanced. Because the developer remaining in a transport passage is blown away before the collection and supply of the developer, the collecting and supplying mechanisms are free from excessive loads. The common members of the above means reduce the production cost and storage cost of storage members included in the collection section and supply section. In addition, the storage members are easy to handle and allow the developer to be effectively recycled.

Various modifications will become possible for those skilled in the art after receiving the teachings of the present disclosure without departing from the scope thereof. For example, the blade included in the cleaning unit 108 may be replaced with a magnet brush or a fur brush, if desired. Of course, the developer may be a single-ingredient type developer as distinguished from the toner and carrier mixture shown and described. The present invention is practicable even with an image forming system of the type transferring a toner image from a photoconductive element to a belt or similar intermediate transfer body, and then transferring it from the intermediate transfer body to a paper or similar recording medium. In such a case, the present invention may be applied to a device for cleaning the intermediate transfer body.

What is claimed is:

1. An image forming system comprising:

a plurality of image forming apparatuses each for individually electrostatically completely forming a latent image representative of a document image on an image carrier, developing the latent image with a developer stored in a developing device, and transferring a resulting developed image to a recording medium; and a single developer source for supplying the developer to developing devices of all of said plurality of image forming apparatuses.

2. A system as claimed in claim 1, further comprising developer conveying means provided independently of said plurality of image forming apparatus and for connecting said single developer source to said developing devices, wherein said developer conveying means comprises distributing means for switching a direction of developer conveyance to said developing devices.

3. A system as claimed in claim 2, wherein said developer conveying means further comprises a flexible member positioned at an outlet side of said distributing means.

4. A system as claimed in claim 2, wherein said developing devices each has a part thereof located outside of the respective image forming apparatus, and wherein developer supplying means is removably mounted on said part of the developing device in order to introduce a developer and air mixture fed from said developer source via said developer conveying means into said developing device.

5. A system as claimed in claim 4, wherein said developer supplying means comprises a funnel-like developer/air separating portion elongate in a vertical direction, wherein said developer conveying means is connected to an upper portion of said developer/air separating portion at a position eccentric to a center of said developer/air separating portion as seen in a horizontal section, and wherein an opening is formed in a lower portion of said developer/air separating portion and communicatable to said developing device, whereby only the developer is collected from the developer and air mixture.

6. A system as claimed in claim 5, wherein said developer supplying means comprises a dust filter located above said position where said developer conveying means is connected to said developer/air separating portion.

7. A system as claimed in claim 5, wherein said developer supplying means further comprises an opening/closing member constantly biased in a direction for closing said opening, and wherein said opening/closing member allows said opening to communicate with said developing device against a bias acting thereon when mounted to said developing device.

8. A system as claimed in claim 7, wherein said opening/closing member comprises:

a locking member constantly angularly biased in one direction and including a locking portion;

a support member through which a rotatable shaft of said locking member is passed, wherein said support member includes an opening for receiving said lower portion of said developer supplying means;

a rotatable shutter member rotatable integrally with said locking member via said rotatable shaft, and including a developer outlet communicatable to said opening of said developer supplying means; and a stop member removably mounted on a stationary member and including an abutment for receiving said locking portion of said locking member, wherein when said stop member is mounted to said stationary member, said locking portion abuts against said abutment.

9. A system as claimed in claim 1, wherein said developer source comprises developer moving means for moving the developer stored in said developer source toward an outlet.

10. A system as claimed in claim 9, wherein said developer moving means comprises:

a screw pump including a rotor rotatable to move the developer in an axial direction thereof; and air feeding means for feeding compressed air in order to cause the developer being moved by said screw pump to flow in a scattered condition.

11. A system as claimed in claim 10, further comprising:

first sensing means for sensing a concentration and an amount of the developer remaining in said developing device;

second sensing means for sensing an amount of the developer remaining in said developer source; and control means having an input thereof connected to a power switch of the image forming apparatus, wherein said control means receives a signal representative of a remaining amount of the developer from a controller included in said image forming apparatus controlling a replenishment of the developer in accordance with the concentration of the developer, and receives a signal representative of a remaining amount of the developer from said second sensing means, and wherein when the amount of the developer remaining in said image forming apparatus is short and only if the developer exists in said developer source, said control means sends drive signals to drivers for driving said developer moving means and a driver for driving said air feeding means.

12. A system as claimed in claim 11, wherein said control means controls said driver for driving said air feeding means independently of the other drivers.

13. A system as claimed in claim 12, wherein at a beginning of operation of said image forming apparatus said control means drives said driver for driving said air feeding means earlier than the other drivers, but at an end of operation said control means stops said driver for said air feeding means later than the other drivers.

14. An image forming system comprising:

a plurality of image forming apparatuses each for individually completely developing a latent image electrostatically formed on an image carrier with a developer, transferring a resulting developed image to a recording medium and fixing the developed image on the recording medium; and a single developer storage and circulation device for supplying and collecting the developer from said plurality of image forming apparatuses for thereby circulating the developer.

15. A system as claimed in claim 14, wherein the developer comprises a two-ingredient type developer which is a toner and carrier mixture, and wherein said developer storage and circulation device comprises developer correcting means disposed therein for controlling the developer to an adequate condition.

16. A system as claimed in claim 14, wherein said plurality of image forming apparatuses each comprises developing means, and wherein said developer storage and circulation device comprises developer storing means constructed independent of said developing means, and developer conveying means and developer collecting means connecting said developing means and said developer storing means.

17. A system as claimed in claim 16, further comprising:

developer distributing and control means for supplying the developer to said developing means of each of said plurality of image forming apparatuses; and developer collecting and control means for collecting the developer from said developing means.

18. A system as claimed in claim 17, wherein said developer storage and circulation device further comprises:

developer conveying means for supplying the developer from said developer storage and circulation device to said developing means of said plurality of image forming apparatuses; and developer sucking means for collecting the developer from said developing means in said developer storage and circulation device.

19. A system as claimed in claim 18, wherein said developer conveying means comprises screw pump means comprising a rotor and a stator engaged with said rotor and having a passage receiving said rotor, and wherein said developer sucking means comprises air feeding means for feeding compressed air for fluidizing the developer to said screw pump means.

20. A system as claimed in claim 19, further comprising developer gathering means each being located at a most downstream portion of said developer conveying means and at a most downstream portion of said developer collecting means, and for gathering the developer conveyed by said developer conveying means or gathering only the developer by separating air from a developer and air mixture collected by said developer collecting means.

21. A system as claimed in claim 20, wherein said developer distributing and control means intervenes between said screw pump means and said developer gathering means, and wherein said developer collecting and control means intervenes between said developing means and said screw pump means.

22. A system as claimed in claim 21, wherein said developer storage and circulation device further comprises control means for controllably driving said developer conveying means, said developer collecting means, said developer distributing and control means and said developer collecting and control means in order to supply and collect the developer from at least two image forming apparatuses.

23. A system as claimed in claim 17, wherein said developer storage and circulation device further comprises transmitting means for informing developer storing and circulating means of whether or not drive means for driving said developing means of each of said plurality of image forming apparatuses is operated, and wherein said transmitting means controllably drives said developer conveying means, said developer distributing and control means, said developer collecting means, and said developer collecting and control means.

24. A system as claimed in claim 17, wherein said plurality of image forming apparatuses each comprises sensing means for sensing a toner concentration of the developer, and wherein said developer storage and circulation device controllably drives said developer conveying means, said developer distributing and control means, said developer collecting means, and said developer collecting and control means in response to an output of said sensing means.

25. A system as claimed in claim 17, wherein said developer storage and circulation device controls an amount of the developer to be conveyed by said developer conveying means and an amount of the developer to be collected by said developer collecting means on the basis of a number of image forming apparatuses in use.

26. A system as claimed in claim 17, wherein said developer conveying means and said developer collecting means each comprises a screw pump, and wherein said developer storage and circulation device controls a rotation speed of said screw pump on the basis of a number of image forming apparatuses in use.

27. An image forming system comprising:

an image forming apparatus for developing a latent image electrostatically formed on an image carrier with a developer stored in a developing device, and transferring a resulting developed image to a recording medium;

developer supplying means constructed independently of said image forming apparatus and for supplying the developer to said developing device; and developer collecting means for collecting a residual developer removed from the image carrier after an image transfer;

wherein said developer supplying means and said developer collecting means are located at a same position; and wherein said developer supplying means and said developer collecting means each comprises:

a powder pump including a screw-like rotor rotatable to move the developer in an axial direction thereof;

air feeding means located on a path alone which the developer is moved by said powder pump, and for causing the developer to move in a scattered condition; and a connecting member for causing the toner flowing from said air feeding means to move toward said developing device.

28. A system as claimed in claim 27, wherein said powder pump, said air feeding means and said connecting member are located at each of a developer supplying portion and a developer collecting portion.

29. A system as claimed in claim 27, wherein said developer collecting means comprises a developer container removably fitted on a part of said developer supplying means and capable of introducing the developer collected in said developer container into said developer supplying means.

30. A system as claimed in claim 29, wherein said developer container has a capacity which is between one-tenth and one-fifth of a capacity of said developer supplying member.

31. A system as claimed in claim 29, wherein said developer collecting means comprises a member for discharging air used to convey the developer.

32. A system as claimed in claim 31, wherein said member is removable from said developer container.

* * * * *